US009163450B2

(12) United States Patent
Messenger

(10) Patent No.: US 9,163,450 B2
(45) Date of Patent: Oct. 20, 2015

(54) METHOD FOR FLASHING A WINDOW OR DOOR OPENING

(71) Applicant: Gary William Messenger, Pomona, CA (US)

(72) Inventor: Gary William Messenger, Pomona, CA (US)

( * ) Notice: Subject to any disclaimer, the term of this patent is extended or adjusted under 35 U.S.C. 154(b) by 24 days.

(21) Appl. No.: 14/457,262

(22) Filed: Aug. 12, 2014

(65) Prior Publication Data

US 2015/0047269 A1 Feb. 19, 2015

Related U.S. Application Data

(60) Provisional application No. 61/959,018, filed on Aug. 13, 2013.

(51) Int. Cl.

| | |
|---|---|
| ***E04D 1/36*** | (2006.01) |
| ***E04D 3/38*** | (2006.01) |
| ***E04D 13/14*** | (2006.01) |
| ***E06B 7/14*** | (2006.01) |
| ***E06B 1/62*** | (2006.01) |

(52) U.S. Cl.
CPC .... *E06B 7/14* (2013.01); *E06B 1/62* (2013.01)

(58) Field of Classification Search
CPC ..... E04B 1/64; E04B 1/66; E06B 1/62; E06B 1/70; E06B 1/702; E06B 1/705; E06B 2001/628; E06B 7/14; E06B 7/16
See application file for complete search history.

(56) References Cited

U.S. PATENT DOCUMENTS

| | | | | |
|---|---|---|---|---|
| 6,103,356 | A * | 8/2000 | Messenger | 428/215 |
| 6,401,402 | B1 * | 6/2002 | Williams | 52/58 |
| 7,735,291 | B2 | 6/2010 | Summy | |
| 8,399,088 | B2 | 3/2013 | Deng et al. | |
| 2001/0034984 | A1 * | 11/2001 | Murphy et al. | 52/204.5 |
| 2003/0177736 | A1 * | 9/2003 | Gatherum | 52/741.1 |
| 2005/0166471 | A1 * | 8/2005 | Allen | 52/58 |
| 2006/0101726 | A1 * | 5/2006 | Collins | 52/58 |
| 2006/0130426 | A1 * | 6/2006 | O'Rourke et al. | 52/745.16 |
| 2007/0289226 | A1 * | 12/2007 | Lokkart | 52/62 |
| 2008/0104917 | A1 | 5/2008 | Whelan et al. | |
| 2009/0090068 | A1 | 4/2009 | O'rourke | |
| 2009/0145067 | A1 * | 6/2009 | Tatley et al. | 52/411 |
| 2010/0170186 | A1 * | 7/2010 | Hohmann, Jr. | 52/741.4 |
| 2012/0079788 | A1 * | 4/2012 | Floren et al. | 52/741.4 |
| 2012/0186665 | A1 * | 7/2012 | Vos et al. | 137/343 |
| 2013/0186009 | A1 | 7/2013 | Hart | |
| 2014/0059969 | A1 | 3/2014 | Summy | |
| 2014/0250801 | A1 * | 9/2014 | Knollmeyer | 52/58 |

* cited by examiner

*Primary Examiner* — Brian D Mattei
(74) *Attorney, Agent, or Firm* — Christie, Parker & Hale, LLP

(57) ABSTRACT

A method for flashing an opening defined by a bottom sill, a pair of side jambs, and a top header includes forming a sill diverter dam at the bottom sill to receive a backside of a door or window frame with an adhesive strip placed along the sill diverter dam. The method further includes applying a sheet of flexible membrane at each intersection of the bottom sill and each side jamb, attaching a strip of weep flashing to the wall overlapping the diverter dam at the bottom sill, applying sealant along an upper edge of the door or window frame, attaching a jamb diverter sheet to the wall at each side jamb, applying sealant to the door or window frame, placing the door or window frame in the opening, applying additional sealant along the top header, and attaching a header diverter sheet to the wall along the top header.

12 Claims, 40 Drawing Sheets

STEP 5 – CUT OR SCORE

STEP 6 – FOLD DIAGONAL CREASE

STEP 7 – FOLD OUTER SECTION OVER WALL 20

STEP 8 – APPLICATION OF SEALANT 172 OR
SHEET OF FLEXIBLE MEMBRANE 175

METHOD FOR FLASHING A WINDOW OR DOOR OPENING

CROSS-REFERENCE TO RELATED APPLICATION

This application claims priority to and the benefit of U.S. Provisional Patent Application No. 61/959,018, filed in the U.S. Patent and Trademark Office on Aug. 13, 2013, the entire contents of which are incorporated herein by reference.

FIELD OF THE INVENTION

This invention is directed to waterproofing and sealing of structural joints and surfaces around flat or recessed window and door frames, and the like. More particularly, this invention is directed to a method for flashing a window, door, or other opening.

BACKGROUND OF THE INVENTION

Installation of windows or doors in a building structure, for example, requires adequate sealing and protection against moisture penetration in the form of waterproof and water-tight sealing of the structural joints and surfaces around openings in exterior walls where the windows and doors will be installed. Employed sealing and waterproofing mechanisms must also allow moisture to weep from the opening or area where the sealing and protection against moisture penetration is required. This waterproof and water-tight sealing of structural joints and surfaces to prevent moisture penetration may be particularly complicated at window and door opening corners where traditional flashing techniques and materials are difficult to correctly implement, or where the window or door may be recessed from the exterior or interior of the finished wall.

A number of different waterproofing or flashing methods and devices employing a variety of different techniques and materials for sealing joints and surfaces of openings currently exist. A number of these different methods and devices specifically for sealing recessed openings also exist. However, these existing methods and devices often require onsite fabrication of a flashing device or system, additional sealing steps, or application of additional weather resistant barrier or flashing layers to properly seal against moisture penetration at the window and door openings. Accordingly, a need exists for a flashing method that is quick and easy to install and has a versatile and adaptable application for use at a variety of window and door opening types, whether flat or recessed.

SUMMARY

Aspects of the present invention provide improved methods for flashing flat or recessed windows or doors, or other openings. According to additional aspects of the present invention, a moisture diversion method or sealing mechanism may include diverter sheets at all side of an opening configured to receive a door or window frame, and can be utilized in new building construction, retrofits, and/or post construction applications. According to other aspects of the present invention, the diverter sheets may be versatile to accommodate an array of window or door opening sizes.

In one embodiment, a method for flashing an opening in a wall configured to receive a flat door or window frame, the opening defined by a bottom sill, a pair of side jambs, and a top header, includes forming a sill diverter dam at the bottom sill. Forming a sill diverter dam at the bottom sill may include attaching a sill diverter sheet having a center strip, an outer edge, and an inner edge along an entire length of the bottom sill with the center strip forming a shelf on the bottom sill, cutting outermost ends of the outer edge and inner edge to form a wall flap and a jamb flap at each respective side jamb where the center strip extends past the bottom sill, and folding the outer edge of the diverter sheet down with the outer edge and each wall flap flush against the wall and folding each jamb flap up flush with its respective side jamb, folding the inner edge of the diverter sheet up, thereby forming a diverter flap configured to receive a backside of the door or window frame configured to be installed at the opening. The method may also include applying a sheet of flexible membrane at each intersection of the bottom sill and each side jamb over the sill diverter dam, stretching each sheet of flexible membrane over an outside edge of the respective intersection and flush with the outer edge of the sill diverter dam at the wall adjacent the opening. The method may further include attaching a lower strip of weep flashing to the wall overlapping the outer edge of the sill diverter sheet of the sill diverter dam adjacent the opening at the bottom sill with the lower strip of weep flashing extending along at least an entire length of the bottom sill, applying sealant along an upper edge of the door or window frame along the top header, and attaching a jamb diverter sheet to the wall adjacent the opening at each side jamb and extending at least a height of each side jamb and partially over the sealant applied along the upper edge of the door or window frame. The method may further include applying sealant along an inside flange of the door or window frame, placing the door or window frame in the opening, applying sealant along an outside flange of the door or window frame and over an outside edge of the door or window frame to the extend to the wall surrounding the opening, and applying sealant along the entire length of the opening at the upper edge of the door or window frame along the top header in an upside-down V-shape applied starting at a center of the opening and running down to each opening corner. The method may further include attaching a header diverter sheet to the wall over the sealant in the upside-down V-shape and over the door or window frame along the upper edge at the top header, placing an adhesive strip along the diverter flap configured to attach the diverter flap to the backside of the door or window frame, and attaching a lower edge of the door or window frame to the sill diverter dam with the adhesive strip.

In another embodiment, the adhesive strip may be double-sided tape. In an embodiment, the double-sided tape may be 3/16 inch thick. In another embodiment, the double-sided tape may be 3/8 inch thick.

In another embodiment, the diverter flap may be at least one-inch in height such that the center strip of the sill diverter sheet is at least as wide as the door or window frame and the diverter flap extends up one inch.

In another embodiment, the sill diverter sheet, the lower strip of weep flashing, each jamb diverter sheet, and the header diverter sheet each may be made of a non-adhesive self-sealing laminate membrane having a central core sheet of bituminous rubberized-asphalt with self-sealing properties.

In another embodiment, the methods of attaching the sill diverter sheet, attaching the lower strip of weep flashing, attaching each jamb diverter sheet, and attaching the header diverter sheet each may include attaching the non-adhesive self-sealing laminate for structural sealing using sealant, nails, screws, tacks, fasteners, or staples.

In another embodiment, the sheet of flexible membrane at each intersection may be a strip of stretchable film or tape cut into six-inch by six-inch pieces.

In another embodiment, applying the sheet of flexible membrane at each intersection of the bottom sill and each side jamb over the sill diverter dam may include attaching the sheet of flexible membrane using adhesive, sealant, nails, screws, tacks, fasteners, or staples.

According to additional aspects of the present invention, a method for flashing an opening in a wall configured to receive a recessed door or window frame having a production recess, the opening defined by a bottom sill, a recessed sill stepped externally down and out from the bottom sill, a pair of side jambs at the bottom sill, a pair of recessed jambs at the recessed sill, a top header in line with the bottom sill, and a recessed top header stepped externally up and out from the top header, includes forming a recessed sill diverter dam at the recessed sill. Forming a recessed sill diverter dam at the recessed sill may include attaching a sill diverter sheet having a center strip, an outer edge, and an inner edge along an entire length of the recessed sill with the center strip forming a shelf along the recessed sill with the inner edge extending up a height to the bottom sill, and cutting outermost ends of the outer edge and inner edge to form a wall flap and a jamb flap at each respective recessed jamb where the center strip extends past the recessed sill, and folding the outer edge of the diverter sheet down such that the outer edge and each wall flap are flush against the wall and folding each jamb flap up flush with its respective recessed jamb with the inner edge flush against the step between the recessed sill and the bottom sill. The method may further include applying an adhesive at each intersection of the recessed sill and each recessed jamb over the recessed sill diverter dam and applying a sheet of flexible membrane at each intersection of the recessed sill and each recessed jamb over the recessed sill diverter dam over the adhesive applied at each intersection, and stretching each sheet of flexible membrane over an outside edge of the respective intersection and flush with the wall. The method may further include applying an adhesive to a top surface of the wall along an upper edge of the opening along the recessed top header. The method may further include forming a recessed jamb diverter strip at each recessed jamb by attaching a recessed jamb diverter sheet to the wall adjacent the opening at each recessed jamb, the recessed jamb diverter sheet having a center strip, an outer edge, and an inner edge along an entire height of each recessed jamb, with the center strip forming a shelf along the height of each recessed jamb and extending up at least to the recessed top header, and cutting outermost ends of the outer edge and inner edge to form a wall flap, a sill flap, a header flap, and a jamb flap at each respective recessed jamb, wherein the center strip extends along the entire height of the respective recessed jamb, folding the outer edge of the recessed jamb diverter sheet including the wall flap around the respective recessed jamb to be flush against the wall adjacent the opening along at least the height of each recessed jamb with the wall flap extending up at least past the recessed top header at the top surface of the wall and down past the recessed sill, folding each jamb flap around the respective recessed jamb to be flush with the respective side jamb at the opening extending along an entire height of the side jamb, folding each sill flap down onto the recessed sill and flush with an inner edge between the recessed sill and the respective recessed jamb, and folding the header flap up onto the recessed top header from each recessed jamb to be flush with an intersection of the recessed top header and each recessed jamb and to be flush with the wall. The method may further include applying sealant along an inside flange of the door or window frame, placing the door or window frame in the opening, and applying sealant along an outside flange of the door or window frame and over an outside edge of the door or window frame to the extend to the wall surrounding the opening. The method may further include attaching a header diverter sheet to the top surface of the wall and over the adhesive along the upper edge of the door or window frame, the header diverter sheet having a center strip, an outer edge, and an inner edge, the center strip extending along an entire length of the recessed top header and extending down from the recessed top header at least to the top header, and cutting outermost ends of the outer edge and inner edge to form a wall flap and a jamb flap, where the center strip extends along the entire length of the recessed top header, the outer edge including the wall flap is folded around the recessed top header flush against the top surface of the wall with the wall flap extending at least past the respective recessed jamb, each jamb flap is folded around the recessed top header extending onto the respective recessed jamb and the inner edge is folded down from the recessed top header down flush with the top header. The method may further include applying an adhesive at each respective intersection of the recessed top header and each recessed jamb, and applying a sheet of flexible membrane at each respective intersection of the recessed top header and each recessed jamb over the adhesive applied at each respective intersection and stretching each sheet of flexible membrane over an outside edge of the intersection and flush with the wall, the top header, and the recessed top header.

In another embodiment, the method may further include applying an adhesive along an upper edge of the door or window frame along the header diverter sheet, and attaching a secondary header diverter sheet to the top surface of the wall and over the header diverter sheet.

In another embodiment, the adhesive used to attach the header diverter sheet and the secondary header diverter sheet may be a sealant applied along the entire length of the opening at the recessed top header and the header diverter sheet, respectively, in an upside-down V-shape applied starting at a center of the opening and running down to each opening corner.

In another embodiment, the adhesive used to attach the header diverter sheet and the secondary header diverter sheet may be double-sided tape placed along the entire length of the opening at the recessed top header in an upside-down V-shape placed starting at a center of the opening and running down to each opening corner. In an embodiment, the double-sided tape may be 3/16 inch thick. In another embodiment, the double-sided tape may be 3/8 inch thick.

In another embodiment, the production recess may have a depth less than or equal to four inches, and the sill diverter sheet may be a twelve-inch wide roll of non-adhesive laminate for structural sealing.

In another embodiment, the production recess may have a depth ranging from four inches to eight inches, and the sill diverter sheet may be an eighteen-inch wide roll of non-adhesive laminate for structural sealing.

In another embodiment, the sill diverter sheet, each recessed jamb diverter sheet, and the header diverter sheet may each be made of a non-adhesive self-sealing laminate membrane having a central core sheet of bituminous rubberized-asphalt with self-sealing properties.

In another embodiment, the methods of attaching the sill diverter sheet, attaching each recessed jamb diverter sheet, and attaching the header diverter sheet may each include attaching the non-adhesive self-sealing laminate for structural sealing using sealant, nails, screws, tacks, fasteners, or staples.

According to additional aspects of the present invention, a method for flashing an opening in a wall configured to receive a recessed window or door frame having a production recess, the opening defined by a bottom sill, a recessed sill stepped externally down and out from the bottom sill, a pair of side jambs at the bottom sill, a pair of recessed jambs at the recessed sill, a top header in line with the bottom sill, and a recessed top header stepped externally up and out from the top header, includes forming a recessed sill diverter dam at the recessed sill. Forming a recessed sill diverter dam may include attaching a sill diverter sheet having a center strip, an outer edge, and an inner edge along an entire length of the recessed sill with the center strip forming a shelf along the recessed sill with the inner edge extending up a height of a step to the bottom sill, and cutting outermost ends of the outer edge and inner edge to form a wall flap and a jamb flap at each respective recessed jamb where the center strip extends past the recessed sill, and folding the outer edge of the sill diverter sheet down such that the outer edge and each wall flap are flush against the wall and folding each jamb flap up flush with its respective recessed jamb with the inner edge flush against the step between the recessed sill and the bottom sill. The method may further include applying an adhesive at each intersection of the recessed sill and each recessed jamb over the recessed sill diverter dam, and applying a sheet of flexible membrane at each intersection of the recessed sill and each recessed jamb over the recessed sill diverter dam over the adhesive applied at each intersection, and stretching each sheet of flexible membrane over an outside edge of the respective intersection and flush with the wall. The method may further include applying an adhesive to a top surface of the wall along an upper edge of the opening along the recessed top header. The method may further include forming a recessed jamb diverter strip at each recessed jamb by attaching a recessed jamb diverter sheet to the wall adjacent the opening at each recessed jamb, the recessed jamb diverter sheet having a center strip, an outer edge, and an inner edge along an entire height of each recessed jamb, with the center strip forming a shelf along the height of each recessed jamb and extending up at least to the recessed top header, and cutting outermost ends of the outer edge and inner edge to form a wall flap, a sill flap, a header flap, and a jamb flap at each respective recessed jamb, wherein the center strip extends along the entire height of the respective recessed jamb, folding the outer edge of the recessed jamb diverter sheet including the wall flap around the respective recessed jamb to be flush against the wall adjacent the opening along at least the height of each recessed jamb with the wall flap extending up at least past the recessed top header at the top surface of the wall and down past the recessed sill, folding each jamb flap around the respective recessed jamb to be flush with the respective side jamb at the opening extending along an entire height of the side jamb, folding each sill flap down onto the recessed sill and flush with an inner edge between the recessed sill and the respective recessed jamb, and folding the header flap up onto the recessed top header from each recessed jamb to be flush with an intersection of the recessed top header and each recessed jamb and to be flush with the wall. The method may further include forming a bottom sill diverter dam at the bottom sill by attaching a sill diverter sheet having a center strip, an outer edge, and an inner edge along an entire length of the bottom sill with the center strip forming a shelf along the bottom sill and the outside edge extending down over and past an entire height of the bottom sill at the step, cutting outermost ends of the outer edge and inner edge to form a wall flap, a diverter flap, and a jamb flap at each respective side jamb with the outer edge extending down from the bottom sill flush down against the step at the recessed sill, the wall flap extending along a thickness of the side jamb to be flush with the recessed jamb, and each jamb flap folded up flush with its respective side jamb, and folding the inner edge of the sill diverter sheet up along the length of the bottom sill and at the side jamb where each jamb flap is folded up, forming the shelf with the diverter flap extending along the entire length of the bottom sill as well as along a height of each side jamb configured to receive a backside of the door or window frame configured to be installed at the opening. The method may further include applying a sheet of flexible membrane at each intersection of the bottom sill and each side jamb over the bottom sill diverter dam, and stretching each sheet of flexible membrane over an outside edge of the respective intersection and flush with the step. The method may further include attaching a lower strip of weep flashing to the step between the bottom sill and the recessed sill overlapping the outer edge of the bottom sill diverter dam adjacent the opening at the bottom sill, the lower strip of weep flashing extending along at least an entire length of the recessed sill, applying sealant along an inside flange of the door or window frame, placing the door or window frame in the opening, applying sealant along an outside flange of the door or window frame and over an outside edge of the door or window frame to the extend to the wall surrounding the opening. The method may further include attaching a header diverter sheet to the top surface of the wall and over the adhesive along the upper edge of the door or window frame, the header diverter sheet having a center strip, an outer edge, and an inner edge, the center strip extending along an entire length of the recessed top header and extending down from the recessed top header at least to the top header, and cutting outermost ends of the outer edge and inner edge to form a wall flap and a jamb flap, where the center strip extends along the entire length of the recessed top header, the outer edge including the wall flap is folded around the recessed top header flush against the top surface of the wall with the wall flap extending at least past the respective recessed jamb, each jamb flap is folded around the recessed top header extending onto the respective recessed jamb and the inner edge is folded down from the recessed top header down flush with the top header. The method may further include applying an adhesive at each respective intersection of the recessed top header and each recessed jamb and applying a sheet of flexible membrane at each respective intersection of the recessed top header and each recessed jamb over the adhesive applied at each respective intersection and stretching each sheet of flexible membrane over an outside edge of the intersection and flush with the wall, the top header, and the recessed top header. The method may further include placing an adhesive strip along the diverter flap of the sill diverter dam, the adhesive strip being configured to attach the diverter flap to the backside of the door or window frame, and attaching a lower edge of the door or window frame to the bottom sill diverter dam with the adhesive strip.

In another embodiment, the method may further include applying an adhesive along an upper edge of the door or window frame along the header diverter sheet, and attaching a secondary header diverter sheet to the top surface of the wall and over the header diverter sheet.

In another embodiment, applying the sheet of flexible membrane at each intersection of the bottom sill and each side jamb over the bottom sill diverter dam may include attaching the sheet of flexible membrane using adhesive, sealant, nails, screws, tacks, fasteners, or staples.

In another embodiment, the adhesive used to attach the header diverter sheet and the secondary header diverter sheet may a sealant be applied along the entire length of the opening at the recessed top header and the header diverter sheet, respectively, in an upside-down V-shape applied starting at a center of the opening and running down to each opening corner.

In an embodiment, the adhesive strip may be double-sided tape. In an embodiment, the double-sided tape may be 3/16 inch thick. In an embodiment, the double-sided tape may be 3/8 inch thick.

In another embodiment, the production recess may have a depth less than or equal to four inches, and the sill diverter sheet may be a twelve-inch wide roll of non-adhesive laminate for structural sealing.

In another embodiment, the production recess may have a depth ranging from four inches to eight inches, and the sill diverter sheet may be an eighteen-inch wide roll of non-adhesive laminate for structural sealing.

In another embodiment, each sill diverter sheet, each recessed jamb diverter sheet, the lower strip of weep flashing, and the header diverter sheet may each be made of a non-adhesive self-sealing laminate membrane having a central core sheet of bituminous rubberized-asphalt with self-sealing properties.

In another embodiment, the methods of attaching each sill diverter sheet, attaching each recessed jamb diverter sheet, attaching the lower strip of weep flashing, and attaching the header diverter sheet may each include attaching the non-adhesive self-sealing laminate for structural sealing using sealant, nails, screws, tacks, fasteners, or staples.

According to additional aspects of the present invention, a kit for flashing an opening in a wall configured to receive a door or window frame, the opening defined by a bottom sill, a pair of side jambs, and a top header, includes at least one sill diverter sheet for forming a sill diverter dam at the bottom sill of the opening, a sheet of flexible membrane for each respective intersection of the bottom sill and each side jamb, a lower strip of weep flashing, a jamb diverter sheet for each respective side jamb, a header diverter sheet, and adhesive material including adhesive strips and sealant. The sill diverter sheet, the lower strip of weep flashing, each jamb diverter sheet, and the header diverter sheet each may be made of a non-adhesive self-sealing laminate membrane having a central core sheet of bituminous rubberized-asphalt with self-sealing properties.

In another embodiment, the kit for flashing an opening may further include a sheet of flexible membrane for each respective intersection of a recessed sill and each recessed jamb. The opening may be further defined by the recessed sill stepped externally down and out from the bottom sill, a pair of recessed jambs at the recessed sill, and a recessed top header stepped externally up and out from the top header. The kit for flashing an opening may also include a recessed jamb diverter sheet for each of the recessed jambs to form respective recessed jamb diverter strips, a sheet of flexible membrane for each intersection of the recessed top header and each recessed jamb, and a secondary header diverter sheet. Each recessed jamb diverter sheet and the secondary header diverter sheet may be made of a non-adhesive self-sealing laminate membrane comprising a central core sheet of bituminous rubberized-asphalt with self-sealing properties.

This summary is provided to introduce a selection of concepts that are further described below in the detailed description. This summary is not intended to identify key or essential features of the claimed subject matter, nor is it intended to be used in limiting the scope of the claimed subject matter. Numerous advantages and benefits of the inventive subject matter disclosed herein will become apparent to those of ordinary skill in the art upon reading and understanding the present specification.

BRIEF DESCRIPTION OF THE DRAWINGS

The inventive subject matter disclosed herein can take form in various components and arrangements of components, and in various steps and arrangements of steps. The drawings are only for purposes of illustrating embodiments and are not to be construed as limiting. Further, it is to be appreciated that the drawings may not be to scale.

Embodiments of a method for flashing a window or door according to the present invention are described herein with reference to the following figures. The same reference numerals are used throughout the figures to reference like features and components.

DETAILED DESCRIPTION

For clarity and simplicity, the present specification shall refer to structural and/or functional elements, relevant standards and/or protocols, and other components that are commonly known in the art without further detailed explanation as to their configuration or operation except to the extent they have been modified or altered in accordance with and/or to accommodate the embodiments presented herein.

Aspects of the present invention relate to waterproofing and sealing of structural joints and surfaces around flat or recessed window and door frames, and the like. More particularly, this invention is directed to a method for flashing a window, door, or other opening. The method for flashing a window, door, or opening of the present invention has an adaptable application for variations in corner seams and angles and for allowance for recesses in the door, window, or other opening frame, while minimizing the installation process and time and resulting in a reduction of costs. The flashing material, according to some embodiments, has self-sealing properties where the flashing may be connected to a wall or other surface surrounding an opening using conventional fasteners such as nails, staples, or tacks without compromising the sealing properties of the flashing material.

Figure 1:
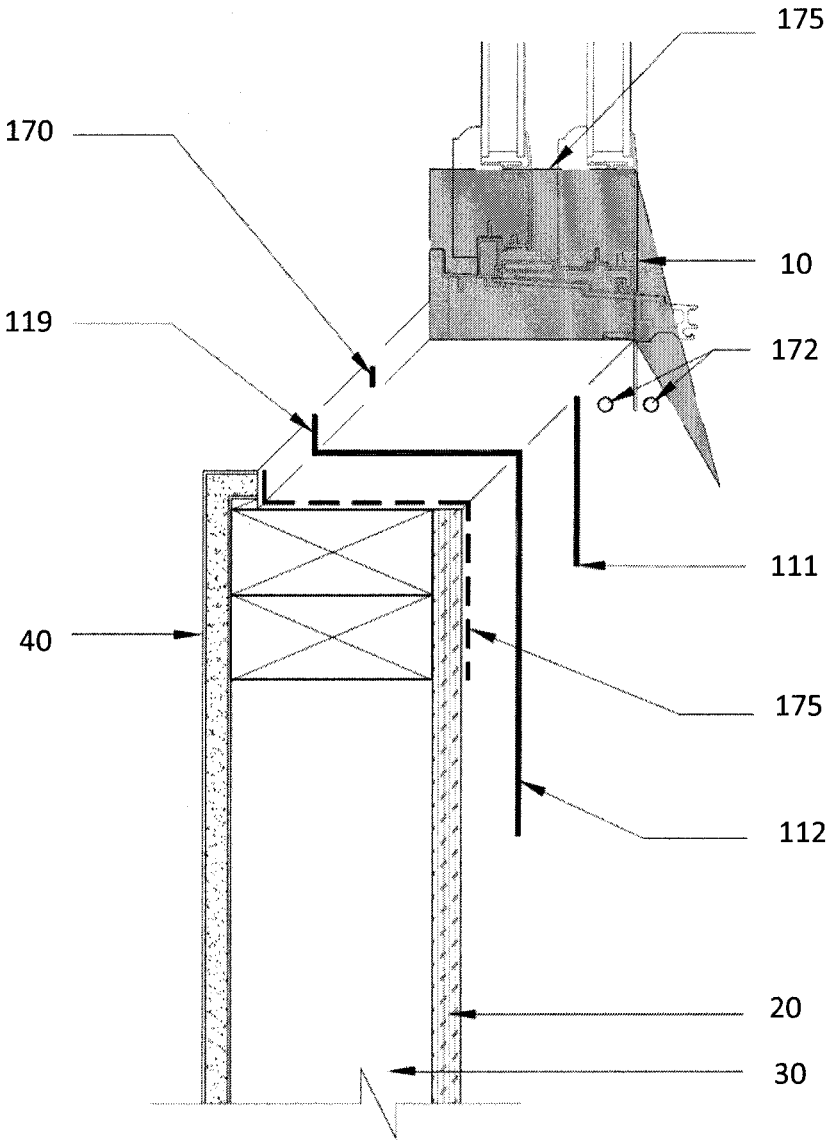
FIG. 1 is an exploded perspective view illustrating a method for flashing an opening in a wall configured to receive a flat door or window frame according to an embodiment of the present invention.

According to a first embodiment of the present invention illustrated in FIGS. 1, 2, 3A-3C, and 4A-4F, a method for flashing an opening 50 in a wall 20, 40 configured to receive a flat door or window frame 10 is shown. The wall 20, 40, according to embodiments of the present invention, for example as shown in FIGS. 1, 5, and 8, may include a wall assembly having an interior wall 40, for example, drywall positioned within an interior of a structure receiving a window or door, and an exterior wall 20, for example, a shear panel or a plywood shear panel, the exterior wall having a main exterior surface 20 and a top surface 20*b* above the opening 50. Framing 30, for example wood, steel, aluminum, or other types of framing suitable in building and other structural construction may be positioned within this wall assembly, the framing may also form part of a bottom sill 110, a pair of side jambs 130*a* and 130*b*, and/or a top header 150 defining the opening 50 in the wall 20, 40 configured to receive a flat window or door frame 10.

Figure 2:
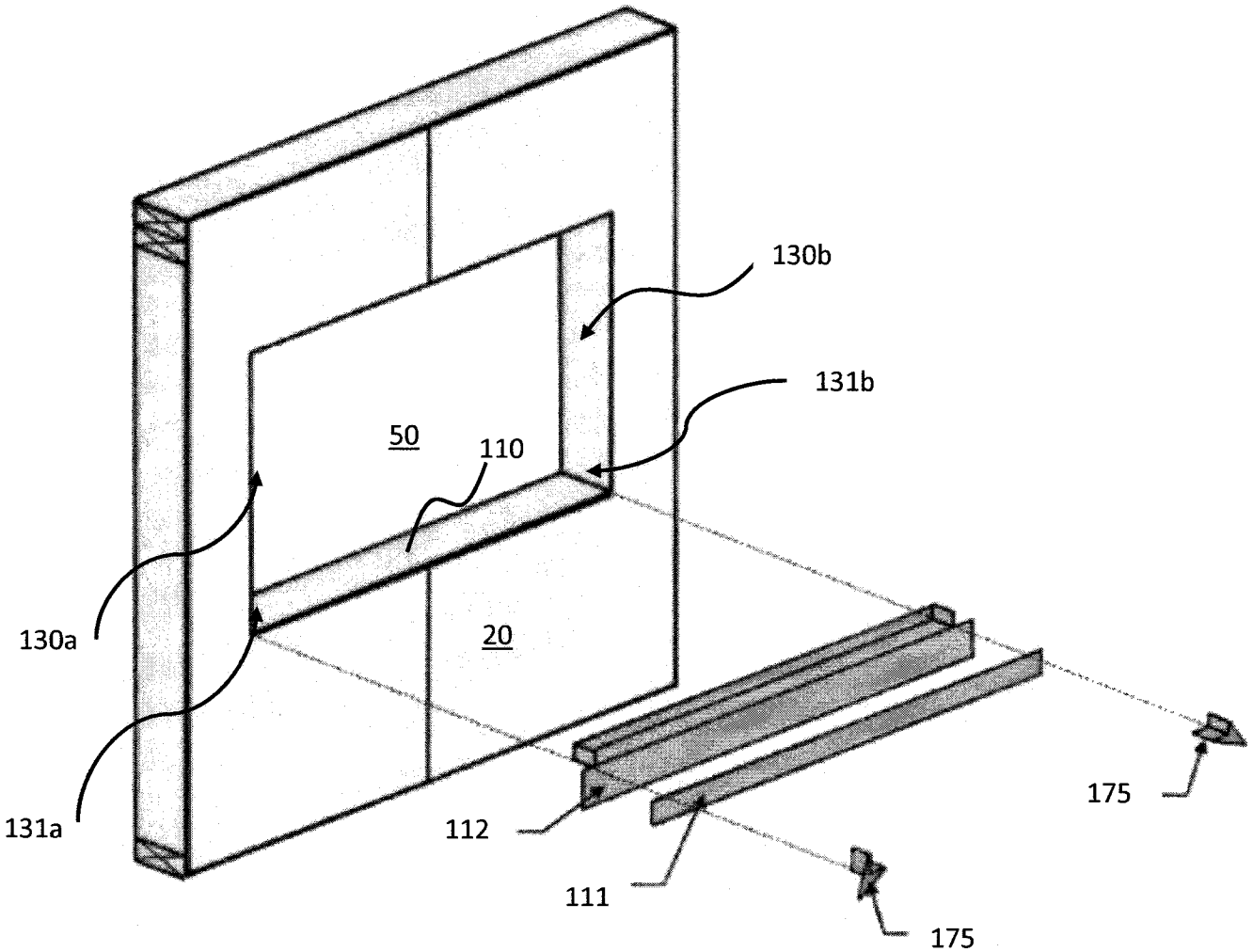
FIG. 2 is an exploded perspective view illustrating tasks of forming a sill diverter dam at a bottom sill, attaching a lower strip of weep flashing, and applying a sheet of flexible membrane according to the method for flashing an opening illustrated in FIG. 1.
Figure 3A:
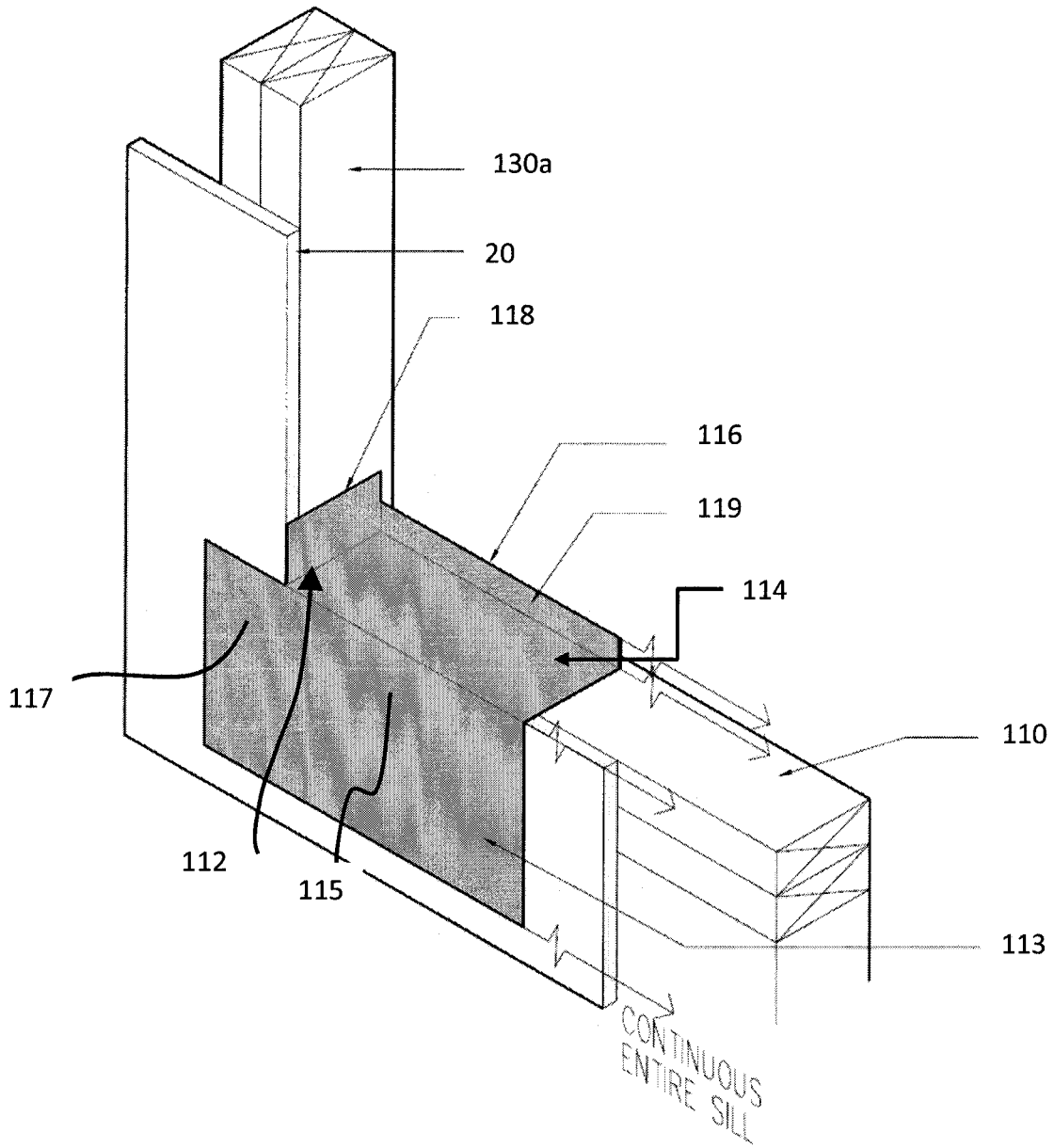
FIG. 3A is a partial perspective view illustrating the task of forming the sill diverter dam at the bottom sill illustrated in FIG. 2 and according to the method for flashing an opening illustrated in FIG. 1.

With continued reference to the embodiments illustrated in FIGS. 2 and 3A, a method for flashing an opening 50 in a wall 20, 40 configured to receive a flat door or window frame 10 includes forming a sill diverter dam 112 at the bottom sill 110. Forming the sill diverter dam 112 according to this embodiment includes attaching a sill diverter sheet 113 having a center strip 114, an outer edge 115, and an inner edge 116 along an entire length of the bottom sill 110 with the center strip 114 forming a shelf on the bottom sill 110. In this embodiment, the outermost ends of the outer edge 115 and inner edge 116 may be cut to form a wall flap 117 and a jamb flap 118 at each respective side jamb 130*a* and 130*b* (shown in FIG. 2) where the center strip 114 extends past the bottom sill 110, and the outer edge 115 of the diverter sheet 113 may be folded down so that the outer edge 115 and each wall flap 117 is flush against the wall 20. Each jamb flap 118, in this embodiment, may be folded up flush with its respective side jamb 130*a* and 130*b*.

Forming the sill diverter dam 112, according to this embodiment, may further include forming a diverter flap 119 by folding the inner edge 116 of the diverter sheet 113 up. The diverter flap 119, according to this embodiment, may be configured to receive a backside of the door or window frame 10 configured to be installed at the opening 50. In this embodiment, in order to allow sufficient overlap for attaching the door or window frame 10 to the diverter flap 119, the sill diverter sheet 113 may be cut at least 1 inch wider than a depth of the door or window frame 10 and placed at the bottom sill 110 in line with the exterior wall 20 face where the door or window frame 10 is to be installed (flush) such that the at least extra 1 inch in width is folded up at the inner edge 116 extending up. According to this embodiment, an adhesive strip 170 may then be placed along the diverter flap 119, the adhesive strip 170 being configured to attach the diverter flap 119 to the backside of the door or window frame 10. According to an embodiment, the adhesive strip 170 may be placed along the diverter flap 119 after installation of the door or window frame in the opening 50, or prior. The adhesive strip 170, according to an embodiment, may be double-sided tape. For example, in an embodiment, the adhesive strip 170 may be double-sided tape having a thickness of ⅜ inch, for example double-sided tape manufactured by TREMCO. In another embodiment, the adhesive strip 170 may be double-sided tape having a thickness of 3⁄16 inch.

The sill diverter sheet 113, according to an embodiment, may be a non-adhesive laminate for structural sealing, for example the waterproof membrane material described in U.S. Pat. No. 6,103,356 to Messenger, incorporated herein, in its entirety, by reference. In the embodiment shown, the sill diverter sheet 113 is a 9 inch wide or 12 inch wide flexible sheet of FUTURE FLASH® self-sealing waterproof flashing membrane, manufactured my MFM Building Products Corp., including an inner sheet of polyester (Mylar® brand) and an outer sheet of cross-laminated polyurethane sandwiched around an inner core of rubberized asphalt, for example Bituthene® brand, and having a nominal thickness of 40 mils. In other embodiments, the sill diverter sheet 113 may have a width less than or greater than 9 or 12 inches (for example, 3, 6, 18, or 36 inches), and may have a nominal thickness less than 40 mils (for example, 25 mils or 35 mils). However, the present invention is not limited to the disclosure in this reference or to these embodiments. For example, in some embodiments, the sill diverter sheet 113 may be made of any flexible, generally water-resistant material such as a sheet of a polymeric film or fabric made of a material such as polyethylene.

Figure 3B:
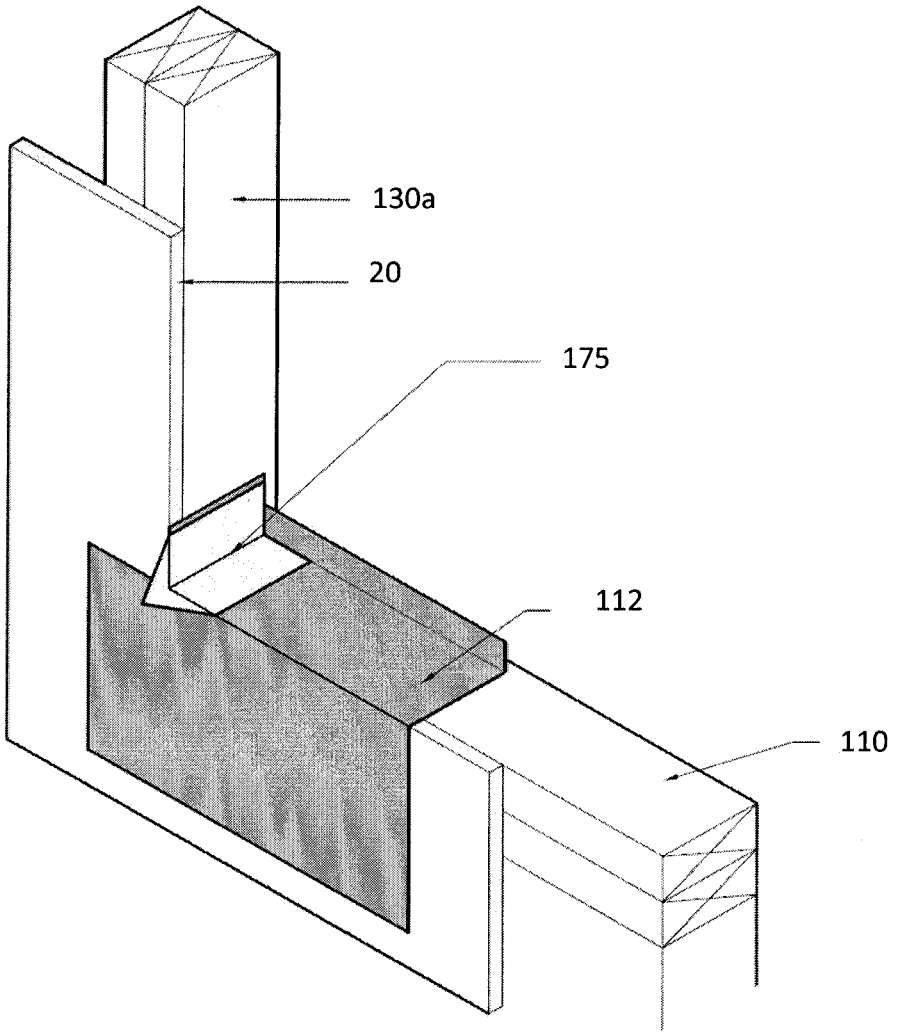
FIG. 3B is a partial perspective view illustrating the task of applying the sheet of flexible membrane illustrated in FIG. 2 and according to the method for flashing an opening illustrated in FIG. 1.

With continued reference to the embodiments illustrated in FIGS. 2 and 3B, the method for flashing an opening 50 in a wall 20, 40 configured to receive a flat door or window frame 10 further includes applying a sheet of flexible membrane 175 at each intersection 131*a* and 131*b* of the bottom sill 110 and each side jamb 130*a* and 130*b* over the sill diverter dam 112 and stretching each sheet of flexible membrane 175 over an outside edge of the respective intersection 131*a* and 131*b* and flush with the outer edge 115 of the sill diverter dam 112 at the wall 20 adjacent to the opening 50. The sheet of flexible membrane 175, according to this embodiment, may be a strip of stretchable film or tape, for example, having a hexagonal or pentagonal shape with a quasi-triangular portion stretched over the outside edge of the respective intersection 131*a* or 131*b* and trimmed flush to a backside of the of the door or window frame 10. In an embodiment, the sheet of flexible membrane 175 may be precut at its corners to streamline installation at the corners or to facilitate bending, stretching, or installation. In an embodiment, the sheet of flexible membrane 175 may be a 4 inch by 6 inch strip of stretchable self-adhering, pliable polymer surface membrane or tape having a hexagonal or pentagonal shape, for example, Butterfly Tape™ manufactured by MFM Building Products Corp., and having a nominal thickness of 35 mils. In another embodiment, the sheet of flexible membrane 175 may be a 6 inch by 6 inch strip of stretchable self-adhering, pliable polymer surface membrane or tape having a hexagonal or pentagonal shape, for example, the Butterfly Tape™ described above. The sheet of flexible membrane 175, according to these embodiments, may be applied at each intersection 131*a* and 131*b* of the bottom sill 110 and each side jamb 130*a* and 130*b* over the sill diverter dam 112 and attached at each respective location using adhesive, sealant, nails, screws, tacks, fasteners, or staples. In an embodiment, the sealant used to attach the respective sheets of flexible membrane 175 may be sealant 172, such as a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

Figure 3C:
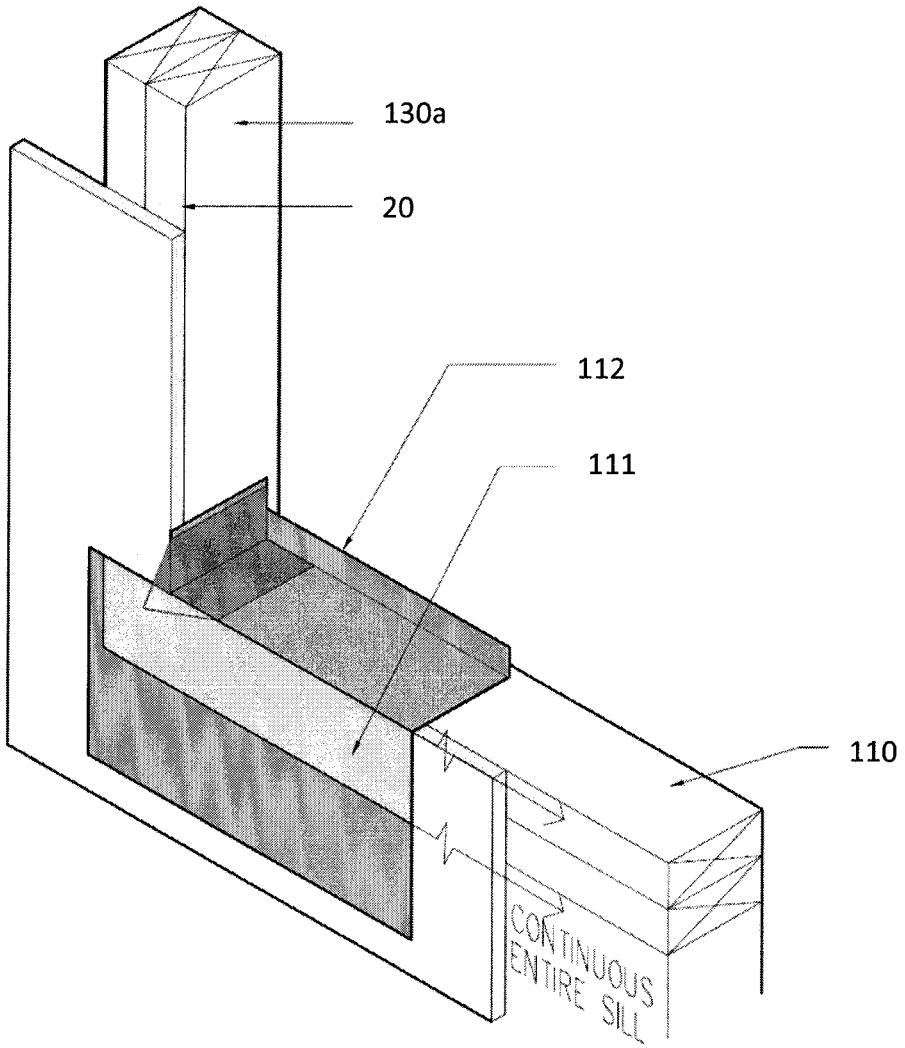
FIG. 3C is a partial perspective view illustrating the task of attaching the lower strip of weep flashing illustrated in FIG. 2 and according to the method for flashing an opening illustrated in FIG. 1.

With continued reference to the embodiments illustrated in FIGS. 2 and 3C, the method for flashing an opening 50 in a wall 20, 40 configured to receive a flat door or window frame 10 further includes attaching a lower strip of weep flashing 111 to the wall 20 overlapping the outer edge 115 of the sill diverter sheet 113 of the sill diverter dam 112 adjacent to the opening 50 at the bottom sill 110. The lower strip of weep flashing 111, according to this embodiment, extends along at least an entire length of the bottom sill 110. The lower strip of weep flashing 111, according to this embodiment, may be a non-adhesive laminate for structural sealing, for example a 3 inch wide flexible sheet of FUTURE FLASH® self-sealing waterproof flashing membrane, as described above, and having a nominal thickness of 25 mils. In other embodiments, the lower strip of weep flashing 111 may have a width greater than three inches (for example, 6, 9, 12, 18, or 36 inches), and may have a nominal thickness greater than 25 mils (for example, 35 mils or 40 mils). However, embodiments of the present invention are not limited to these embodiments.

With reference to the embodiments illustrated in FIGS. 1, 4A, 4B, and 4C, the method for flashing an opening 50 in a wall 20, 40 configured to receive a flat door or window frame 10 according to these embodiments further includes applying sealant 172 along an upper edge of the door or window frame 50 along the top header 150. The sealant 172, according to an embodiment, includes applying a continuous bead of sealant 172, for example, a one-half inch bead of sealant 172 horizontally along the top header 150 at the top surface 20*b* of the wall 20. The sealant 172, according to an embodiment, may be a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

Figure 4A:
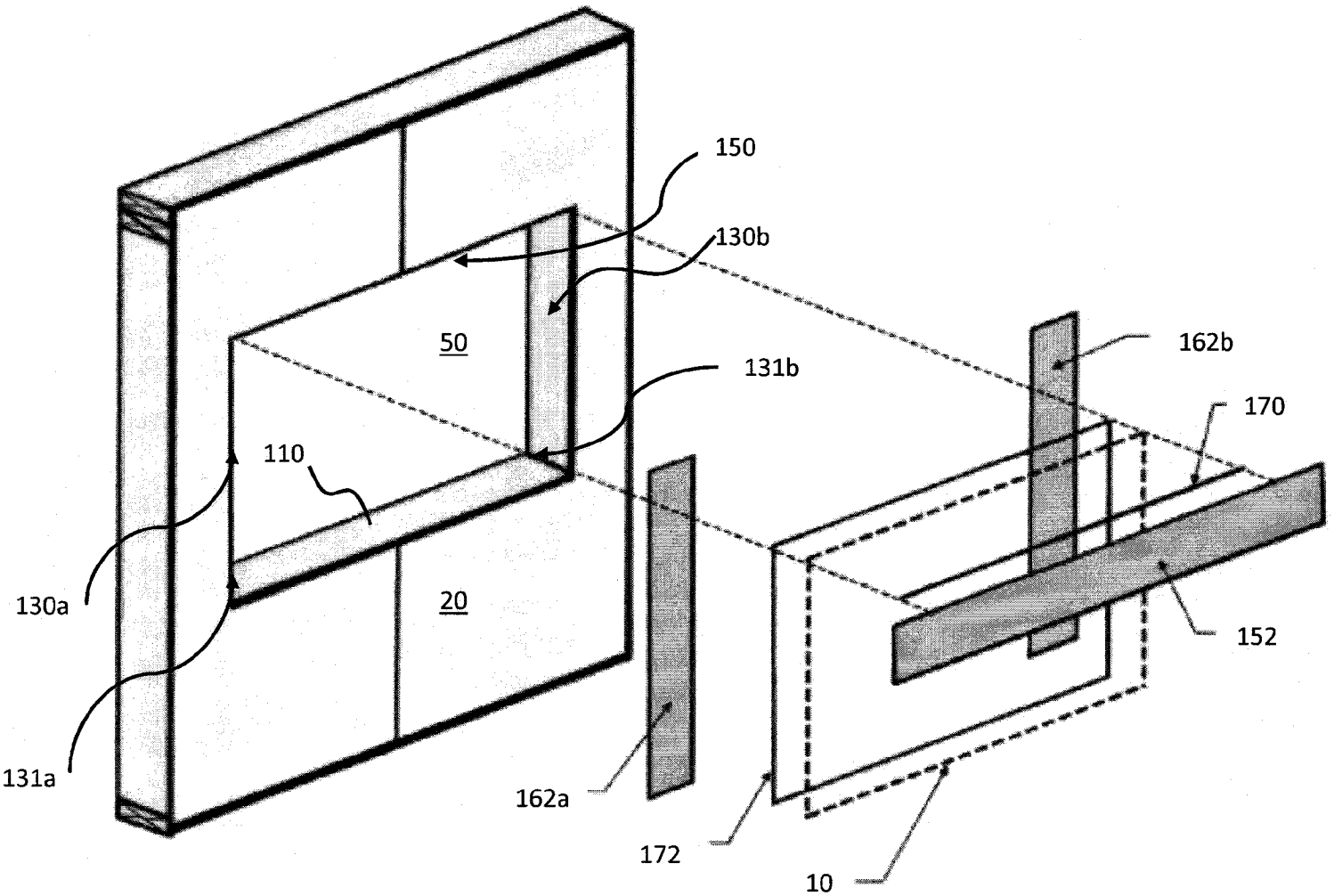
FIG. 4A is an exploded perspective view illustrating additional tasks of attaching a jamb diverter sheet, applying sealant, placing a door or window frame in the opening, and attaching a header diverter sheet according to the method for flashing an opening illustrated in FIG. 1.
Figure 4B:
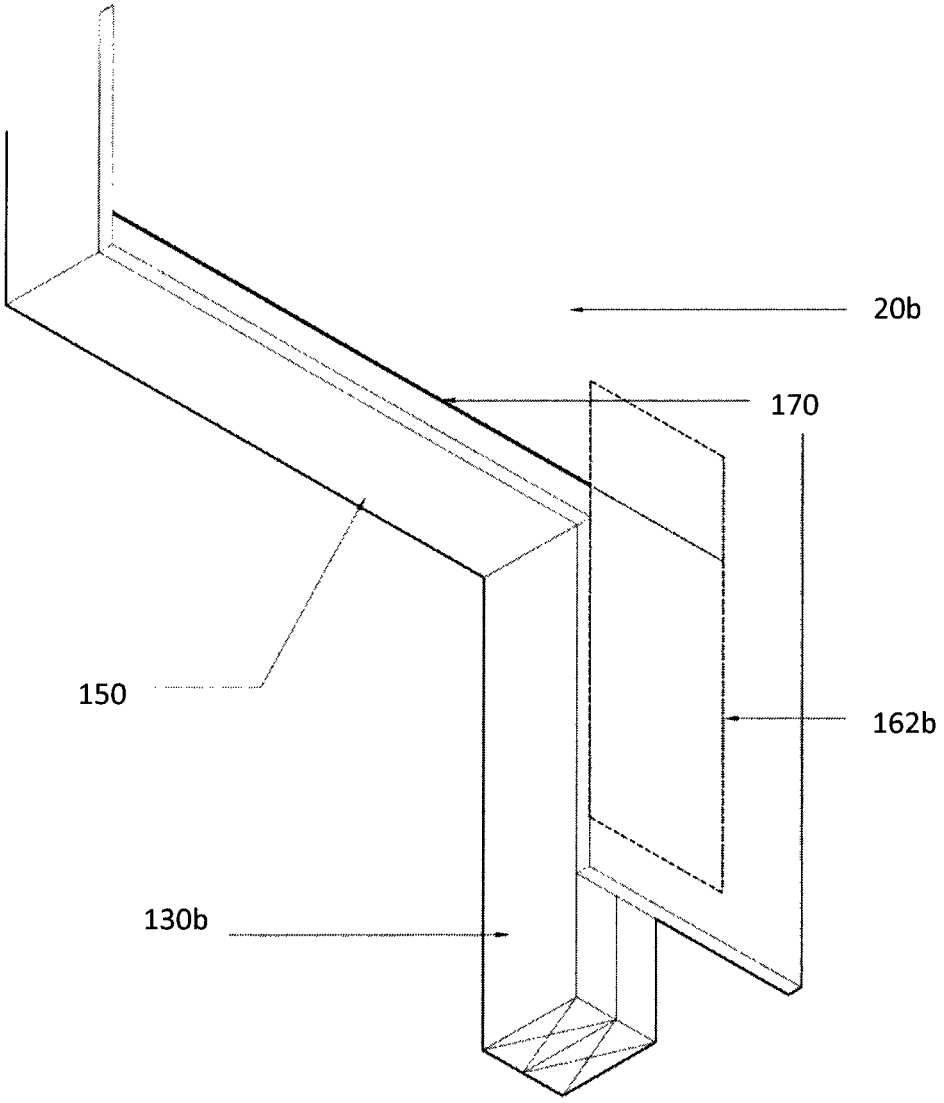
FIG. 4B is a partial perspective view illustrating the task of applying sealant along an upper edge of the door or window frame along a top header illustrated in FIG. 4A and according to the method for flashing an opening illustrated in FIG. 1.
Figure 4C:
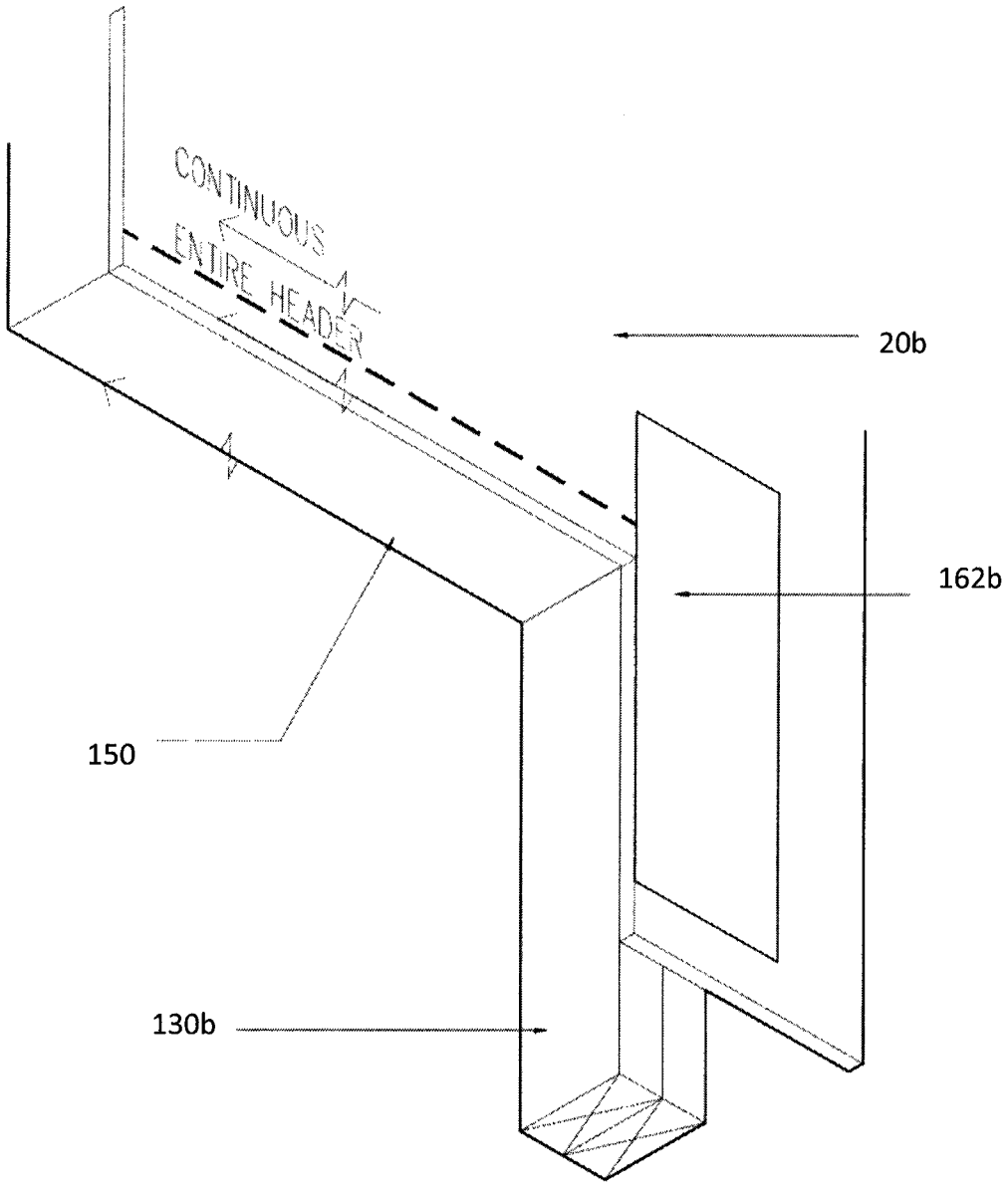
FIG. 4C is a partial perspective view illustrating the task of attaching a jamb diverter sheet to the wall adjacent the opening at each side jamb illustrated in FIG. 4A and according to the method for flashing an opening illustrated in FIG. 1.

With continued reference to the embodiments illustrated in FIGS. 1, 4A, 4B, and 4C, the method for flashing an opening 50 in a wall 20, 40 configured to receive a flat door or window frame 10 according to these embodiments further includes attaching a jamb diverter sheet 162*a* and 162*b* (as shown in FIG. 4A) to the wall 20 adjacent to the opening 50 at each side jamb 130*a* and 130*b* and extending at least a height of each side jamb 130*a* and 130*b* and partially over the sealant 172 applied along the upper edge of the door or window frame 50. The jamb diverter sheet 162*a* and 162*b*, according to an embodiment, may be a non-adhesive laminate for structural sealing, for example a 9 inch wide flexible sheet of FUTURE FLASH® self-sealing waterproof flashing membrane, as described above, and having a nominal thickness of 25 mils. In other embodiments, the jamb diverter sheet 162*a* and 162*b* may have a width less than or greater than nine inches (for example, 3, 6, 12, 18, or 36 inches), and may have a nominal thickness greater than 25 mils (for example, 35 mils or 40 mils). However, embodiments of the present invention are not limited to these embodiments.

With continued reference to the embodiments illustrated in FIGS. 1, 4A, 4B, and 4C, the method for flashing an opening 50 in a wall 20, 40 configured to receive a flat door or window frame 10 according to these embodiments further includes applying a continuous amount of sealant 172 along an inside flange of the door or window frame 10. The sealant 172, according to an embodiment, may be a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

With continued reference to the embodiments illustrated in FIGS. 1, 4A, 4B, and 4C, the method for flashing an opening 50 in a wall 20, 40 configured to receive a flat door or window frame 10 according to these embodiments further includes placing the door or window frame 10 in the opening 50, setting the door or window frame 10 in the opening 50, and leveling and fastening the door or window frame 10 in the opening 50, and applying sealant 172 along an outside flange of the door or window frame 10 and over an outside edge of the door or window frame 10 to extend to the wall 20 surrounding the opening 50. The sealant 172 applied to the outside flange, in an embodiment, maybe tooled over the outside edge of the door or window frame 10 to cover any voids between the window frame 10 and the flashing 112, 111, 162*a*, and/or 162*b*. The installation of the door or window frame 10 and the door or window it receives, according to these embodiments, can be performed according to manufacturer specifications. The sealant 172, according to an embodiment, includes applying a continuous bead of sealant 172, for example, a one-half inch bead of sealant 172 along the inside flange and the outside flange of the door or window frame 10. The sealant 172, according to an embodiment, may be a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

Figure 4D:
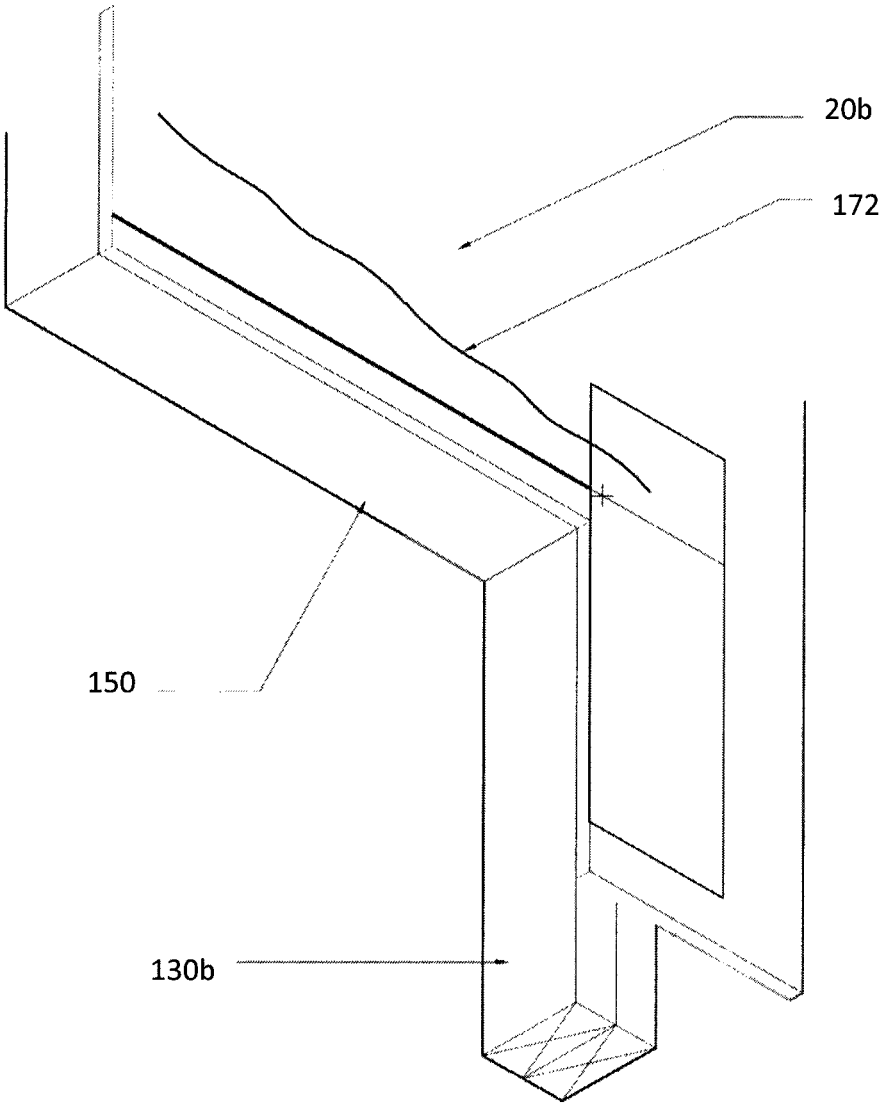
FIG. 4D is a partial perspective view illustrating the task of applying sealant along the top header illustrated in FIG. 4A and according to the method for flashing an opening illustrated in FIG. 1.

After the door or window frame 10 has been installed within the opening 50, sealant 172 may be placed along an upper edge of the door or window frame 10 at the top header 150, according to an embodiment, as shown in FIGS. 4A and 4D. According to an embodiment, sealant 172 may be applied along the entire length of the opening 50 at the upper edge of the door or window frame 10 along the top header 150 in an upside-down V-shape applied starting at a center of the opening 50 and running down to each opening corner. The sealant 172, according to an embodiment, includes applying a continuous bead of sealant 172, for example, a one-half inch bead of sealant 172 in an upside-down V-shaped or pyramid shape. The sealant 172, according to an embodiment, may be a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

Figure 4E:
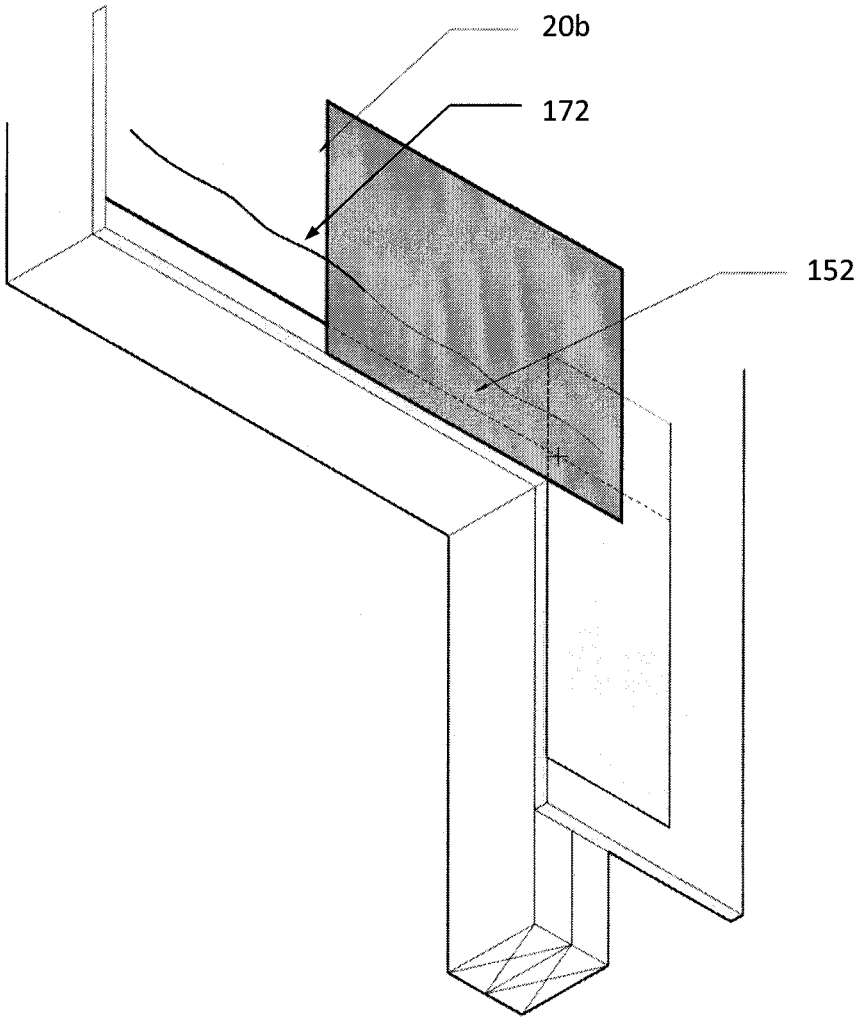
FIG. 4E is a partial perspective view illustrating the task of attaching a header diverter sheet at the top header illustrated in FIG. 4A and according to the method for flashing an opening illustrated in FIG. 1.

With continued reference to the embodiments illustrated in FIGS. 1, 4A, and 4E, the method for flashing an opening 50 in a wall 20, 40 configured to receive a flat door or window frame 10 according to these embodiments further includes attaching a header diverter sheet 152 to the wall 20 and over the sealant 172 in the upside-down V-shape along the upper edge of the door or window frame 10 at the top header 150 and over the door or window frame 10. The header diverter sheet 152 according to an embodiment may be a non-adhesive laminate for structural sealing, for example a 9 inch wide flexible sheet of FUTURE FLASH® self-sealing waterproof flashing membrane, as described above, and having a nominal thickness of 25 mils. In other embodiments, the header diverter sheet 152 may have a width less than or greater than nine inches (for example, 3, 6, 12, 18, or 36 inches), and may have a nominal thickness greater than 25 mils (for example, 35 mils or 40 mils). However, embodiments of the present invention are not limited to these embodiments.

Figure 4F:
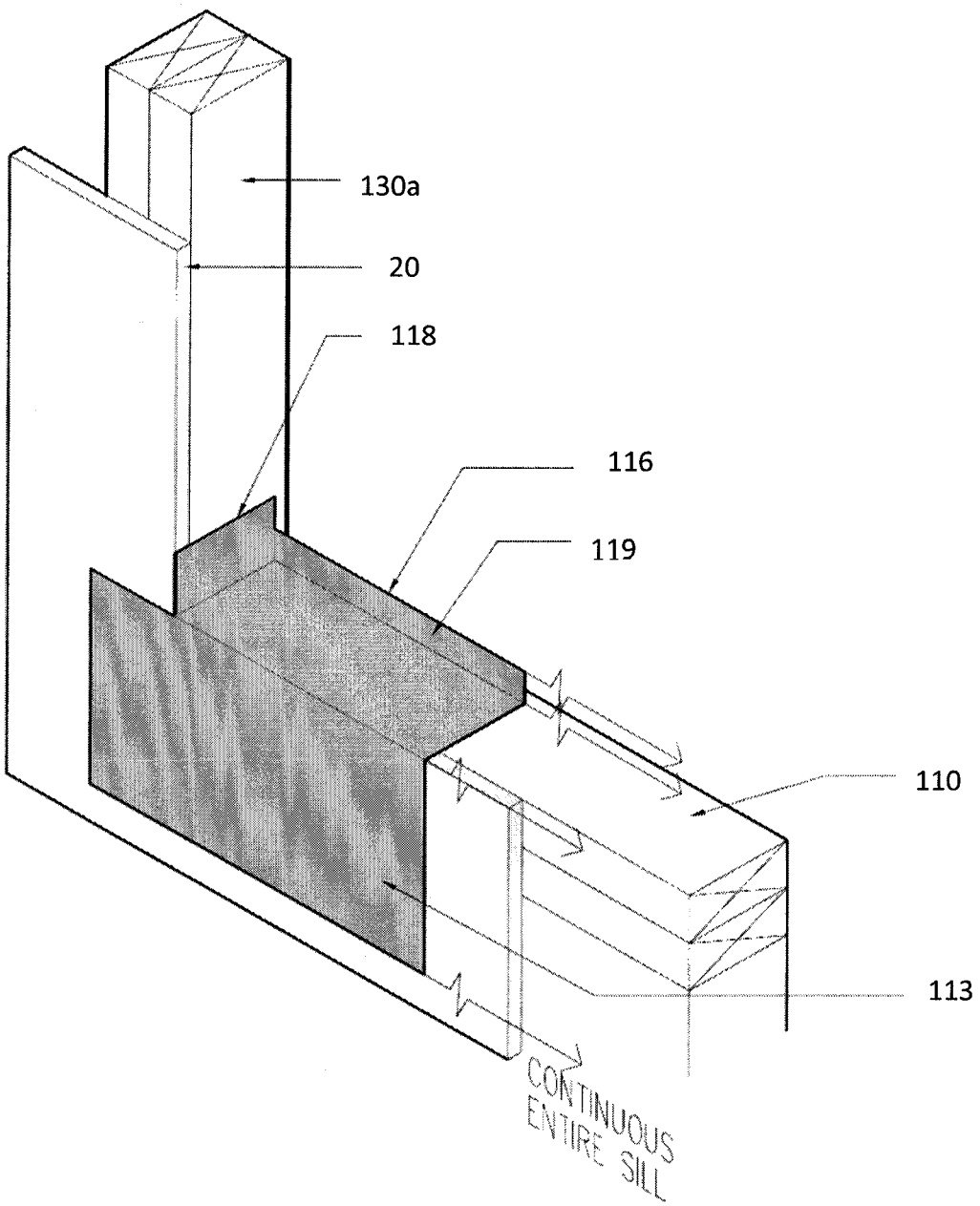
FIG. 4F is a partial perspective view illustrating the task of placing an adhesive strip along the diverter flap and attaching the door or window frame to the sill diverter dam illustrated in FIG. 4A and according to the method for flashing an opening illustrated in FIG. 1.

With continued reference to the embodiments illustrated in FIGS. 1, 4A, and 4F, the method for flashing an opening 50 in a wall 20, 40 configured to receive a flat door or window frame 10 according to these embodiments further includes placing an adhesive strip 170 along the diverter flap 119, the adhesive strip 170 being configured to attach the diverter flap 119 to a backside of the door or window frame 10. The method may further include attaching a lower edge of the door or window frame 10 to the sill diverter dam 112 with the adhesive strip 170. The adhesive strip 170, according to an embodiment, may be double-sided tape. For example, in an embodiment, the adhesive strip 170 may be double-sided tape having a thickness of ⅜ inch, for example double-sided tape manufactured by TREMCO. In another embodiment, the adhesive strip 170 may be double-sided tape having a thickness of 3/16 inch.

In the embodiments described above with references to FIGS. 1, 2, 3A-3C, and 4A-4F, for example, attaching the sill diverter sheet 113 along the entire length of the bottom sill 110, attaching the lower strip of weep flashing 111 to the wall 20, attaching the jamb diverter sheets 162*a* and 162*b* to the wall 20, and attaching the header diverter sheet 152 to the wall 20, can be performed by using sealant, staples, nails, screws, tacks, or any other suitable fasteners or fastening material directly penetrating through the flashing material 113, 111, 162*a*, 162*b*, and/or 152. In embodiments where the flashing material 113, 111, 162*a*, 162*b*, and/or 152 is the flexible sheet of sandwich-type flashing, for example, FUTURE FLASH® self-sealing waterproof flashing membrane, as described above, the inner core of rubberized asphalt may be configured to self-seal any holes created by attaching these flashing materials 113, 111, 162*a*, 162*b*, and/or 152 using conventional fasteners, without the need to apply further sealants.

According to other aspects of the present invention, according to the embodiments illustrated in FIGS. 5A, 5B, 6, 7A-7D, and 8A-8D, a method for flashing an opening 52 in a wall 20, 40 configured to receive a recessed door or window frame 12 having a production recess is shown. The production recess at the recessed door or window frame 12, according to an embodiment, has a depth that is less than 4 inches. In another embodiment, the production recesses at the recessed door or window frame 12 may be greater than 4 inches, and in an embodiment, the depth may range from between 4 inches to 8 inches. Repeated descriptions of elements in the embodiments shown in FIGS. 5A, 5B, 6, 7A-7D, and 8A-8D that are similar or identical to elements already shown and/or described with regards to the embodiments illustrated in FIGS. 1, 2, 3A-3C, and 4A-4F, and having the same or similar reference numerals, are omitted below. Like reference numerals denote like elements throughout the specification.

Figure 5A:
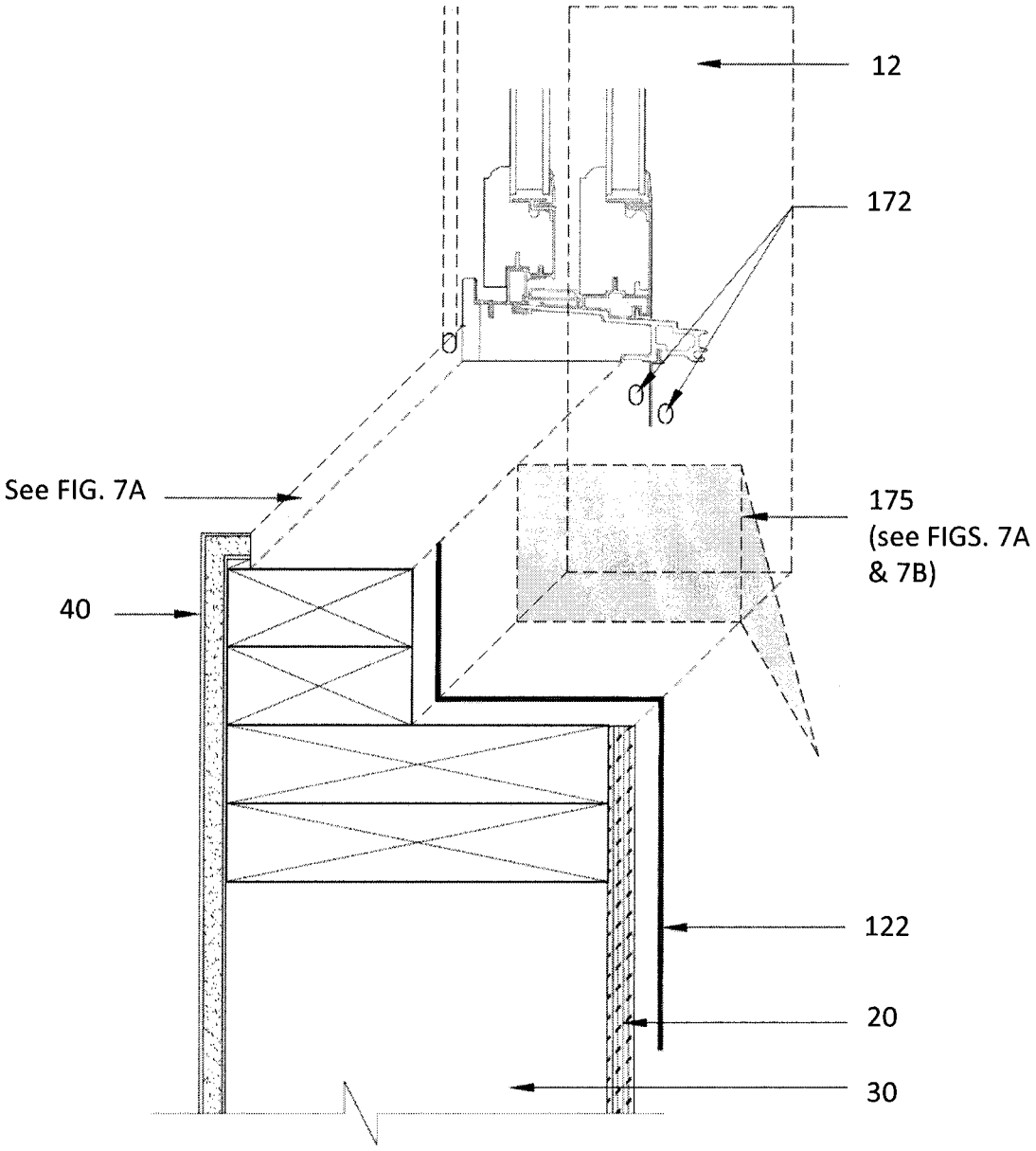
FIG. 5A is an exploded perspective view illustrating a method for flashing an opening in a wall configured to receive a recessed door or window frame according to another embodiment of the present invention.
Figure 6:
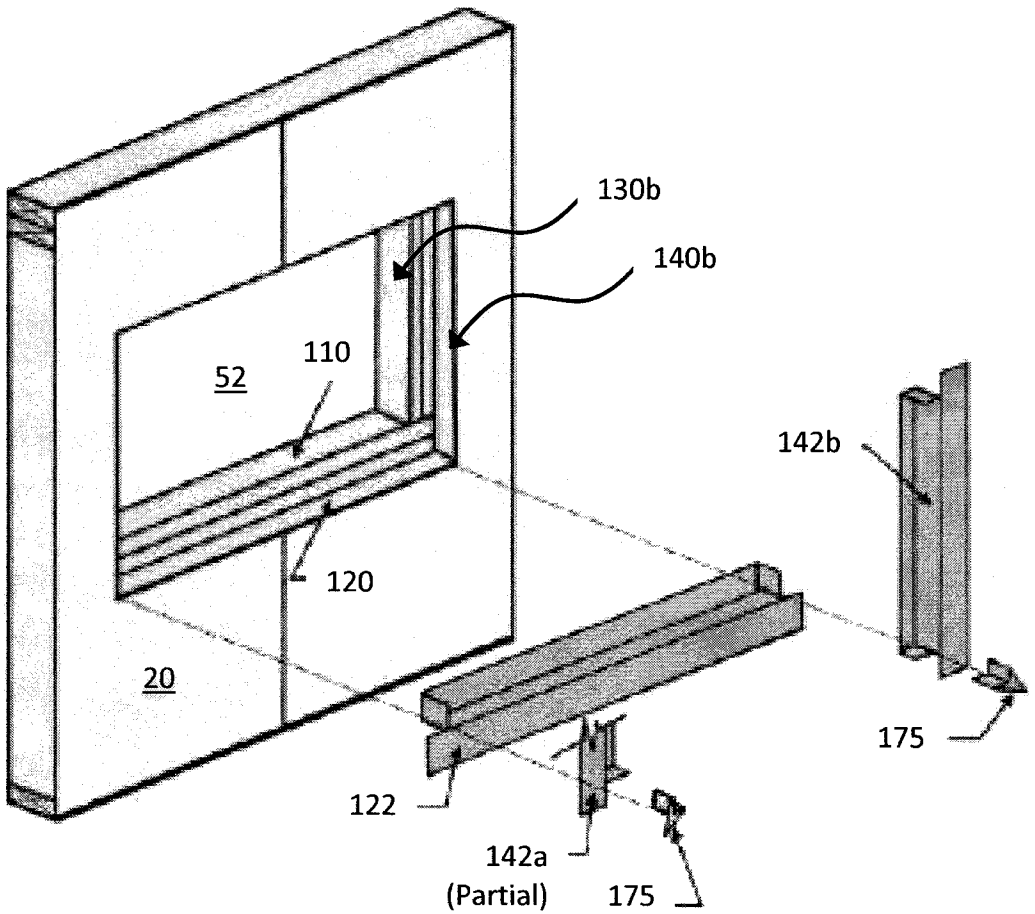
FIG. 6 is an exploded perspective view illustrating tasks of forming a recessed sill diverter dam, applying a sheet of flexible membrane, and forming a recessed jamb diverter strip according to the method for flashing an opening illustrated in FIG. 5A.
Figure 7A:
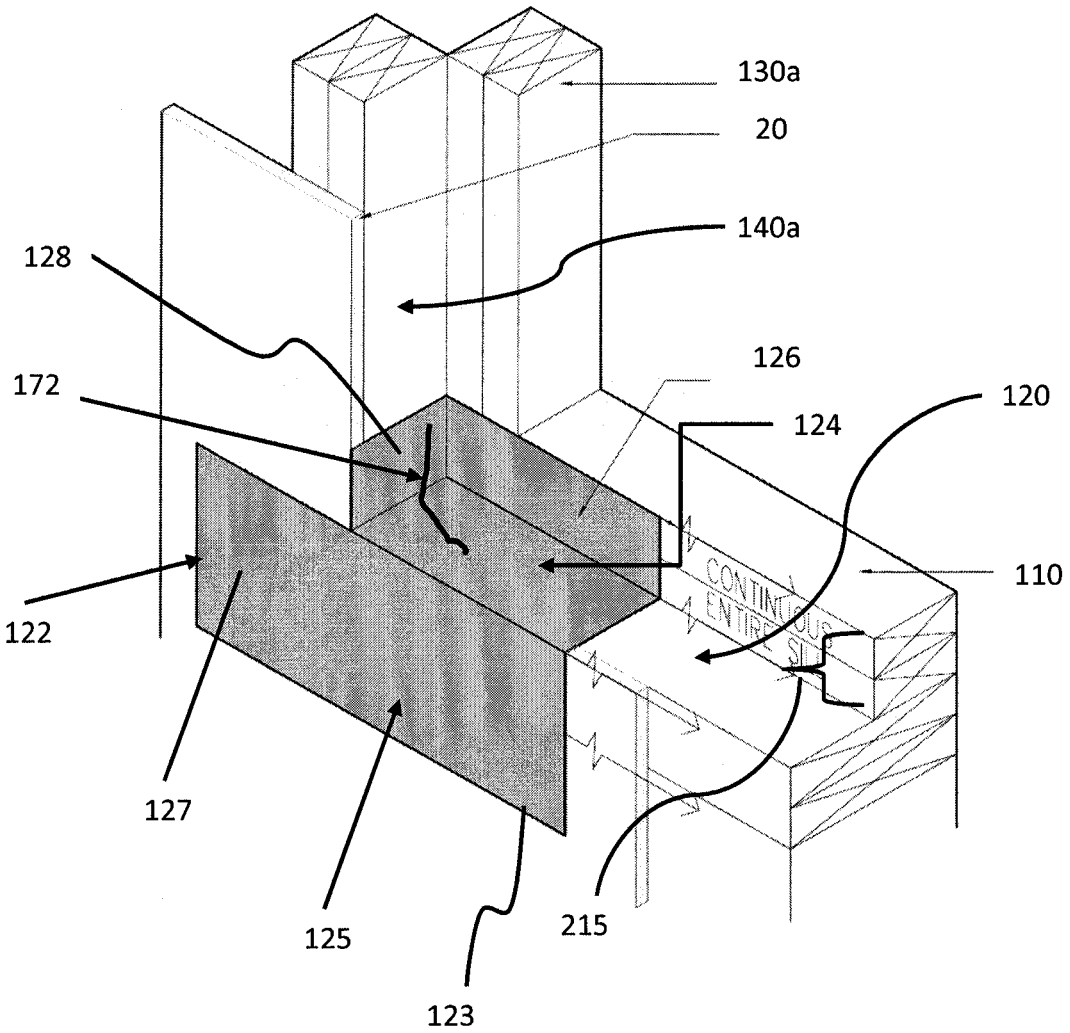
FIG. 7A is a partial perspective view illustrating the task of forming the recessed sill diverter dam illustrated in FIG. 6 and according to the method for flashing an opening illustrated in FIGS. 5A and 9.
Figure 7B:
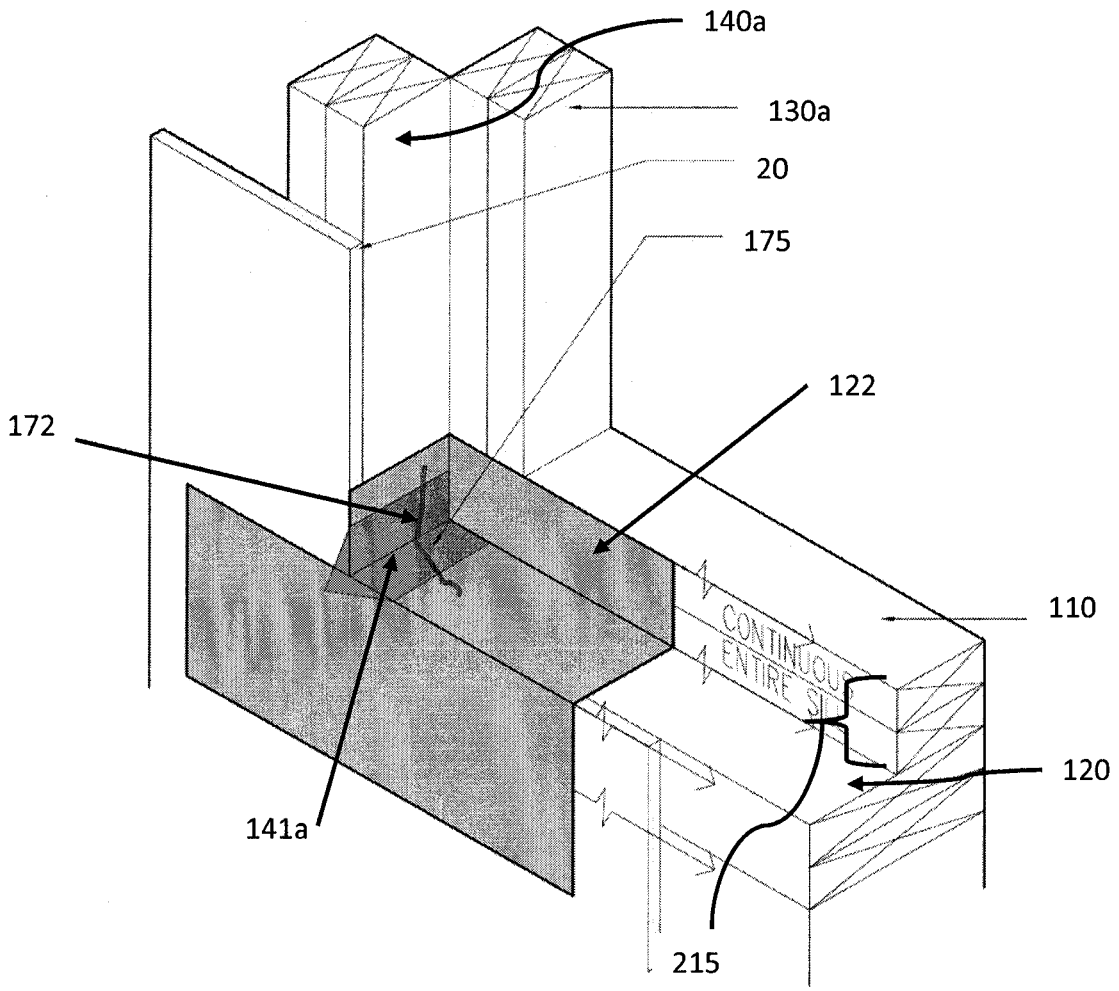
FIG. 7B is a partial perspective view illustrating the task of applying the sheet of flexible membrane illustrated in FIG. 6 and according to the method for flashing an opening illustrated in FIGS. 5B and 9.
Figure 7C:
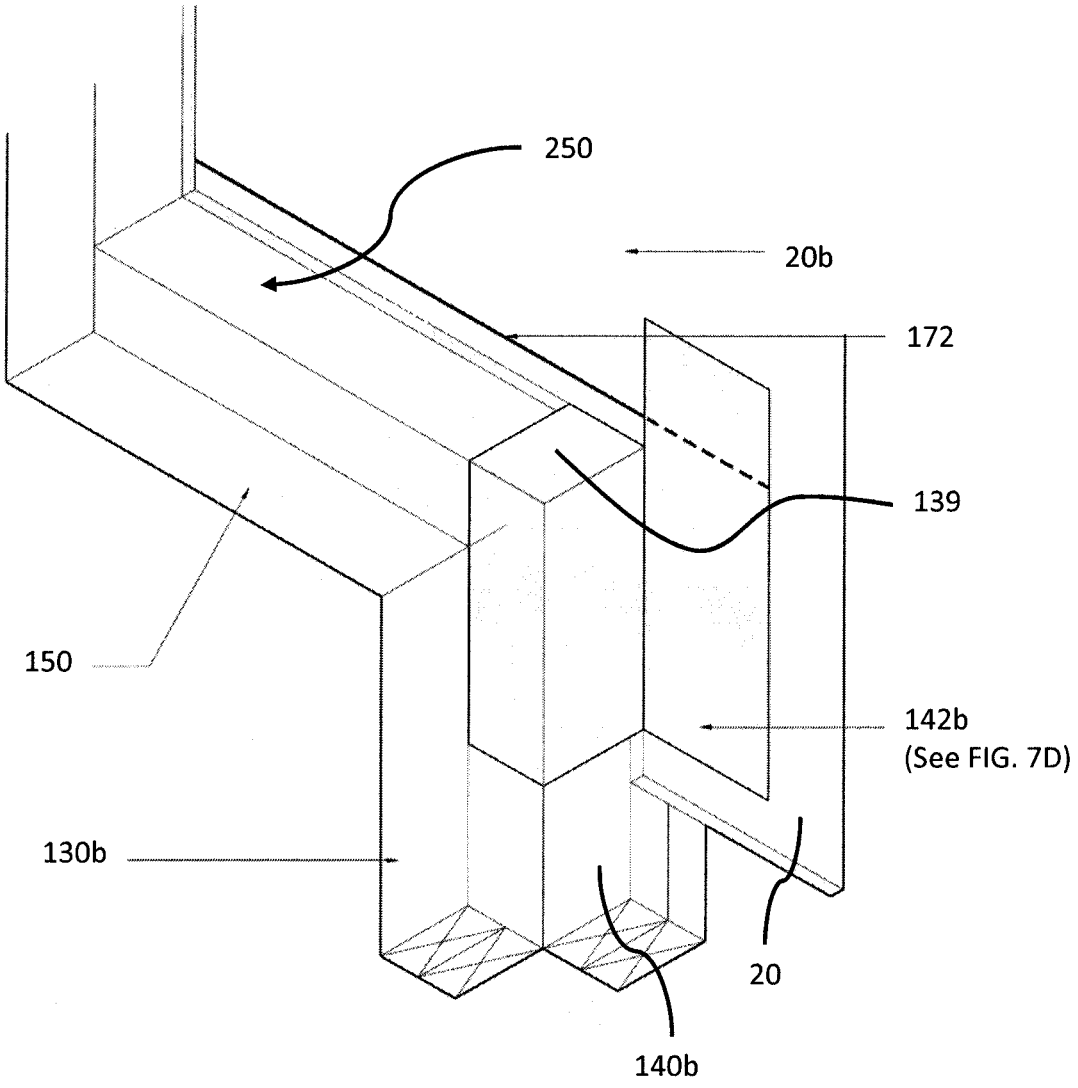
FIG. 7C is a partial perspective view illustrating the task of applying an adhesive to a top surface of the wall illustrated in FIG. 6 and according to the method for flashing an opening illustrated in FIGS. 5B and 9.

As shown in FIGS. 5A, 6, and 7C the opening 52, according to these embodiments, is defined by a bottom sill 110, a recessed sill 120 stepped externally down and out from the bottom sill 110, a pair of side jambs 130*a* and 130*b* (see FIGS. 6 and 7C) in line with the bottom sill 110, a pair of recessed jambs 140*a* and 140*b* (see FIGS. 6 and 7C) in line with the recessed sill 120, a top header 150 (see FIG. 7C) in line with the bottom sill 110, and a recessed top header 250 (see FIG. 7C) stepped externally up and out from the top header 150. In these embodiments, the framing 30 at the opening 52 may form part of the bottom sill 110, the recessed sill 120, the pair of side jambs 130*a* and 130*b*, the pair of recessed jambs 140*a* and 140*b*, the top header 150, and/or the recessed top header 250.

With continued reference to the embodiments illustrated in FIGS. 5A, 6, and 7A, the method for flashing an opening 52 in a wall 20, 40 configured to receive a recessed door or window frame 12 having a production recess includes forming a recessed sill diverter dam 122 at the recessed sill 120. Forming the recessed sill diverter dam 122 according to this embodiment includes attaching a sill diverter sheet 123 having a center strip 124, an outer edge 125, and an inner edge 126 along an entire length of the recessed sill 120 with the center strip 124 forming a shelf along the recessed sill 120 with the inner edge 126 extending up a height to the bottom sill 110. In this embodiment, the outermost ends of the outer edge 125 and the inner edge 126 may be cut to form a wall flap 127 and a jamb flap 128 at each respective recessed jamb 140*a* and 140*b* where the center strip 124 extends past the recessed sill 120, and the outer edge 125 of the diverter sheet 123 may be folded down such that the outer edge 125 and each wall flap 127 are flush against the wall 20. In this embodiment, each jamb flap 128 may also be folded up flush with its respective recessed jamb 140*a* and 140*b* with the inner edge 126 flush against a step 215 between the recessed sill 120 and the bottom sill 110.

The sill diverter sheet 123, according to an embodiment, may be a non-adhesive laminate for structural sealing, as described above, for example a 12 inch wide flexible sheet of FUTURE FLASH® self-sealing waterproof flashing membrane, and having a nominal thickness of 40 mils. In other embodiments, the sill diverter sheet 123 may have a width less than or greater than 12 inches (for example, 3, 6, 9, 18, or 36 inches), and may have a nominal thickness less than 40 mils (for example, 25 mils or 35 mils). However, embodiments of the present invention are not limited to these embodiments. In an embodiment where the production recess has a depth greater than 4 inches but less than 8 inches, the sill diverter sheet 123 may be an 18 inch wide FUTURE FLASH® self-sealing waterproof flashing membrane having a nominal thickness of 40 mils. In other embodiments where the production recess has a depth greater than 8 inches, the sill diverter sheet 123 may be a 36 inch wide FUTURE FLASH® self-sealing waterproof flashing membrane having a nominal thickness of 40 mils.

Figure 12A:
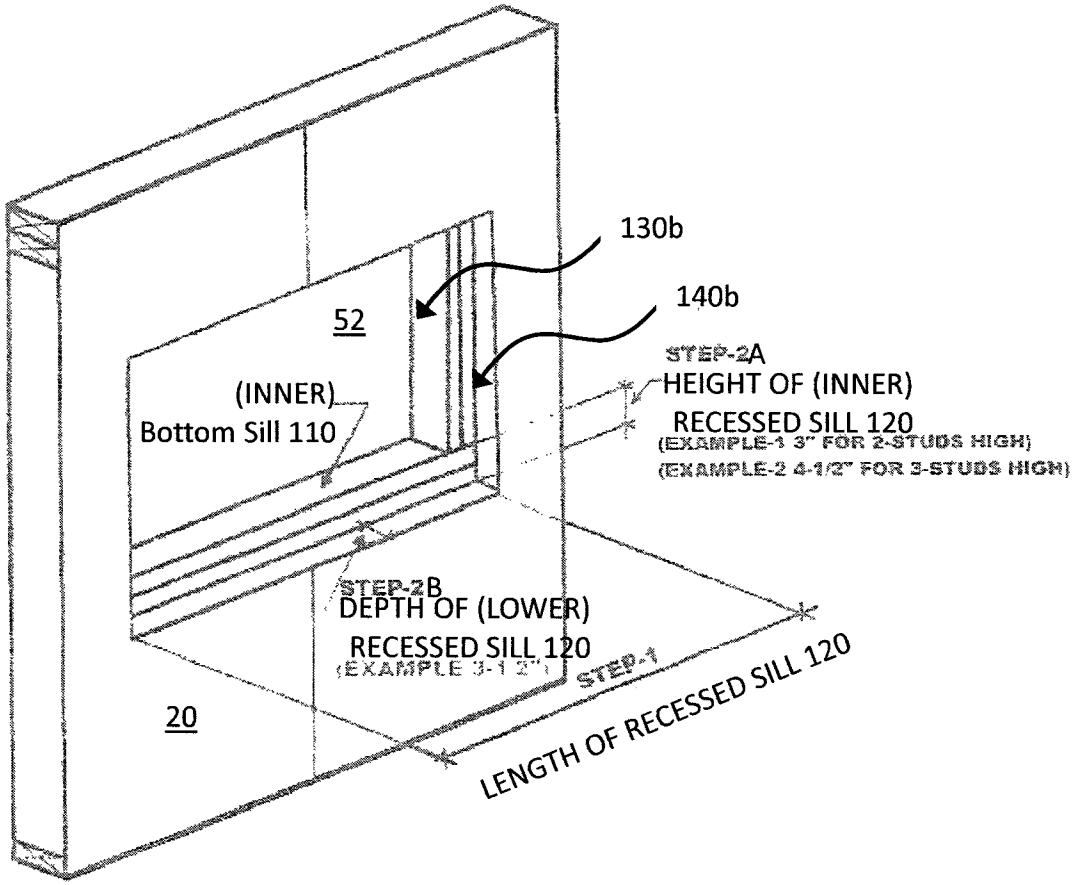
FIGS. 12A-12I are partial perspective views illustrating the task of applying the recessed sill diverter dam as illustrated in FIGS. 5A, 6, 7A-7D, and 9, according to an embodiment.
Figure 12B:
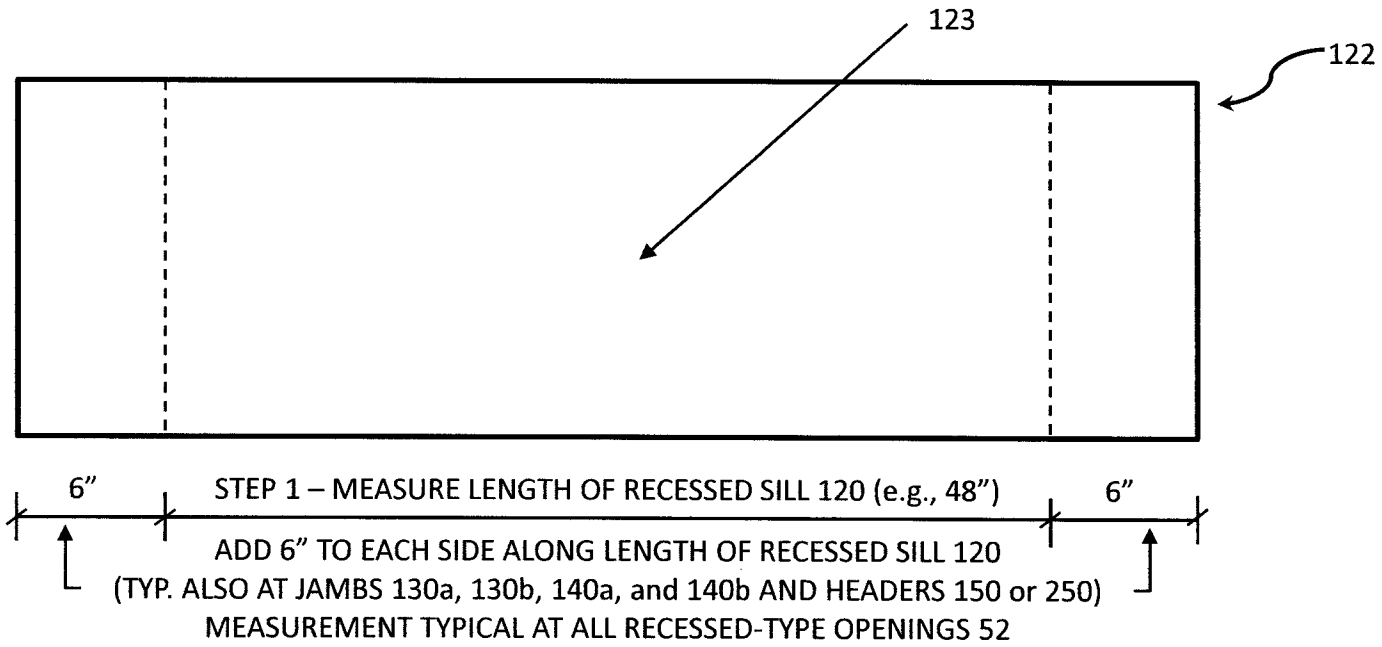
Figure 12C:
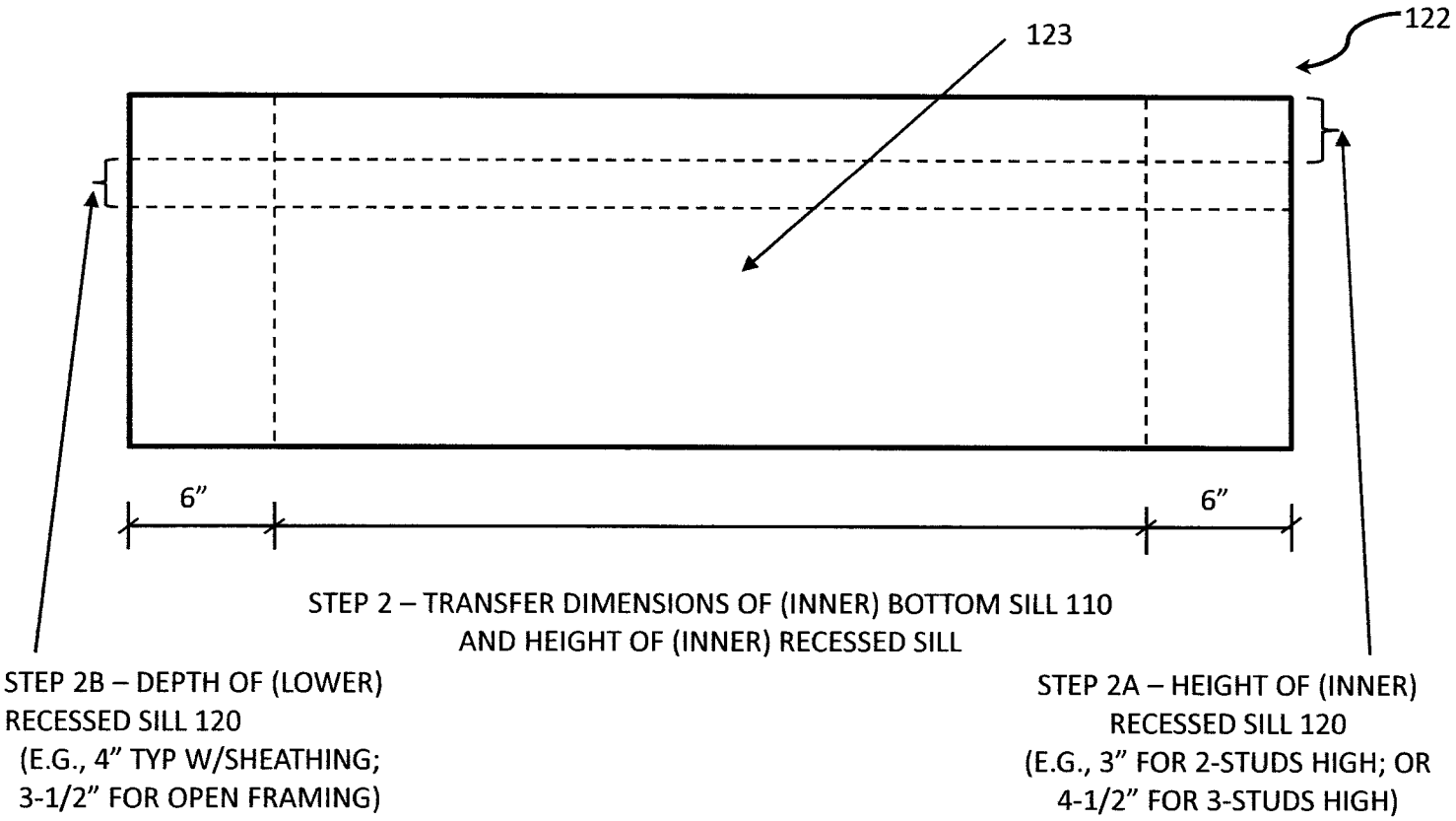
Figure 12D:
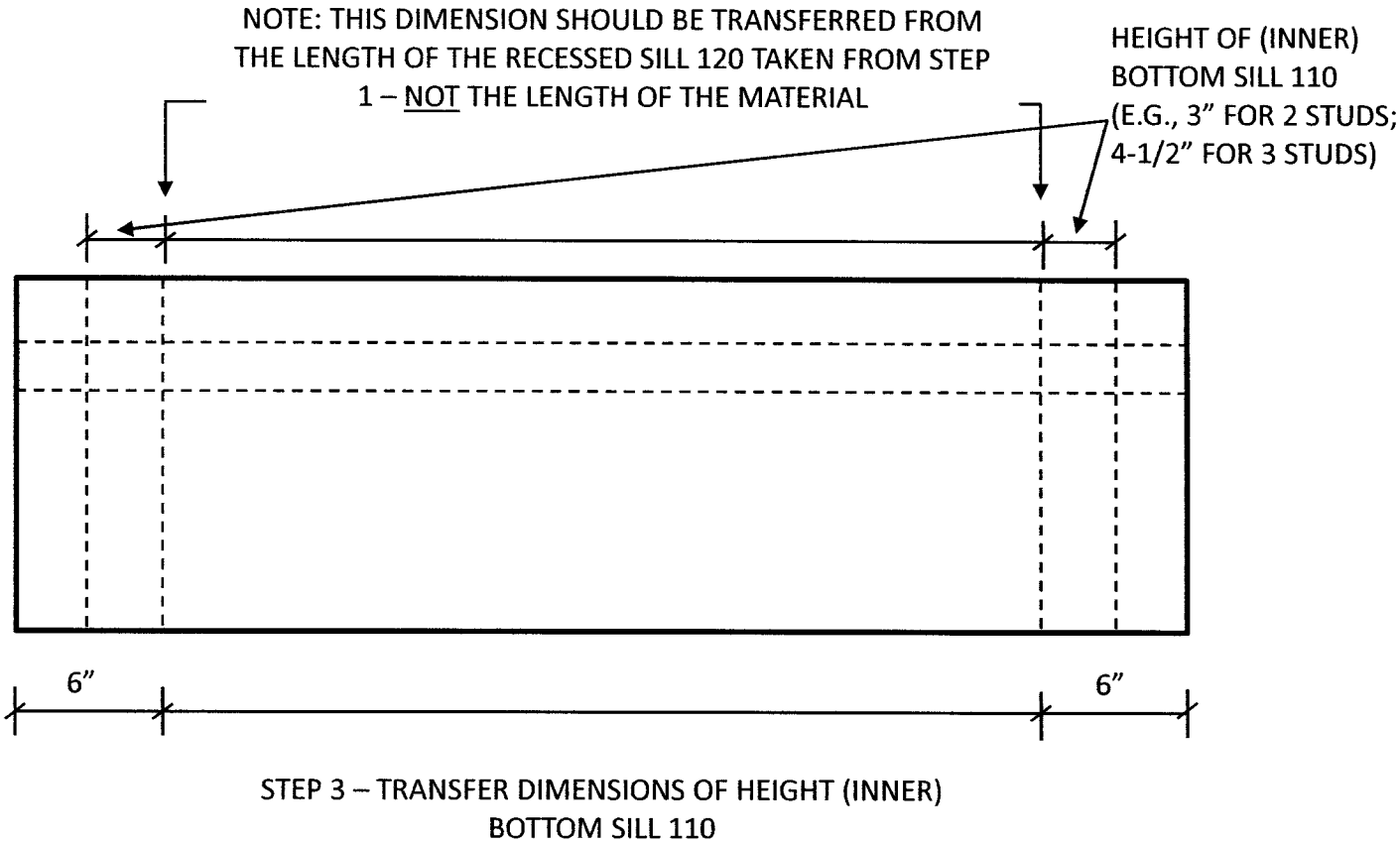
Figure 12E:
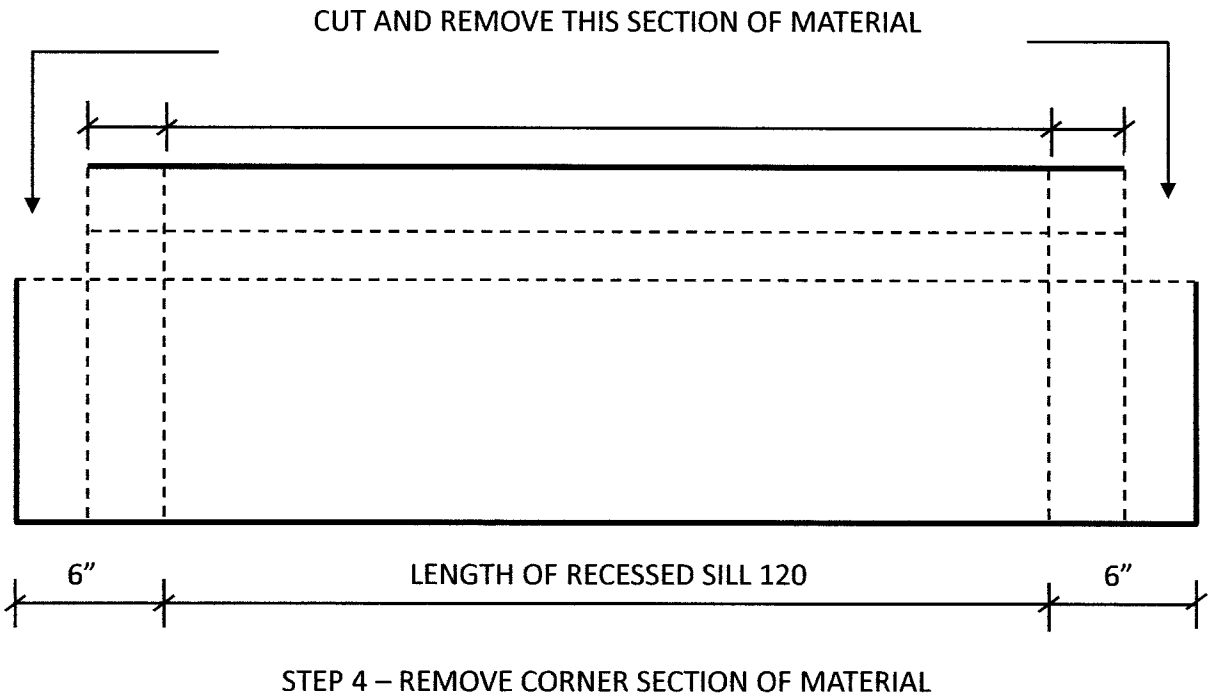
Figure 12F:
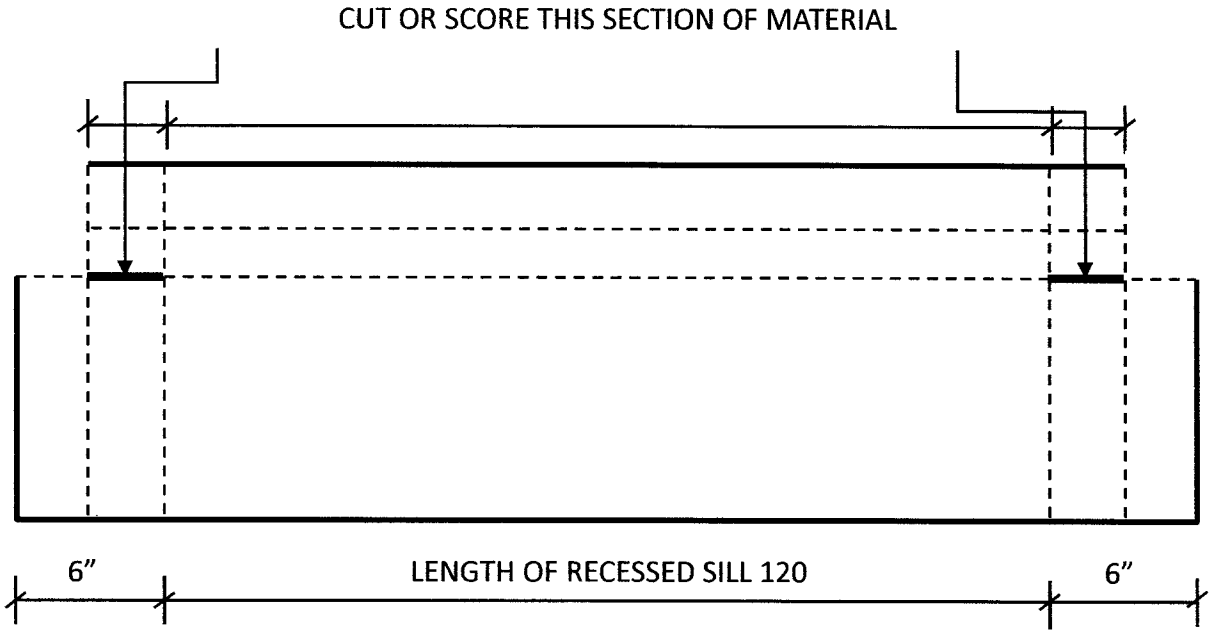
Figure 12G:
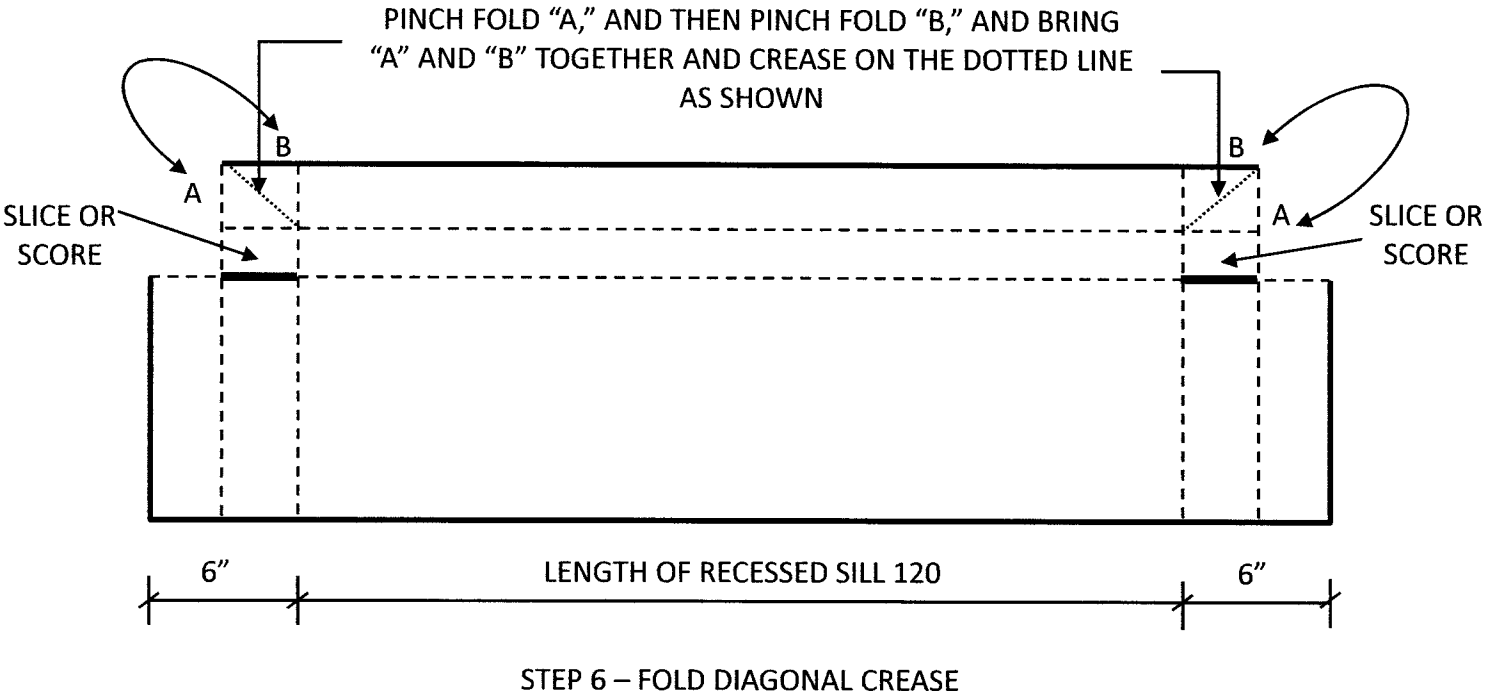
Figure 12H:
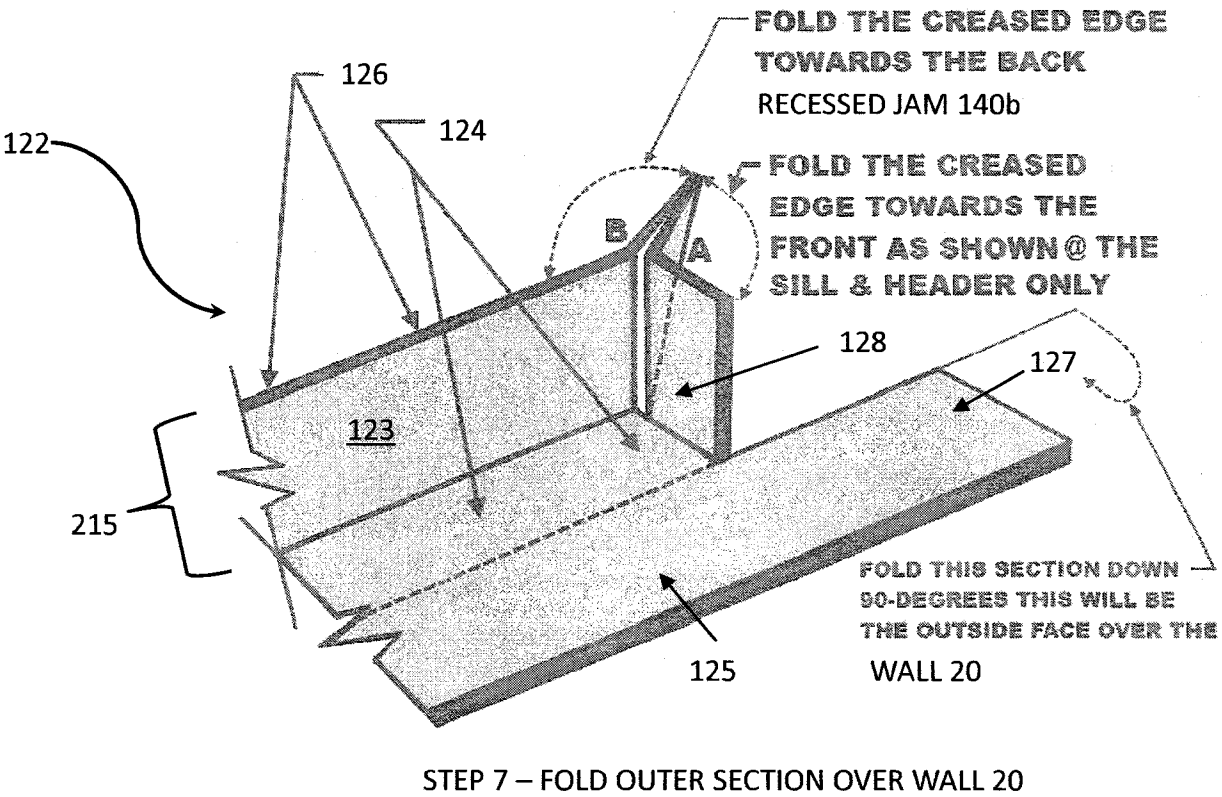
Figure 12I:
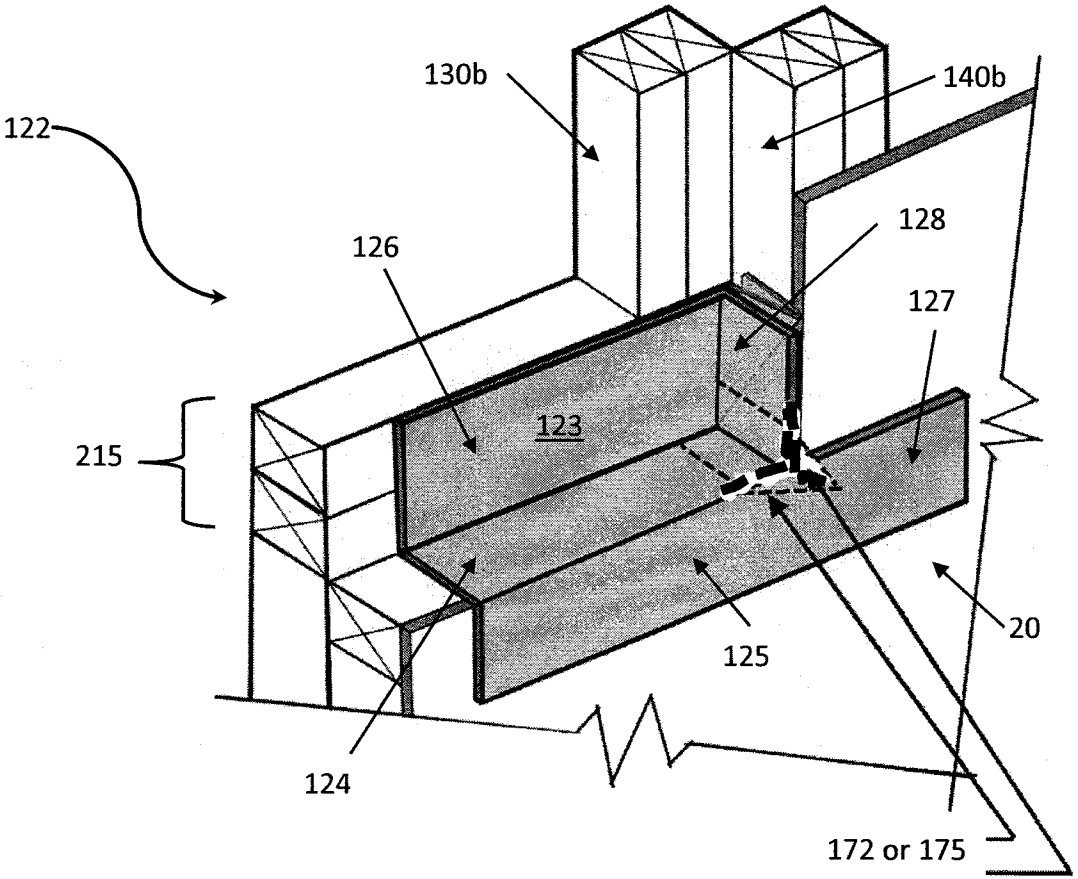

In an embodiment, for example, as shown in FIGS. 12A-12I, forming the recessed sill diverter dam 122 includes measuring a length of the recessed sill 120, for example, 48 inches, and cutting a sheet of the sill diverter sheet 123 to include 6 inches of extra length at each side, such that for a 48 long wide recessed sill 120, the sill diverter sheet 123 would be cut to 60 inches in length (as shown in FIGS. 12A and 12B). The method further includes scoring, folding, or demarcating the boundaries at the 6 inch mark at either end of the sill diverter sheet 123 to indicate where the extra 6 inches of the sill diverter sheet 123 extend from the measured length of the recessed sill 120. Forming the recessed sill diverter dam 122 further includes measuring a height of the (inner) recessed sill 120, where, for example, in an opening 52 formed using two studs, the height of the recessed sill 120 would be 3 inches, and in an opening 52 formed using three studs, the height of the recessed sill 120 would be 4.5 inches (as shown in FIG. 12C). The sill diverter sheet 123 may then be scored, folded, or demarcated along its length measuring down the height of the recessed sill 120, and this process may be repeated measuring down from the score, fold, or demarcation line a distance equal to a depth of the (lower) recessed sill 120, for example, 3.5 inches for the two-stud high recessed sill 120 or 4 inches for the two-stud high recessed sill 120 including sheathing; or 5.5 inches for the three-stud high recessed sill 120 (open framing), or 6 inches including sheathing. The method further includes measuring out from the score, fold, or demarcation lines indicating the extra 6 inches of sill diverter sheet 123 along the length of the sill diverter sheet 123 a measurement equal to the height of the recessed sill 120 (for example, 3 inches for the 2-stud high recessed sill 120 or 4.5 inches for the three-stud high recessed sill 120) and scoring, folding, or demarcating lines indicating a portion of the sill diverter sheet 123 to be cut (as shown in FIG. 12D). Forming the recessed sill diverter dam 122 includes cutting and removing a portion of the sill diverter sheet 123 starting at the ends of the sheet a width equal to the height of the recessed sill 120 from each side and a length equal to the depth of the recessed sill 120 plus the height of the recessed sill 120, as shown in FIG. 12E. For example, in the 2-stud high recessed sill 120, the area of the sill diverter sheet 123 to be removed has a width equal to 6 inches minus the 3 inch height of the recessed sill 120 or 3 inches, and a length equal to the 3 inch height of the recessed sill 120 plus the 3.5 inch depth of the recessed sill 120 or 6.5 inches. For example, in the 3-stud high recessed sill 120, the area of the sill diverter sheet 123 to be removed has a width equal to 6 inches minus the 4.5 inch height of the recessed sill 120 or 1.5 inches, and a length equal to the 4.5 inch height of the recessed sill 120 plus the 5.5 inch depth of the recessed sill 120 or 10 inches. Forming the recessed sill diverter dam 122 further includes cutting, slicing, or scoring along the cut sections along the length of the sill diverter sheet 123 up to the 6-inch demarcation lines (as shown in FIG. 12F) and then pinching and folding the sliced or scored sections together to form a crease forming a shelf and an extra triangular flap (as shown in FIGS. 12G and 12H). This flap can then be folded toward the shelf to be flush, as shown in FIGS. 12H and 12I.

With continued reference to the embodiments illustrated in FIGS. 5A, 6, 7A, 7B, and 12I, the method for flashing an opening 52 in a wall 20, 40 configured to receive a recessed door or window frame 12 having a production recess further includes applying an adhesive 170 or 172 at each intersection 141*a* (see FIG. 7D) of the recessed sill 120 and each recessed jamb 140*a* and 140*b* over the recessed sill diverter dam 122. The adhesive 170 or 172 according to this embodiment may be adhesive strips 170 or sealant 172. In an embodiment where the adhesive is sealant 172, the sealant 172 may be of a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO. In another embodiment, the adhesive may be an adhesive strip 170, and according to an embodiment, may be double-sided tape having a thickness of ⅜ inch, for example double-sided tape manufactured by TREMCO. In another embodiment, the adhesive strip 170 may be double-sided tape having a thickness of 3/16 inch.

With continued reference to the embodiments illustrated in FIGS. 5A, 6, 7B, and 12I, the method for flashing an opening 52 in a wall 20, 40 configured to receive a recessed door or window frame 12 having a production recess further includes applying a sheet of flexible membrane 175 at each intersection 141*a* (see FIG. 7D) of the recessed sill 120 and each recessed jamb 140*a* and 140*b* over the recessed sill diverter dam 122 and over the adhesive 170 or 172 at each intersection 141*a* (see FIG. 7D) of the recessed sill 120 and each recessed jamb 140*a* and 140*b* over the recessed sill diverter dam 122, and stretching each sheet of flexible membrane 175 over an outside edge of the respective intersection 141*a* (see FIG. 7D) and flush with the wall 20. The sheet of flexible membrane 175, according to this embodiment, may be a strip of stretchable film or tape, for example, having a hexagonal or pentagonal shape with a quasi-triangular portion stretched over the outside edge of the respective intersection 141*a* (see FIG. 7D) and trimmed flush with the step 215. In an embodiment, the sheet of flexible membrane 175 may be precut at its corners to streamline installation at the corners or to facilitate bending, stretching, or installation. In an embodiment, the sheet of flexible membrane 175 may be a 4 inch by 6 inch strip of stretchable self-adhering, pliable polymer surface membrane or tape having a pentagonal or hexagonal shape, for example, the Butterfly Tape™ described above, and having a nominal thickness of 35 mils. In another embodiment, the sheet of flexible membrane 175 may be a 6 inch by 6 inch strip of stretchable self-adhering, pliable polymer surface membrane or tape having a pentagonal or hexagonal shape, for example, the Butterfly Tape™ described above.

Figure 7D:
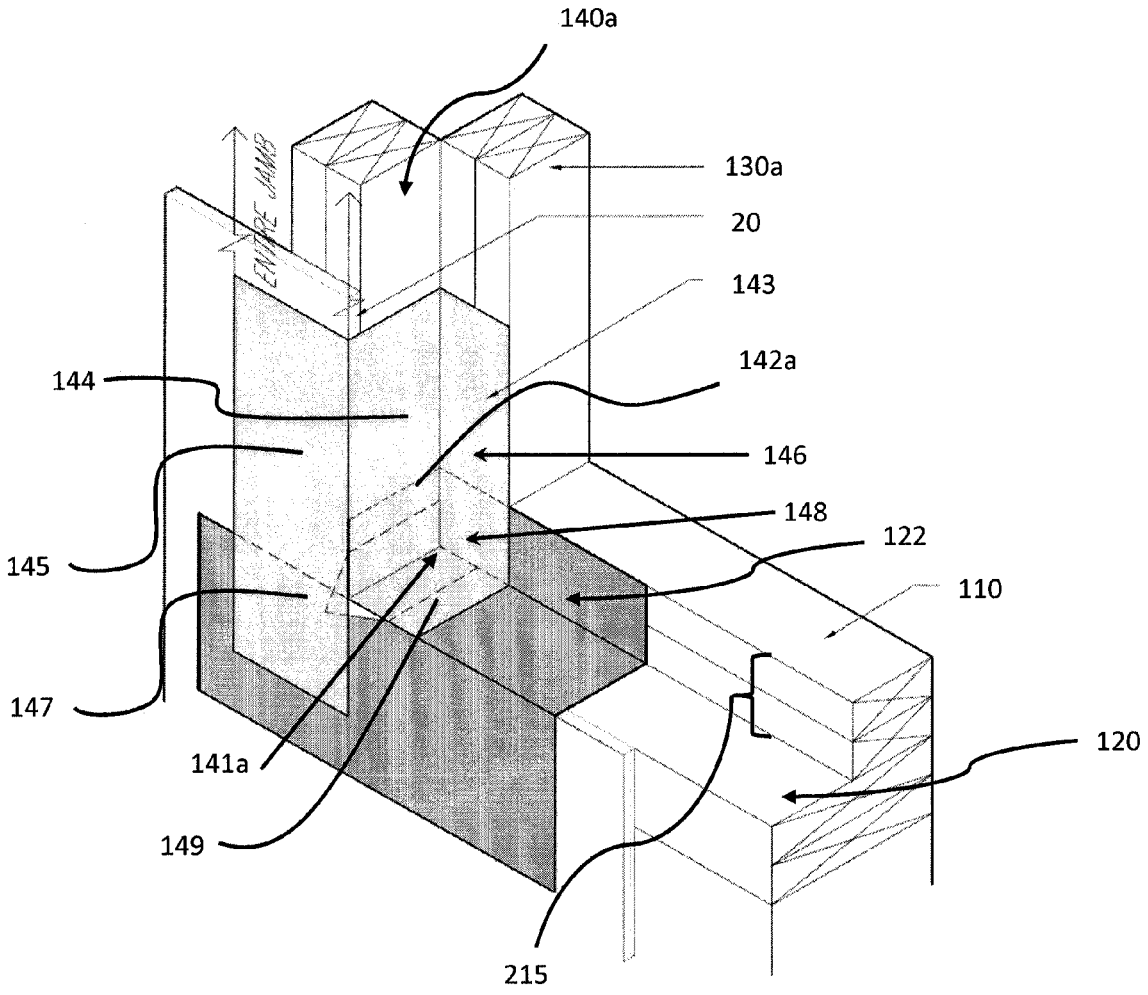
FIG. 7D is a partial perspective view illustrating the task of forming the recessed jamb diverter strip illustrated in FIG. 6 and according to the method for flashing an opening illustrated in FIGS. 5A, 5B, and 9.

With continued reference to the embodiments illustrated in FIGS. 5A, 5B, 6, and 7C, the method for flashing an opening 52 in a wall 20, 40 configured to receive a recessed door or window frame 12 further includes applying an adhesive 170 or 172 to a top surface 20*b* of the wall 20 along an upper edge of the opening 52 along the recessed top header 250, according to an embodiment. The adhesive, 170 or 172, according to an embodiment, may be a continuous bead of sealant 172. The sealant 172, according to this embodiment, may be the high quality polyurethane caulk configured to adhere to surfaces including wood, vinyl, and metal across a wide range of temperatures experienced in typical window and/or door frames exposed to various weather conditions, for example, the FUTURE FLASH® Sealant, described above. In this embodiment, the sealant 172 may be applied as an approximately ½ inch bead of sealant. In an embodiment, the sealant 172 may be applied along the entire length of the opening 52 at the recessed top header 250 in an upside-down V-shape or pyramid-shape applied starting at a center of the opening 52 and running down to each opening corner. In another embodiment, the sealant 172 may be applied along the entire length of the opening 52 at the recessed top header 250 in an approximately horizontal line from one corner to another of the opening 52. The adhesive, 170 or 172, according to another embodiment, may be an adhesive strip 170. The adhesive strip 170, according to an embodiment, may be double-sided tape. For example, in an embodiment, the adhesive strip 170 may be double-sided tape having a thickness of ⅜ inch, for example double-sided tape manufactured by TREMCO. In another embodiment, the adhesive strip 170 may be double-sided tape having a thickness of 3/16 inch. In an embodiment, the adhesive strip 170 may be applied along the entire length of the opening 52 at the recessed top header 250 in an upside-down V-shape or pyramid-shape applied starting at a center of the opening 52 and running down to each opening corner at the intersection 151*a* and 151*b* of the recessed top header 250 and each recessed jamb 140*a* and 140*b*. In another embodiment, the adhesive strip 170 may be applied along the entire length of the opening 52 at the recessed top header 250 in an approximately horizontal line from one corner to another of the opening 52. In another embodiment, the adhesive strip 170 may be applied along the entire length of the opening 52 at the recessed top header 250 in a continuous application starting at one of the intersections 151*a* (or similarly 151*b* for the opposite intersection as shown in FIG. 7D) of the recessed top header 250 and a respective recessed jamb 140*a* and 140*b* running continuously to the opposite corner at the other intersection 151*b* or 151*a* of the recessed top header 250 and the other recessed jamb 140*b* or 140*a*.

With continued reference to the embodiments illustrated in FIGS. 5A, 5B, 6, and 7D, the method for flashing an opening 52 in a wall 20, 40 configured to receive a recessed door or window frame 12 further includes forming a recessed jamb diverter strip 142*a* and 142*b* (see FIG. 7C) at each recessed jamb 120. Forming the recessed jamb diverter strip 142*a* and 142*b* according to this embodiment may include attaching a recessed jamb diverter sheet 143 to the wall 20 adjacent the opening 52 at each recessed jamb 140*a* and 140*b*. The recessed jamb diverter sheet 143, according to this embodiment, may have a center strip 144, an outer edge 145, and an inner edge 146 along an entire height of each recessed jamb 140*a* and 140*b*, with the center strip 144 forming a shelf along the height of each recessed jamb 140 and 140*b* and extending up at least to the recessed top header 250. In this embodiment, the outermost ends of the outer edge 145 and the inner edge 146 may be cut to form a wall flap 147, a sill flap 149, a header flap 139 (see FIG. 7C), and a jamb flap 148 at each respective recessed jamb 140*a* and 140*b*, where the center strip 144 extends along the entire height of the respective recessed jamb 140*a* and 140*b*. In this embodiment, the outer edge 145 of the recessed jamb diverter sheet 143 may be folded including the wall flap 147 around the respective recessed jamb 140*a* and 140*b* to be flush against the wall 20 adjacent the opening 52 along at least the height of each recessed jamb 140*a* and 140*b*. The wall flap 147, according to an embodiment, may extend up at least past the recessed top header 250 at the top surface 20*b* of the wall 20 and down past the recessed sill 120. Each jamb flap 148, according to an embodiment, may be folded around the respective recessed jamb 140*a* and 140*b* to be flush with the respective side jamb 130*a* and 130*b* at the opening 52 and extending along an entire height of the side jamb 130*a* and 130*b*. The sill flap 149, according to an embodiment, may be folded down onto the recessed sill 120 and flush with an inner edge at the intersection 141*a* between the recessed sill 120 and the respective recessed jamb 140*a* and 140*b*. The header flap 139, in this embodiment, may be folded up onto the recessed top header 250 from each recessed jamb 140*a* and 140*b* flush with an intersection 151*a* and 151*b* of the recessed top header 250 and each recessed jamb 140*a* and 140*b* and flush with the wall 20.

The recessed jamb diverter sheet 143, according to an embodiment, may be a non-adhesive laminate for structural sealing, as described above, for example a 12 inch wide flexible sheet of FUTURE FLASH® self-sealing waterproof flashing membrane, and having a nominal thickness of 25 mils. In other embodiments, the jamb diverter sheet 143 may have a width less than or greater than 12 inches (for example, 3, 6, 9, 18, or 36 inches), and may have a nominal thickness greater than 25 mils (for example, 35 mils or 40 mils). However, embodiments of the present invention are not limited to these embodiments.

Figure 5B:
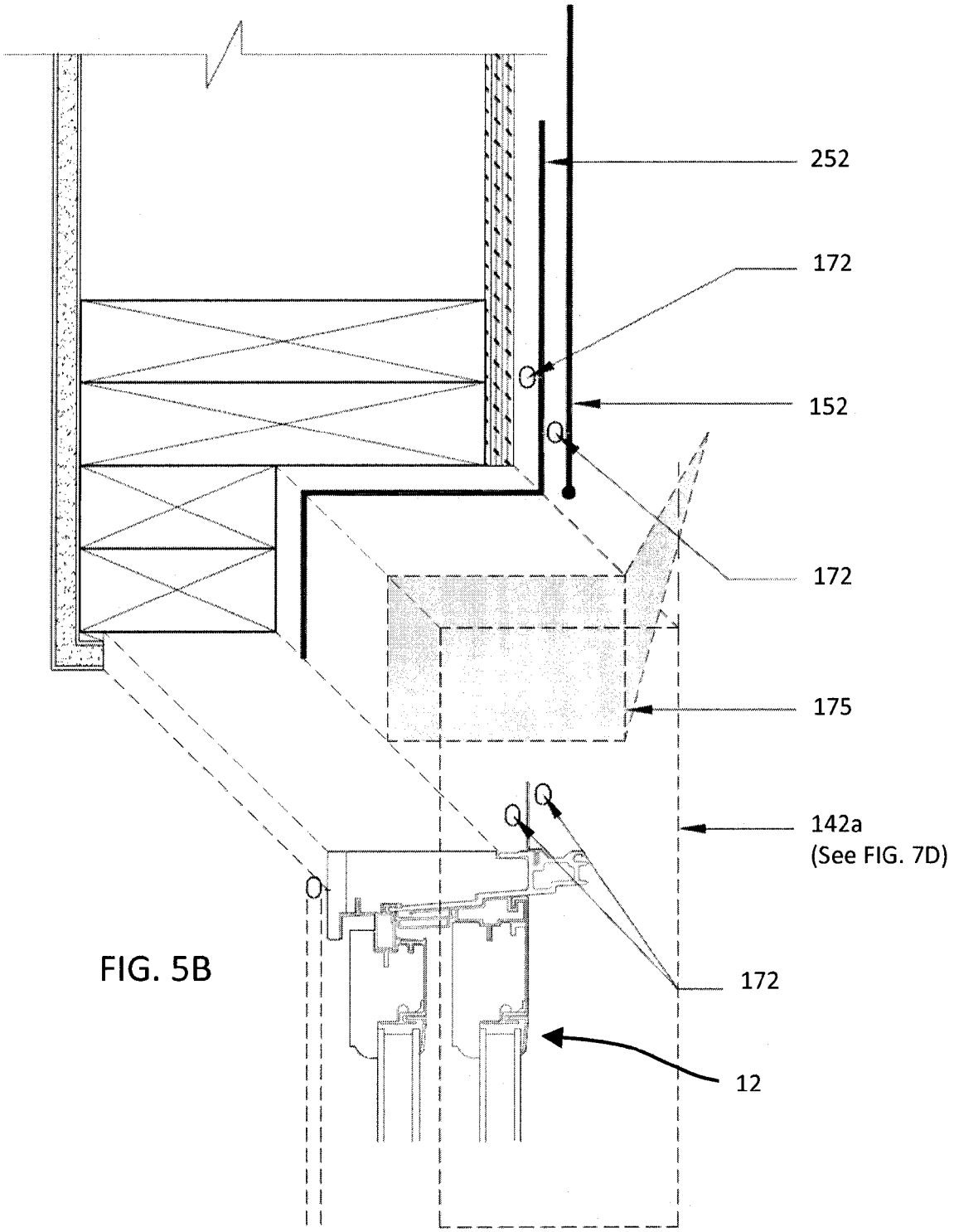
FIG. 5B is an exploded perspective view illustrating tasks of applying an adhesive to a top surface of the wall, forming a recessed jamb diverter strip, applying sealant, placing a door or window frame in the opening, attaching a header diverter sheet, and applying a sheet of flexible membrane according to the methods for flashing an opening illustrated in FIG. 5A.

With continued reference to the embodiments illustrated in FIGS. 5A, 5B, and 6, the method for flashing an opening 52 in a wall 20, 40 configured to receive a recessed door or window frame 12 further includes applying a continuous amount of sealant 172 along an inside flange of the door or window frame 12. The sealant 172, according to an embodiment, includes applying a continuous bead of sealant 172, for example, a one-half inch bead of sealant 172 along the inside flange of the door or window frame 12. The sealant 172, according to an embodiment, may be a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

With continued reference to the embodiments illustrated in FIGS. 5A, 5B, and 6, the method for flashing an opening 52 in a wall 20, 40 configured to receive a recessed door or window frame 12 further includes placing the door or window frame 12 in the opening 52, setting the door or window frame 12 in the opening 52, and leveling and fastening the door or window frame 12 in the opening 52, and applying sealant 172 along an outside flange of the door or window frame 12 and over an outside edge of the door or window frame 12 to extend to the wall 20 surrounding the opening 52. The sealant 172 applied to the outside flange, in an embodiment, maybe tooled over the outside edge of the door or window frame 12 to cover any voids between the window frame 12 and the flashing. The installation of the door or window frame 12 and the door or window it receives, according to these embodiments, can be performed according to manufacturer specifications. The sealant 172, according to an embodiment, includes applying a continuous bead of sealant 172, for example, a one-half inch bead of sealant 172 along the inside flange and the outside flange of the door or window frame 12. The sealant 172, according to an embodiment, may be a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

Figure 8A:
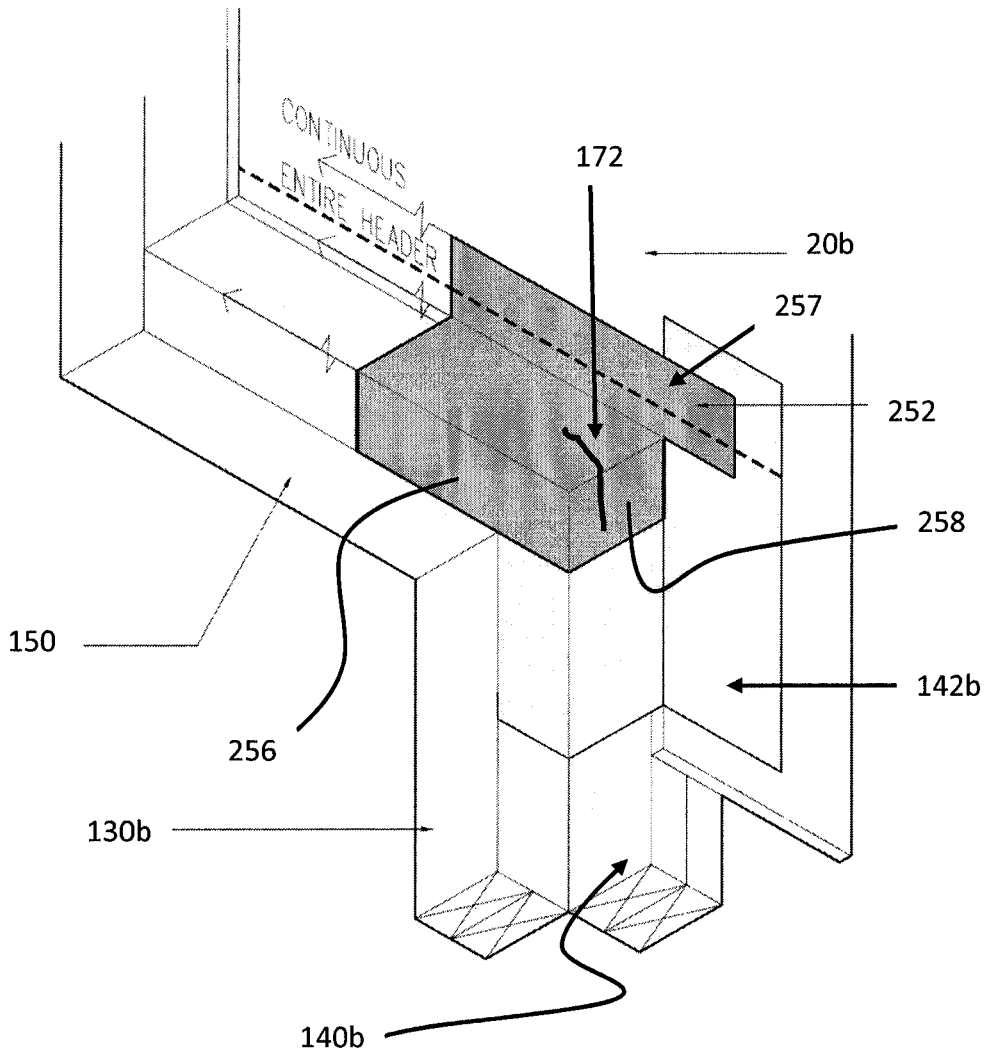
FIG. 8A is a partial perspective view illustrating the task of attaching the header diverter sheet illustrated in FIG. 5B and according to the method for flashing an opening illustrated in FIG. 5A.

With continued reference to the embodiments illustrated in FIG. 5B and with reference to the embodiments illustrated in FIG. 8A, after the door or window frame 12 has been installed within the opening 52, the method for flashing an opening 52 in a wall 20, 40 configured to receive a recessed door or window frame 12 further includes attaching a header diverter sheet 252 to the top surface 20*b* of the wall 20 and over the adhesive 170 or 172 along the upper edge of the door or window frame 12. The header diverter sheet 252, according to this embodiment, may have a center strip 254, an outer edge 255, and an inner edge 256, the center strip 254 extending along an entire length of the recessed top header 250 and extending down from the recessed top header 250 at least to the top header 150. The outermost ends of the outer edge 255 and inner edge 256 may be cut, according to an embodiment, to form a wall flap 257 and a jamb flap 258. The center strip 254, in an embodiment, may extend along the entire length of the recessed top header 250, and the outer edge 255 including the wall flap 257 may be folded around the recessed top header 250 flush against the top surface 20*b* of the wall 20 with the wall flap 257 extending at least past the respective recessed jamb 140*a* and 140*b*. Each jamb flap 258, according to an embodiment, may be folded around the recessed top header 250 extending onto the respective recessed jamb 140*a* and 140*b*, and the inner edge 256 may be folded down from the recessed top header 250 down flush with the top header 150. The header diverter sheet 252 according to an embodiment, may be a non-adhesive laminate for structural sealing, for example a 12 inch wide flexible sheet of FUTURE FLASH® self-sealing waterproof flashing membrane, as described above, and having a nominal thickness of 25 mils. In other embodiments, the header diverter sheet 252 may have a width less than or greater than 12 inches (for example, 3, 6, 9, 18, or 36 inches), and may have a nominal thickness greater than 25 mils (for example, 35 mils or 40 mils). However, embodiments of the present invention are not limited to these embodiments.

Figure 8B:
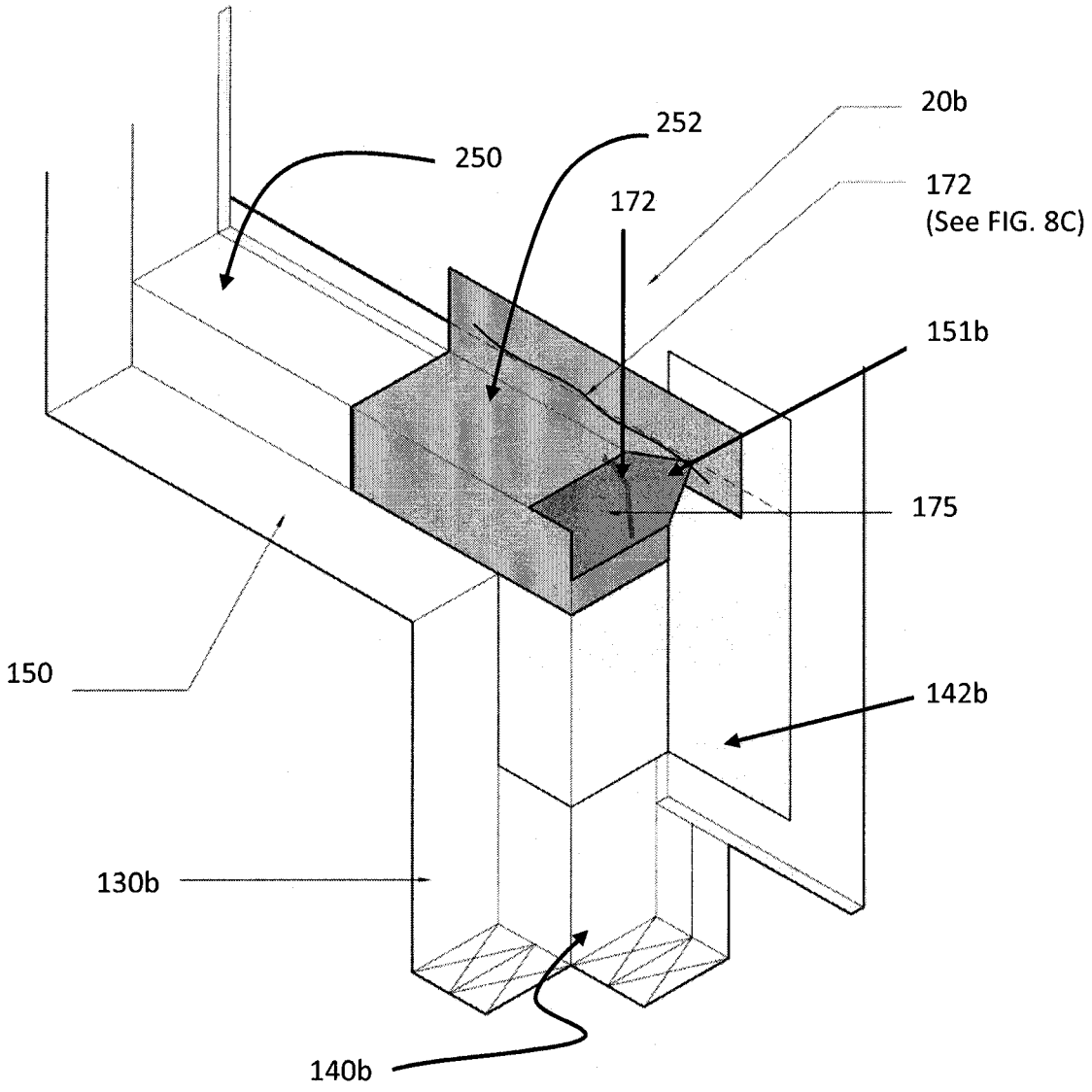
FIG. 8B is a partial perspective view illustrating the task of applying the sheet of flexible membrane illustrated in FIG. 5B and according to the method for flashing an opening illustrated in FIG. 5A.

With continued reference to the embodiments illustrated in FIGS. 5B, 8A, and 8B, the method for flashing an opening 52 in a wall 20, 40 configured to receive a recessed door or window frame 12 according to these embodiments further includes applying an adhesive 170 or 172 at each respective intersection 151*a* and 151*b* of the recessed top header 250 and each recessed jamb 140*a* and 140*b*. The adhesive 170 or 172 according to this embodiment may be adhesive strips 170 or sealant 172. In an embodiment where the adhesive is sealant 172, the sealant 172 may be of a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO. In another embodiment, the adhesive may be an adhesive strip 170, and according to an embodiment, may be double-sided tape having a thickness of ⅜ inch, for example double-sided tape manufactured by TREMCO. In another embodiment, the adhesive strip 170 may be double-sided tape having a thickness of 3/16 inch.

With continued reference to the embodiments illustrated in FIGS. 5B and 8B, the method for flashing an opening 52 in a wall 20, 40 configured to receive a recessed door or window frame 12 according to these embodiments further includes applying a sheet of flexible membrane 175 at each respective intersection 151*a* and 151*b* of the recessed top header 250 and each recessed jamb 140*a* and 140*b* over the adhesive 170 or 172 at each respective intersection 151*a* and 151*b*, and stretching each sheet of flexible membrane 175 over an outside edge of the intersection 151*a* and 151*b* and flush with the wall 20, the top header 150, and the recessed top header 250. The sheet of flexible membrane 175, according to this embodiment, may be a strip of stretchable film or tape, for example, having a hexagonal or pentagonal shape with a quasi-triangular portion stretched over the outside edge of the respective intersection 151*a* or 151*b* and trimmed flush with the wall 20. In an embodiment, the sheet of flexible membrane 175 may be precut at its corners to streamline installation at the corners or to facilitate bending, stretching, or installation. In an embodiment, the sheet of flexible membrane 175 may be a 4 inch by 6 inch strip of stretchable self-adhering, pliable polymer surface membrane or tape having a pentagonal or hexagonal shape, for example, the Butterfly Tape™ described above, and having a nominal thickness of 35 mils. In another embodiment, the sheet of flexible membrane 175 may be a 6 inch by 6 inch strip of stretchable self-adhering, pliable polymer surface membrane or tape having a pentagonal or hexagonal shape, for example, the Butterfly Tape™ described above.

Figure 8C:
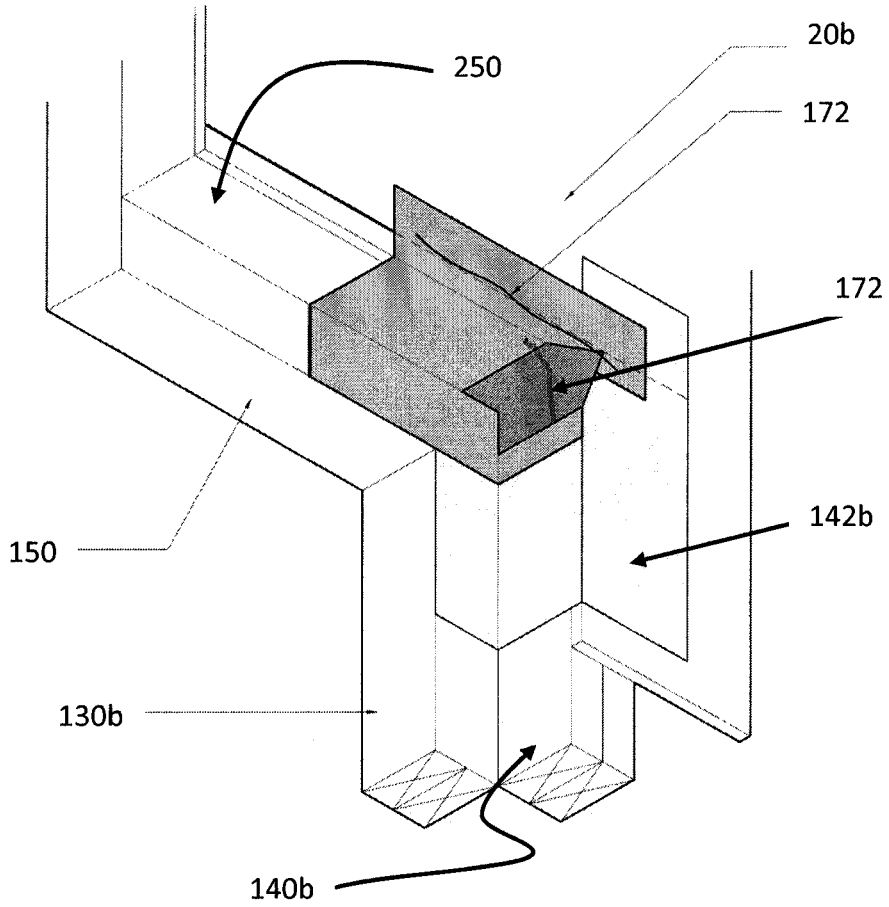
FIG. 8C is a partial perspective view illustrating an additional task of applying an adhesive along the header diverter sheet illustrated in FIGS. 5B and 8A and according to the method for flashing an opening illustrated in FIG. 5A.

With reference now to the embodiments illustrated in FIGS. 5B and 8C, the method for flashing an opening 52 in a wall 20, 40 configured to receive a recessed door or window frame 12, in some embodiments, may include applying an adhesive 170 or 172 along an upper edge of the door or window frame 12 along the header diverter sheet 252. The adhesive, 170 or 172, according to an embodiment, may be a continuous bead of sealant 172. The sealant 172, according to this embodiment, may be the high quality polyurethane caulk configured to adhere to surfaces including wood, vinyl, and metal across a wide range of temperatures experienced in typical window and/or door frames exposed to various weather conditions, for example, the FUTURE FLASH® Sealant, described above. In this embodiment, the sealant 172 may be applied as an approximately ½ inch bead of sealant. In an embodiment, the sealant 172 may be applied along the entire length of the opening 52 at the recessed top header 250 over the header diverter sheet 252 in an upside-down V-shape or pyramid-shape applied starting at a center of the header diverter sheet 252 and running down to each corner at the intersection 151*a* and 151*b* of the recessed top header 250 and each recessed jamb 140*a* and 140*b*. In another embodiment, the sealant 172 may be applied along the entire length of the opening 52 at the recessed top header 250 over the header diverter sheet 252 in an approximately horizontal shape extending to each corner at the intersection 151*a* and 151*b* of the recessed top header 250 and each recessed jamb 140*a* and 140*b*. The adhesive, 170 or 172, according to another embodiment, may be an adhesive strip 170. The adhesive strip 170, according to an embodiment, may be double-sided tape. For example, in an embodiment, the adhesive strip 170 may be double-sided tape having a thickness of ⅜ inch, for example double-sided tape manufactured by TREMCO. In another embodiment, the adhesive strip 170 may be double-sided tape having a thickness of 3⁄16 inch. In an embodiment, the adhesive strip 170 may be applied along the entire length of the opening 52 at the recessed top header 250 over the header diverter sheet 252 in an upside-down V-shape or pyramid-shape applied starting at a center of the header diverter sheet 252 and running down to each corner at the intersection 151*a* and 151*b* of the recessed top header 250 and each recessed jamb 140*a* and 140*b*. In another embodiment, the adhesive strip 170 may be applied along the entire length of the opening 52 at the recessed top header 250 over the header diverter sheet 252 in an approximately horizontal shape extending to each corner at the intersection 151*a* and 151*b* of the recessed top header 250 and each recessed jamb 140*a* and 140*b*.

Figure 8D:
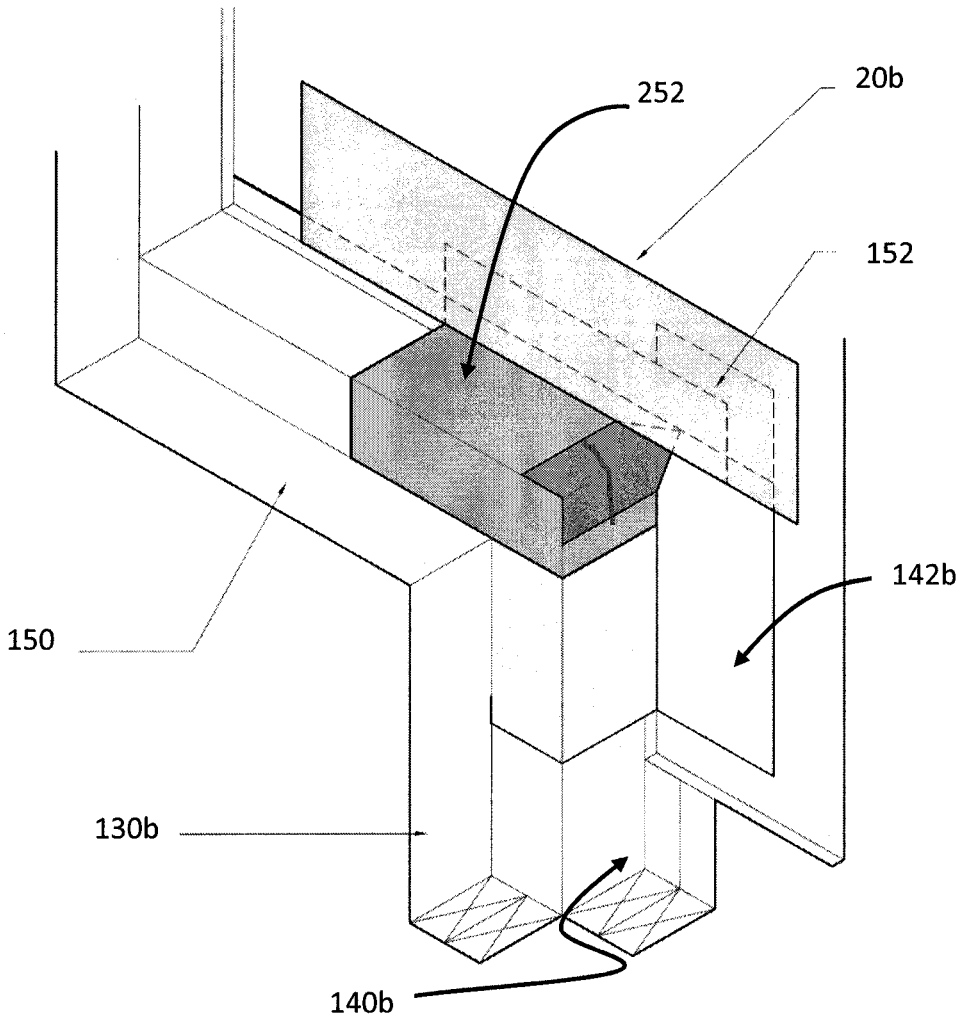
FIG. 8D is a partial perspective view illustrating an additional task of attaching a second header diverter sheet illustrated in FIG. 5B and according to an embodiment for a method for flashing an opening.

With continued reference to the embodiments illustrated in FIGS. 5B and 8D, the method for flashing an opening 52 in a wall 20, 40 configured to receive a recessed door or window frame 12, in these embodiments, further includes attaching a secondary header diverter sheet 152 to the top surface 20*b* of the wall 20 and over the header diverter sheet 252. The secondary header diverter sheet 152, according to an embodiment, may be a non-adhesive laminate for structural sealing, for example a 9 inch wide flexible sheet of FUTURE FLASH® self-sealing waterproof flashing membrane, as described above, and having a nominal thickness of 25 mils. In other embodiments, the header diverter sheet 152 may have a width less than or greater than 9 inches (for example, 3, 6, 12, 18, or 36 inches), and may have a nominal thickness greater than 25 mils (for example, 35 mils or 40 mils). However, embodiments of the present invention are not limited to these embodiments.

In the embodiments described above with references to FIGS. 5A, 5B, 6, 7A-7D, and 8A-8D, for example, attaching the sill diverter sheet 123, attaching the jamb diverter sheet 143, and attaching the header diverter sheets 152 and 252, can be performed by using sealant, staples, nails, screws, tacks, or any other suitable fasteners or fastening material directly penetrating through the flashing material 123, 143, 152, and/or 252. In embodiments where the flashing material 123, 143, 152, and/or 252 is the flexible sheet of sandwich-type flashing, for example, FUTURE FLASH® self-sealing waterproof flashing membrane, as described above, the inner core of rubberized asphalt may be configured to self-seal any holes created by attaching these flashing materials 123, 143, 152, and/or 252 using conventional fasteners, without the need to apply further sealants.

According to other aspects of the present invention, according to the embodiments illustrated in FIGS. 7A-7D, 9, 10, and 11A-11G, another method for flashing an opening 52 in a wall 20, 40 configured to receive a recessed door or window frame 12 having a production recess is shown. While the previous embodiments, for example as shown in FIGS. 5A, 5B, 6, 7A-7D, and 8A-8D provides a standard method for flashing an opening 52 in a wall 20, 40 configured to receive a recessed door or window frame 12, the method according to the embodiments described below and illustrated, for example, in FIGS. 7A-7D, 9, 10, and 11A-11G, may include additional protection against leaking. For window or door frames particularly prone to cracking due to material properties (e.g., vinyl or plastic frames) or external forces and pressures (e.g., seismic activity, natural vibrations and frequencies, shipping damages, etc.), additional protection may be required against leakage or moisture penetration due to these cracks. Accordingly, the method according to the embodiments described below and illustrated in FIGS. 7A-7D, 9, 10, and 11A-11G, includes additional protection, for example, under the door or window frame to divert any moisture away from the drywall or interior walls 40 of the structure.

The production recess at the recessed door or window frame 12, according to these embodiments, may have a depth that is less than 4 inches. In other embodiments, however, the production recesses at the recessed door or window frame 12 may be greater than 4 inches, and in some embodiments, the depth may range from between 4 inches to 8 inches. Repeated descriptions of elements in the embodiments shown in FIGS. 7A-7D, 9, 10, and 11A-11G that are similar or identical to elements shown and/or described with regards to the embodiments illustrated in FIGS. 1, 2, 3A-3C, 4A-4F, 5A, 5B, 6, 7A-7D, and 8A-8D and having the same or similar reference numerals, are omitted below. Like reference numerals denote like elements throughout the specification.

The opening 52, according to these embodiments is defined by the same structure as the opening 52 described with regards to the embodiments shown in FIGS. 5A, 5B, 6, 7A-7D, and 8A-8D. Thus, the opening 52 is defined by the bottom sill 110, the recessed sill 120, the pair of side jambs 130*a* and 130*b*, the pair of recessed jambs 140*a* and 140*b*, the top header 150, and the recessed top header 250.

Figure 9:
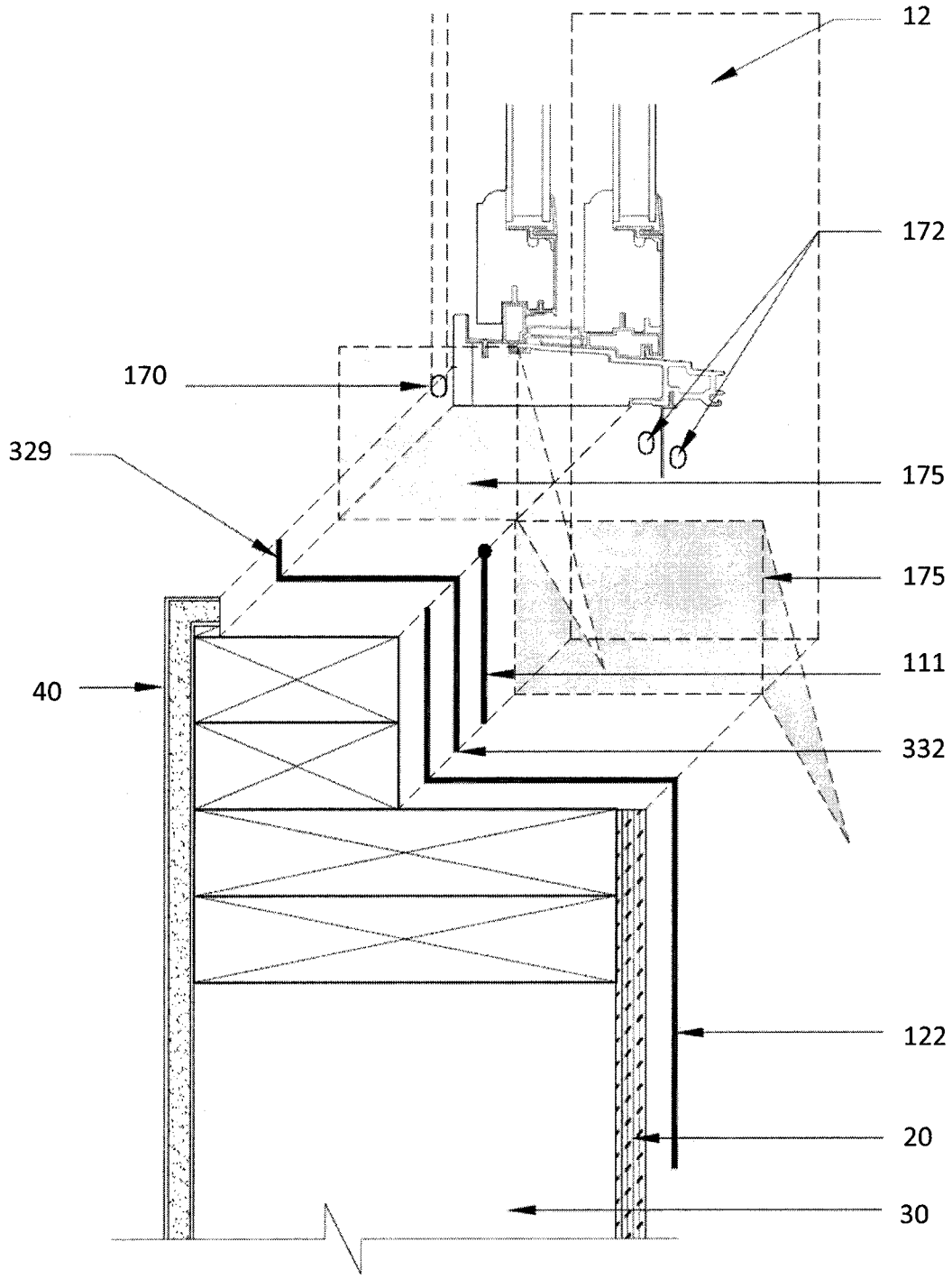
FIG. 9 is an exploded perspective view illustrating a method for flashing an opening in a wall configured to receive a recessed door or window frame according to another embodiment of the present invention.
Figure 10:
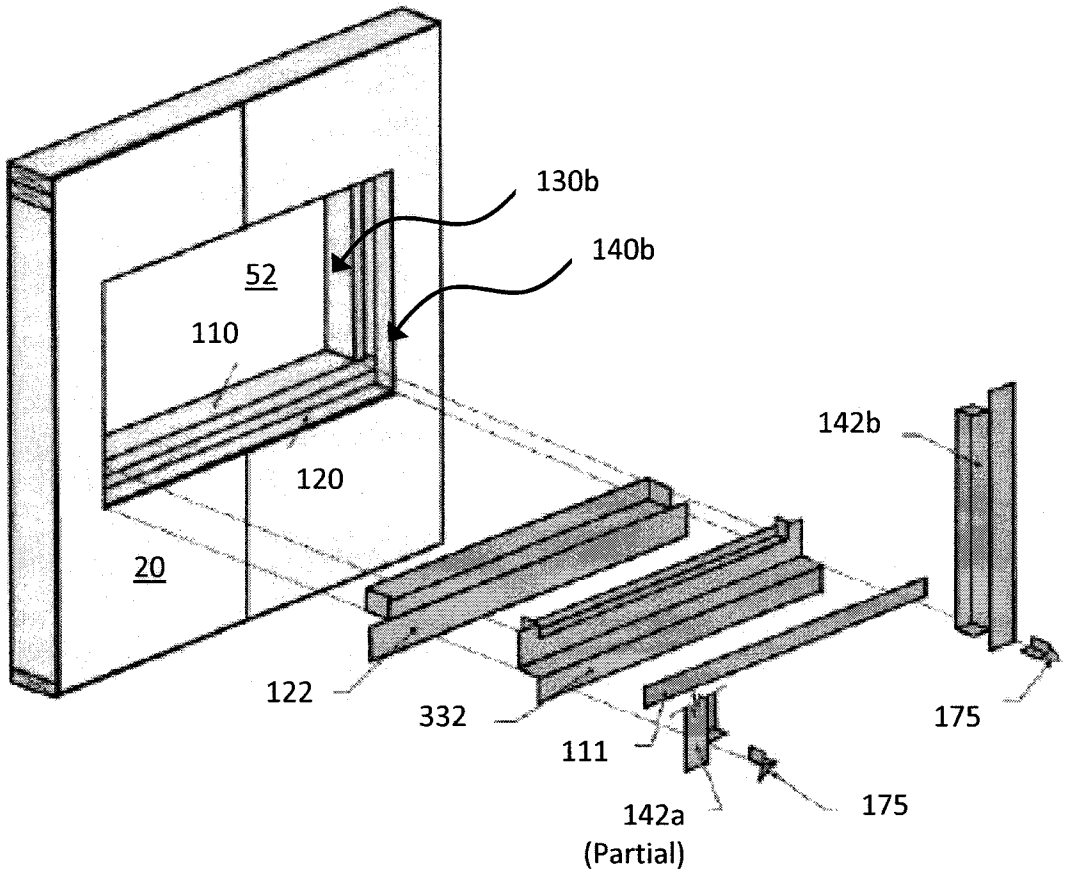
FIG. 10 is an exploded perspective view illustrating tasks of forming a recessed sill diverter dam, applying a sheet of flexible membrane, forming a recessed jamb diverter strip, forming a bottom sill diverter dam, and attaching a lower strip of weep flashing according to the method for flashing an opening illustrated in FIGS. 7A-7D and 8.

With reference to the embodiments illustrated in FIGS. 9, 10, and 7A, the method for flashing an opening 52 in a wall 20, 40 configured to receive a recessed door or window frame 12 having a production recess according to these embodiments includes forming a recessed sill diverter dam 122 at the recessed sill 120, according to the methods and materials previously described above with regards to the embodiments illustrated in FIGS. 5A, 6, and 7A, which are fully incorporated herein. A material of the sill diverter sheet 123, according to these embodiments, may be the same as any of the embodiments of the sill diverter sheets 123 previously described, having a width and nominal thickness, for example, of 12 inches and 40 mils, respectively, or a thickness less than or greater than 12 inches (for example, 3, 6, 9, 18, or 36 inches), and may have a nominal thickness less than 40 mils (for example, 25 mils or 35 mils), according to other embodiments. As described above, in an embodiment where the production recess has a depth greater than 4 inches but less than 8 inches, the sill diverter sheet 123 may be the 18 inch wide FUTURE FLASH® self-sealing waterproof flashing membrane having a nominal thickness of 40 mils, described above. In other embodiments where the production recess has a depth greater than 8 inches, the sill diverter sheet 123 may be the 36 inch wide FUTURE FLASH® self-sealing waterproof flashing membrane having a nominal thickness of 40 mils, described above.

With continued reference to the embodiments illustrated in FIGS. 9, 10, 7A, 7B, and 12I, the method for flashing an opening 52 in a wall 20, 40 configured to receive a recessed door or window frame 12 having a production recess according to these embodiments further includes applying an adhesive 170 or 172 at each intersection 141*a* (see FIG. 7D) of the recessed sill 120 and each recessed jamb 140*a* and 140*b* over the recessed sill diverter dam 122. The adhesive 170 or 172 according to this embodiment may be adhesive strips 170 or sealant 172. In an embodiment where the adhesive is sealant 172, the sealant 172 may be of a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO. In another embodiment, the adhesive may be an adhesive strip 170, and according to an embodiment, may be double-sided tape having a thickness of ⅜ inch, for example double-sided tape manufactured by TREMCO. In another embodiment, the adhesive strip 170 may be double-sided tape having a thickness of 3⁄16 inch.

With continued reference to the embodiments illustrated in FIGS. 9, 10, 7B, and 12I, the method for flashing an opening 52 in a wall 20, 40 configured to receive a recessed door or window frame 12 having a production recess according to these embodiments further includes applying a sheet of flexible membrane 175 at each intersection 141*a* (see FIG. 7D) of the recessed sill 120 and each recessed jamb 140*a* and 140*b* over the recessed sill diverter dam 122 and over the adhesive 170 or 172 at each intersection 141*a* (see FIG. 7D) of the recessed sill 120 and each recessed jamb 140*a* and 140*b* over the recessed sill diverter dam 122, and stretching each sheet of flexible membrane 175 over an outside edge of the respective intersection 141*a* (see FIG. 7D) and flush with the wall 20, according to the methods previously described above with regards to the embodiments illustrated in FIGS. 5A, 6, and 7B, which are fully incorporated herein. The sheet of flexible membrane 175, according to this embodiment, may be a strip of stretchable film or tape, for example, having a hexagonal or pentagonal shape with a quasi-triangular portion stretched over the outside edge of the respective intersection 141*a* (see FIG. 7D) and trimmed flush with the step 215. In an embodiment, the sheet of flexible membrane 175 may be precut at its corners to streamline installation at the corners or to facilitate bending, stretching, or installation. In an embodiment, the sheet of flexible membrane 175 may be a 4 inch by 6 inch strip of stretchable self-adhering, pliable polymer surface membrane or tape having a pentagonal or hexagonal shape, for example, the Butterfly Tape™ described above, and having a nominal thickness of 35 mils. In another embodiment, the sheet of flexible membrane 175 may be a 6 inch by 6 inch strip of stretchable self-adhering, pliable polymer surface membrane or tape having a pentagonal or hexagonal shape, for example, the Butterfly Tape™ described above.

With continued reference to the embodiments illustrated in FIGS. 9 and 7C, the method for flashing an opening 52 in a wall 20, 40 configured to receive a recessed door or window frame 12 further includes applying an adhesive 170 or 172 to a top surface 20*b* of the wall 20 along an upper edge of the opening 52 along the recessed top header 250, according to the methods and using the materials previously described above with regards to the embodiments illustrated in FIGS. 5A, 5B, 6, and 7C, which are fully incorporated herein.

With continued reference to the embodiments illustrated in FIGS. 9, 10, and 7D, the method for flashing an opening 52 in a wall 20, 40 configured to receive a recessed door or window frame 12 further includes forming a recessed jamb diverter strip 142*a* and 142*b* (see FIG. 7C) at each recessed jamb 120, according to the methods and using the materials previously described above with regards to the embodiments illustrated in FIGS. 5A, 5B, 6, and 7D, which are fully incorporated herein. The recessed jamb diverter sheet 143, according to an embodiment, may be a non-adhesive laminate for structural sealing, as described above, for example a 12 inch wide flexible sheet of FUTURE FLASH® self-sealing waterproof flashing membrane, and having a nominal thickness of 25 mils. In other embodiments, the jamb diverter sheet 143 may have a width less than or greater than 12 inches (for example, 3, 6, 9, 18, or 36 inches), and may have a nominal thickness greater than 25 mils (for example, 35 mils or 40 mils). However, embodiments of the present invention are not limited to these embodiments.

Figure 11A:
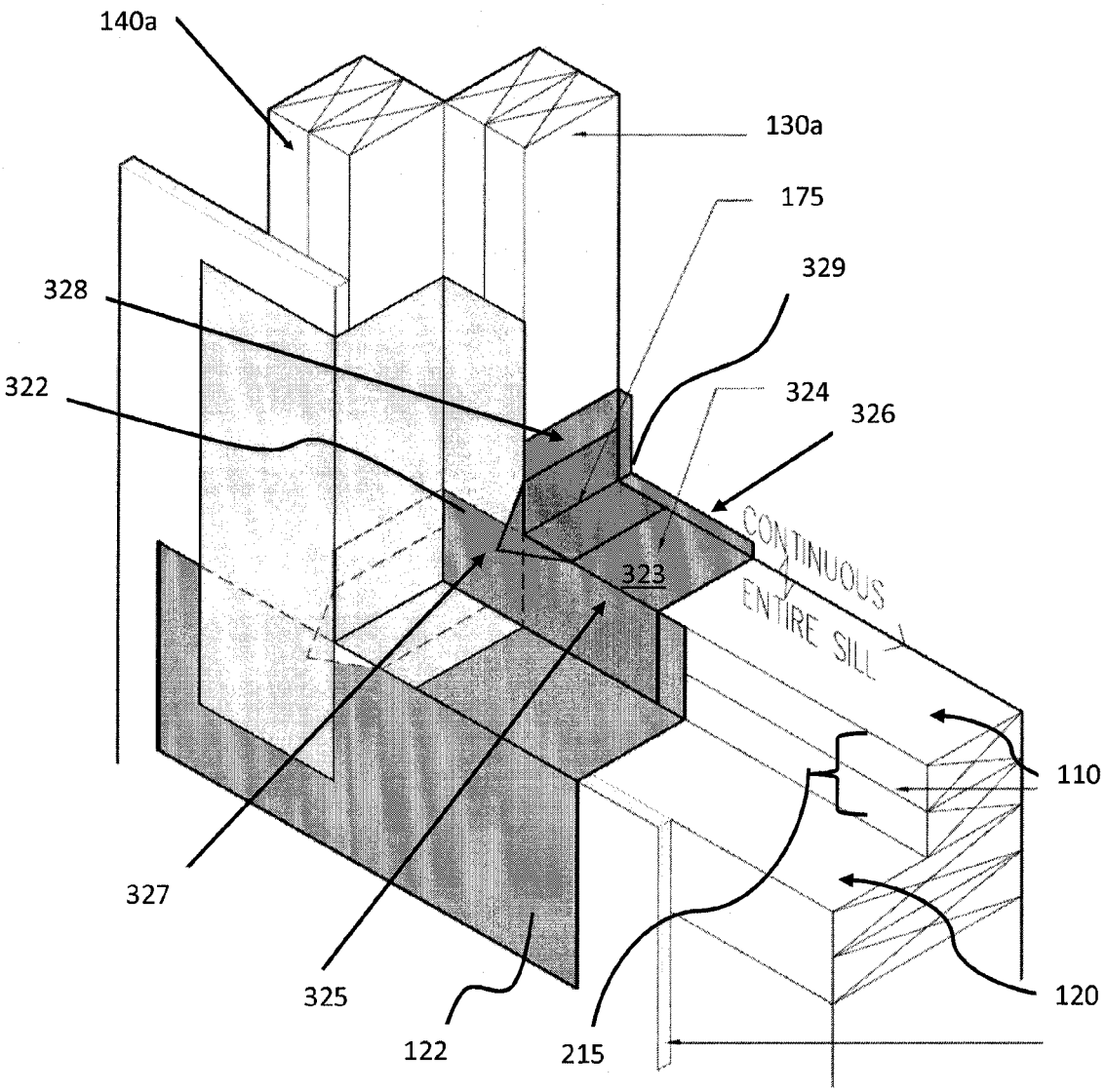
FIG. 11A is a partial perspective view illustrating the task of forming the bottom sill diverter dam illustrated in FIG. 10 and according to the method for flashing an opening illustrated in FIG. 9.

With reference to the embodiments illustrated in FIGS. 9, 10, and 11A, the method for flashing an opening 52 in a wall 20, 40 configured to receive a recessed door or window frame 12 having a production recess according to these embodiments includes forming a bottom sill diverter dam 322 at the bottom sill 110. Forming the bottom sill diverter dam 322 according to this embodiment includes attaching a sill diverter sheet 323 having a center strip 324, an outer edge 325, and an inner edge 326 along an entire length of the bottom sill 110 with the center strip 114 forming a shelf along the bottom sill 110 and the outside edge 325 extending down over an entire height of the bottom sill 110 at the step 215. In this embodiment, the outermost ends of the outer edge 325 and inner edge 326 may be cut to form a wall flap 327, a diverter flap 329, and a jamb flap 328 at each respective side jamb 130*a* and 130*b* with the outer edge 325 extending down from the bottom sill 110 flush down against the step 215 at the recessed sill 120. The wall flap 327, according to an embodiment, may extend along a thickness of the respective side jamb 130*a* and 130*b* to be flush with the respective recessed jamb 140*a* and 140*b*. Each jamb flap 328, in this embodiment, may be folded up flush with its respective side jamb 130*a* and 130*b*.

Forming the bottom sill diverter dam 322, according to this embodiment, may further include forming the diverter flap 329 by folding the inner edge 326 of the diverter sheet 323 up along the length of the bottom sill 110 and at each respective side jamb 130*a* and 130*b* where each jamb flap 328 is folded up, forming the shelf with the diverter flap 329 extending along the entire length of the bottom sill 110 as well as along a height of each side jamb 130*a* and 130*b*. The diverter flap 329, according to this embodiment, may be configured to receive a backside of the door or window frame 12 configured to be installed at the opening 52. In this embodiment, in order to allow sufficient overlap for attaching the door or window frame 12 to the diverter flap 329, the sill diverter sheet 323 may be cut at least 1 inch wider than a depth of the door or window frame 12 and placed at the bottom sill 110 in line with the exterior wall 20 face where the door or window frame 12 is to be installed (recessed) such that the at least extra 1 inch in width is folded up at the inner edge 326 extending up.

According to this embodiment, an adhesive strip 170 may then be placed along the diverter flap 329 and configured to attach the diverter flap 329 to the backside of the door or window frame 12. The adhesive strip 170, according to an embodiment, may be double-sided tape. For example, in an embodiment, the adhesive strip 170 may be the double-sided tape having a thickness of ⅜ inch, for example manufactured by TREMCO. In another embodiment, the adhesive strip 170 may be the double-sided tape having a thickness of 3/16 inch.

The sill diverter sheet 323, according to an embodiment, may be a non-adhesive laminate for structural sealing, for example a 6 inch, 9 inch, or 12 inch wide flexible sheet of FUTURE FLASH® self-sealing waterproof flashing membrane, as described above, and having a nominal thickness of 25 mils. In other embodiments, the sill diverter sheet 323 may have a width less than or greater than 6, 9, or 12 inches (for example, 3, 18, or 36 inches), and may have a nominal thickness greater than 25 mils (for example, 35 mils or 40 mils). However, embodiments of the present invention are not limited to these embodiments. As described above with reference to the sill diverter sheet 123, in an embodiment where the production recess has a depth greater than 4 inches but less than 8 inches, the sill diverter sheet 323 may be the 18 inch wide FUTURE FLASH® self-sealing waterproof flashing membrane having a nominal thickness of 40 mils, described above. In other embodiments where the production recess has a depth greater than 8 inches, the sill diverter sheet 323 may be the 36 inch wide FUTURE FLASH® self-sealing waterproof flashing membrane having a nominal thickness of 40 mils, described above.

Figure 11B:
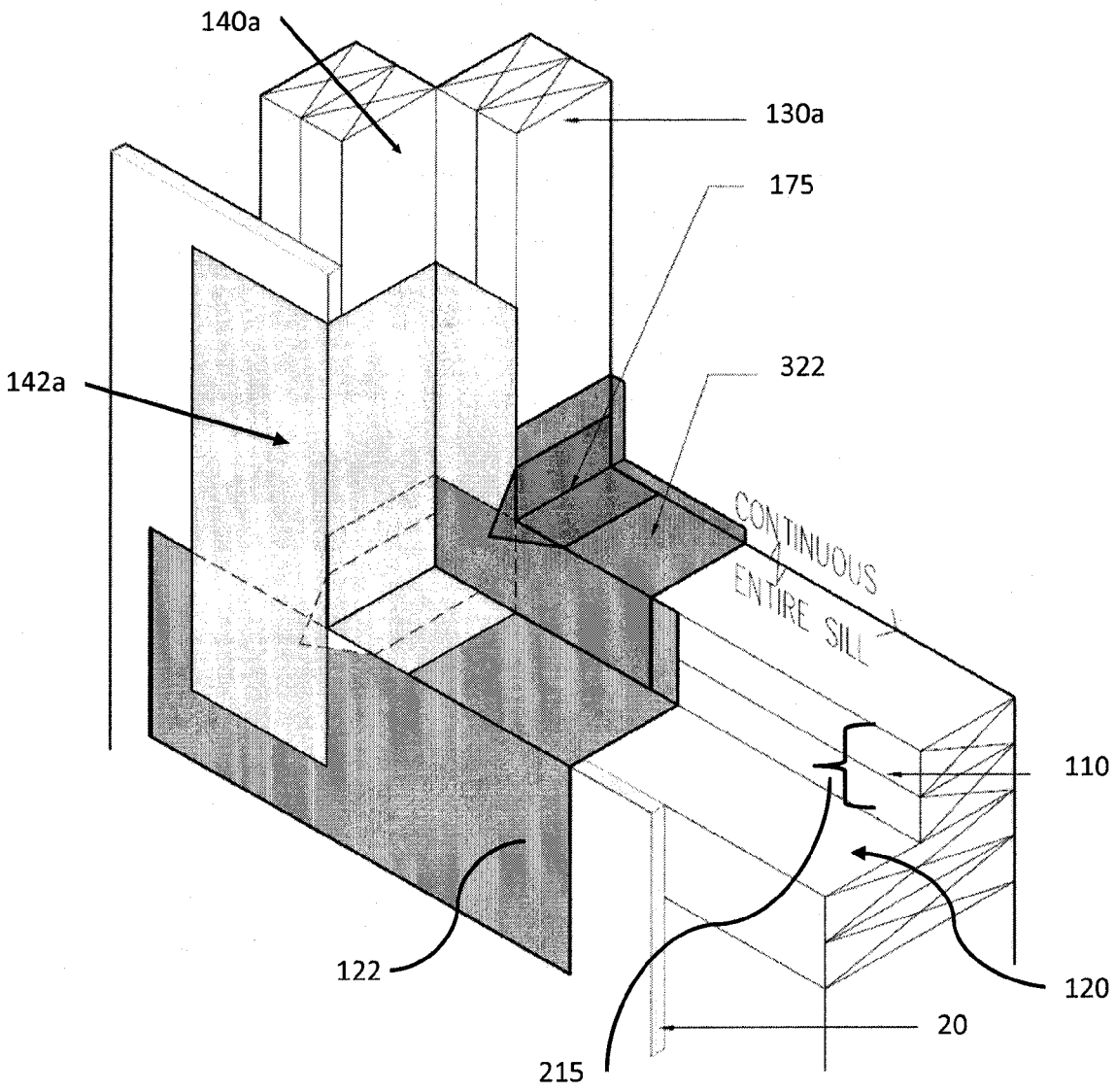
FIG. 11B is a partial perspective view illustrating the task of applying the sheet of flexible membrane illustrated in FIG. 10 and according to the method for flashing an opening illustrated in FIG. 9.

With continued reference to the embodiments illustrated in FIGS. in FIGS. 9, 10, and 11B, the method for flashing an opening 52 in a wall 20, 40 configured to receive a recessed door or window frame 12 according to these embodiments further includes applying a sheet of flexible membrane 175 at each intersection 131*a* (and similarly at the opposite intersection 131*b*) of the bottom sill 110 and each side jamb 130*a* and 130*b* over the bottom sill diverter dam 322, and stretching each sheet of flexible membrane 175 over an outside edge of the respective intersection 131*a* and 131*b* and flush with the step 215. The sheet of flexible membrane 175, according to this embodiment, may be a strip of stretchable film or tape, for example, having a hexagonal or pentagonal shape with a quasi-triangular portion stretched over the outside edge of the respective intersection 141*a* (see FIG. 7D) and trimmed flush with the step 215. In an embodiment, the sheet of flexible membrane 175 may be precut at its corners to streamline installation at the corners or to facilitate bending, stretching, or installation. In an embodiment, the sheet of flexible membrane 175 may be a 4 inch by 6 inch strip of stretchable self-adhering, pliable polymer surface membrane or tape having a pentagonal or hexagonal shape, for example, the Butterfly Tape™ described above, and having a nominal thickness of 35 mils. In another embodiment, the sheet of flexible membrane 175 may be a 6 inch by 6 inch strip of stretchable self-adhering, pliable polymer surface membrane or tape having a pentagonal or hexagonal shape, for example, the Butterfly Tape™ described above. The sheet of flexible membrane 175, according to these embodiments, may be applied at each intersection 131*a* (and similarly at the opposite intersection 131*b*) of the bottom sill 110 and each side jamb 130*a* and 130*b* over the bottom sill diverter dam 322, and attached at each respective location using adhesive, sealant, nails, screws, tacks, fasteners, or staples. In an embodiment, the sealant used to attach the respective sheets of flexible membrane 175 may be sealant 172, such as a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

Figure 11C:
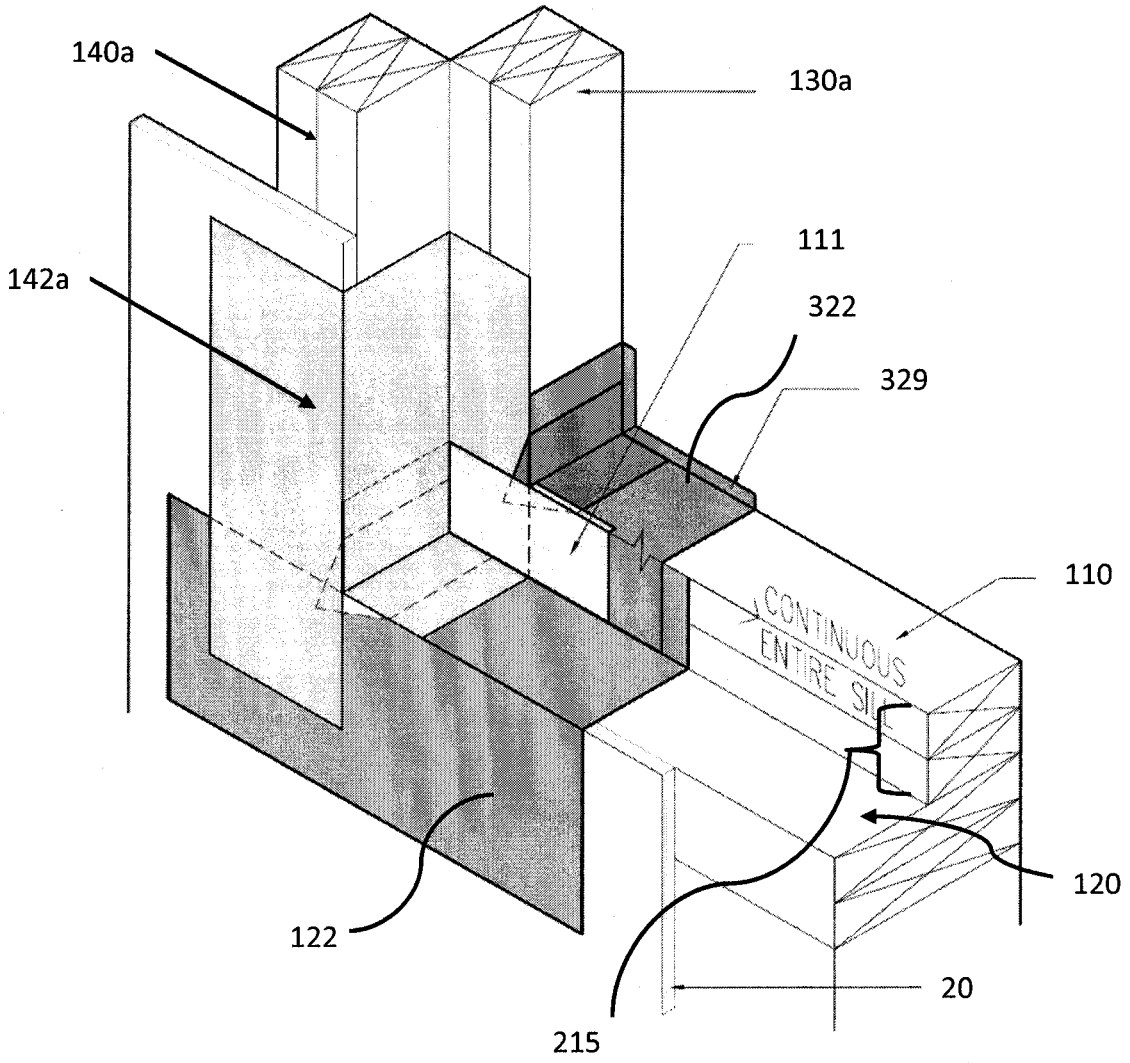
FIG. 11C is a partial perspective view illustrating the task of attaching the lower strip of weep flashing illustrated in FIG. 10 and according to the method for flashing an opening illustrated in FIG. 9.

With continued reference to the embodiments illustrated in FIGS. in FIGS. 9, 10, and 11C, the method for flashing an opening 52 in a wall 20, 40 configured to receive a recessed door or window frame 12 having a production recess according to these embodiments further includes attaching a lower strip of weep flashing 111 to the step 215 between the bottom sill 110 and the recessed sill 120 overlapping the outer edge 325 of the bottom sill diverter dam 322 adjacent to the opening 52 at the bottom sill 110. The lower strip of weep flashing 111, according to this embodiment, extends along at least an entire length of the recessed sill 120. The lower strip of weep flashing 111, according to this embodiment, may be a non-adhesive laminate for structural sealing, for example a 3 inch wide flexible sheet of FUTURE FLASH® self-sealing waterproof flashing membrane, as described above, and having a nominal thickness of 25 mils. In other embodiments, the weep flashing 111 may have a width greater than 3 inches (for example, 6, 9, 12, 18, or 36 inches), and may have a nominal thickness greater than 25 mils (for example, 35 mils or 40 mils). However, embodiments of the present invention are not limited to these embodiments.

With continued reference to the embodiments illustrated in FIGS. in FIGS. 9 and 10, the method for flashing an opening 52 in a wall 20, 40 configured to receive a recessed door or window frame 12 further includes applying a continuous amount of sealant 172 along an inside flange of the door or window frame 12. The sealant 172, according to an embodiment, includes applying a continuous bead of sealant 172, for example, a one-half inch bead of sealant 172 along the inside flange of the door or window frame 12. The sealant 172, according to an embodiment, may be a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

With continued reference to the embodiments illustrated in FIGS. 9 and 10, the method for flashing an opening 52 in a wall 20, 40 configured to receive a recessed door or window frame 12 further includes placing the door or window frame 12 in the opening 52, setting the door or window frame 12 in the opening 52, and leveling and fastening the door or window frame 12 in the opening 52, and applying sealant 172 along an outside flange of the door or window frame 12 and over an outside edge of the door or window frame 12 to extend to the wall 20 surrounding the opening 52. The sealant 172 applied to the outside flange, in an embodiment, maybe tooled over the outside edge of the door or window frame 12 to cover any voids between the window frame 12 and the flashing. The installation of the door or window frame 12 and the door or window it receives, according to these embodiments, can be performed according to manufacturer specifications. The sealant 172, according to an embodiment, includes applying a continuous bead of sealant 172, for example, a one-half inch bead of sealant 172 along the inside flange and the outside flange of the door or window frame 12. The sealant 172, according to an embodiment, may be a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

Figure 11D:
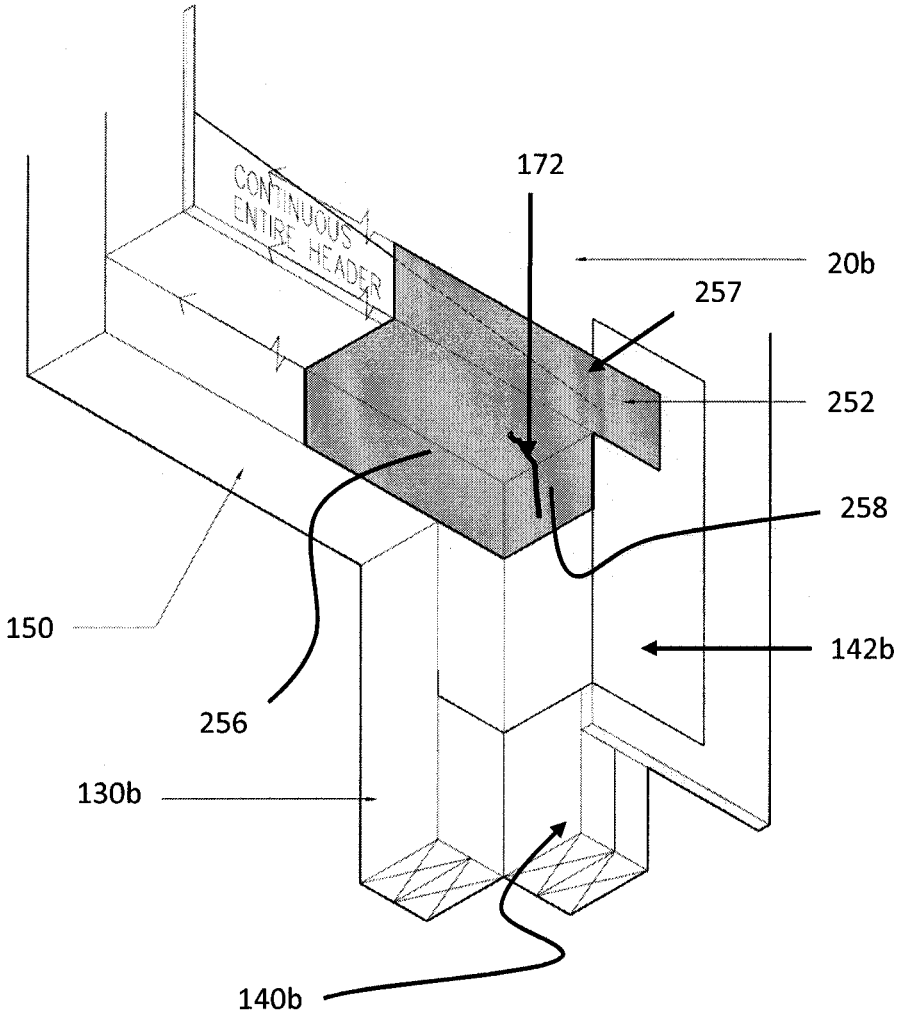
FIG. 11D is a partial perspective view illustrating the task of attaching a header diverter sheet at the top header according to the method for flashing an opening illustrated in FIG. 9.

With reference to the embodiments illustrated in FIG. 11D (and similarly as shown in FIG. 5B, above), after the door or window frame 12 has been installed within the opening 52, the method for flashing an opening 52 in a wall 20, 40 configured to receive a recessed door or window frame 12 further includes attaching a header diverter sheet 252 to the top surface 20*b* of the wall 20 and over the adhesive 170 or 172 along the upper edge of the door or window frame 12. The header diverter sheet 252, according to this embodiment, may have a center strip 254, an outer edge 255, and an inner edge 256, the center strip 254 extending along an entire length of the recessed top header 250 and extending down from the recessed top header 250 at least to the top header 150. The outermost ends of the outer edge 255 and inner edge 256 may be cut, according to an embodiment, to form a wall flap 257 and a jamb flap 258. The center strip 254, in an embodiment, may extend along the entire length of the recessed top header 250, and the outer edge 255 including the wall flap 257 may be folded around the recessed top header 250 flush against the top surface 20*b* of the wall 20 with the wall flap 257 extending at least past the respective recessed jamb 140*a* and 140*b*. Each jamb flap 258, according to an embodiment, may be folded around the recessed top header 250 extending onto the respective recessed jamb 140*a* and 140*b*, and the inner edge 256 may be folded down from the recessed top header 250 down flush with the top header 150. The header diverter sheet 252 according to an embodiment, may be a non-adhesive laminate for structural sealing, for example a 12 inch wide flexible sheet of FUTURE FLASH® self-sealing waterproof flashing membrane, as described above, and having a nominal thickness of 25 mils. In other embodiments, the header diverter sheet 252 may have a width less than or greater than 12 inches (for example, 3, 6, 9, 18, or 36 inches), and may have a nominal thickness greater than 25 mils (for example, 35 mils or 40 mils). However, embodiments of the present invention are not limited to these embodiments.

Figure 11E:
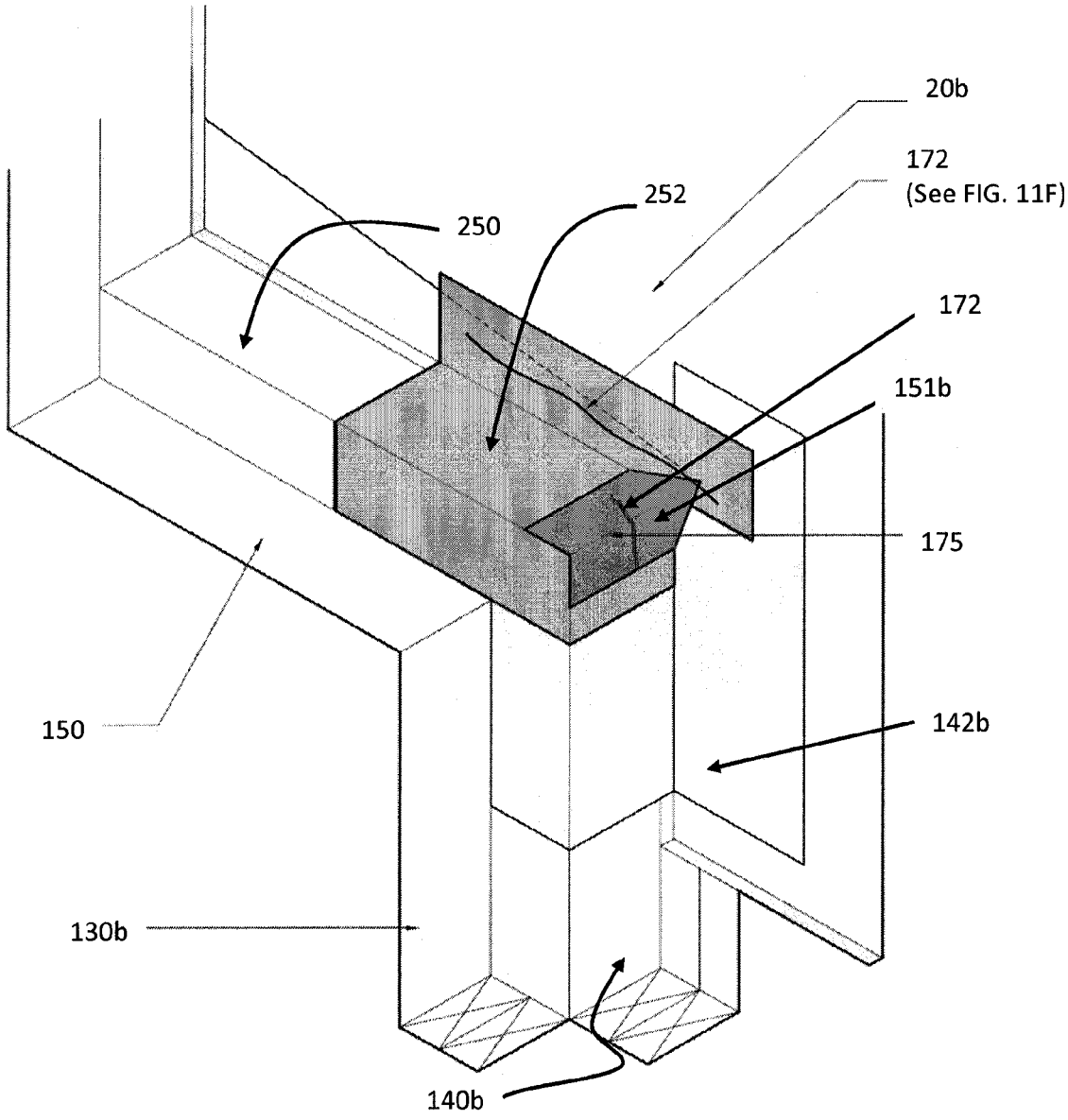
FIG. 11E is a partial perspective view illustrating the task of applying a sheet of flexible membrane according to the method for flashing an opening illustrated in FIG. 9.

With continued reference to the embodiments illustrated in FIGS. 11D and 11E (and similarly as shown in FIG. 5B, above), the method for flashing an opening 52 in a wall 20, 40 configured to receive a recessed door or window frame 12 according to these embodiments further includes applying an adhesive 170 or 172 at each respective intersection 151*a* and 151*b* of the recessed top header 250 and each recessed jamb 140*a* and 140*b*. The adhesive 170 or 172 according to this embodiment may be adhesive strips 170 or sealant 172. In an embodiment where the adhesive is sealant 172, the sealant 172 may be of a high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO. In another embodiment, the adhesive may be an adhesive strip 170, and according to an embodiment, may be double-sided tape having a thickness of ⅜ inch, for example double-sided tape manufactured by TREMCO. In another embodiment, the adhesive strip 170 may be double-sided tape having a thickness of 3⁄16 inch.

With continued reference to the embodiments illustrated in FIG. 11E (and similarly as shown in FIG. 5B, above), the method for flashing an opening 52 in a wall 20, 40 configured to receive a recessed door or window frame 12 according to these embodiments further includes applying a sheet of flexible membrane 175 at each respective intersection 151*a* and 151*b* of the recessed top header 250 and each recessed jamb 140*a* and 140*b* over the adhesive 170 or 172 at each respective intersection 151*a* and 151*b*, and stretching each sheet of flexible membrane 175 over an outside edge of the intersection 151*a* and 151*b* and flush with the wall 20, the top header 150, and the recessed top header 250. The sheet of flexible membrane 175, according to this embodiment, may be a strip of stretchable film or tape, for example, having a hexagonal or pentagonal shape with a quasi-triangular portion stretched over the outside edge of the respective intersection 151*a* or 151*b* and trimmed flush with the wall 20. In an embodiment, the sheet of flexible membrane 175 may be precut at its corners to streamline installation at the corners or to facilitate bending, stretching, or installation. In an embodiment, the sheet of flexible membrane 175 may be a 4 inch by 6 inch strip of stretchable self-adhering, pliable polymer surface membrane or tape having a pentagonal or hexagonal shape, for example, the Butterfly Tape™ described above, and having a nominal thickness of 35 mils. In another embodiment, the sheet of flexible membrane 175 may be a 6 inch by 6 inch strip of stretchable self-adhering, pliable polymer surface membrane or tape having a pentagonal or hexagonal shape, for example, the Butterfly Tape™ described above.

Figure 11F:
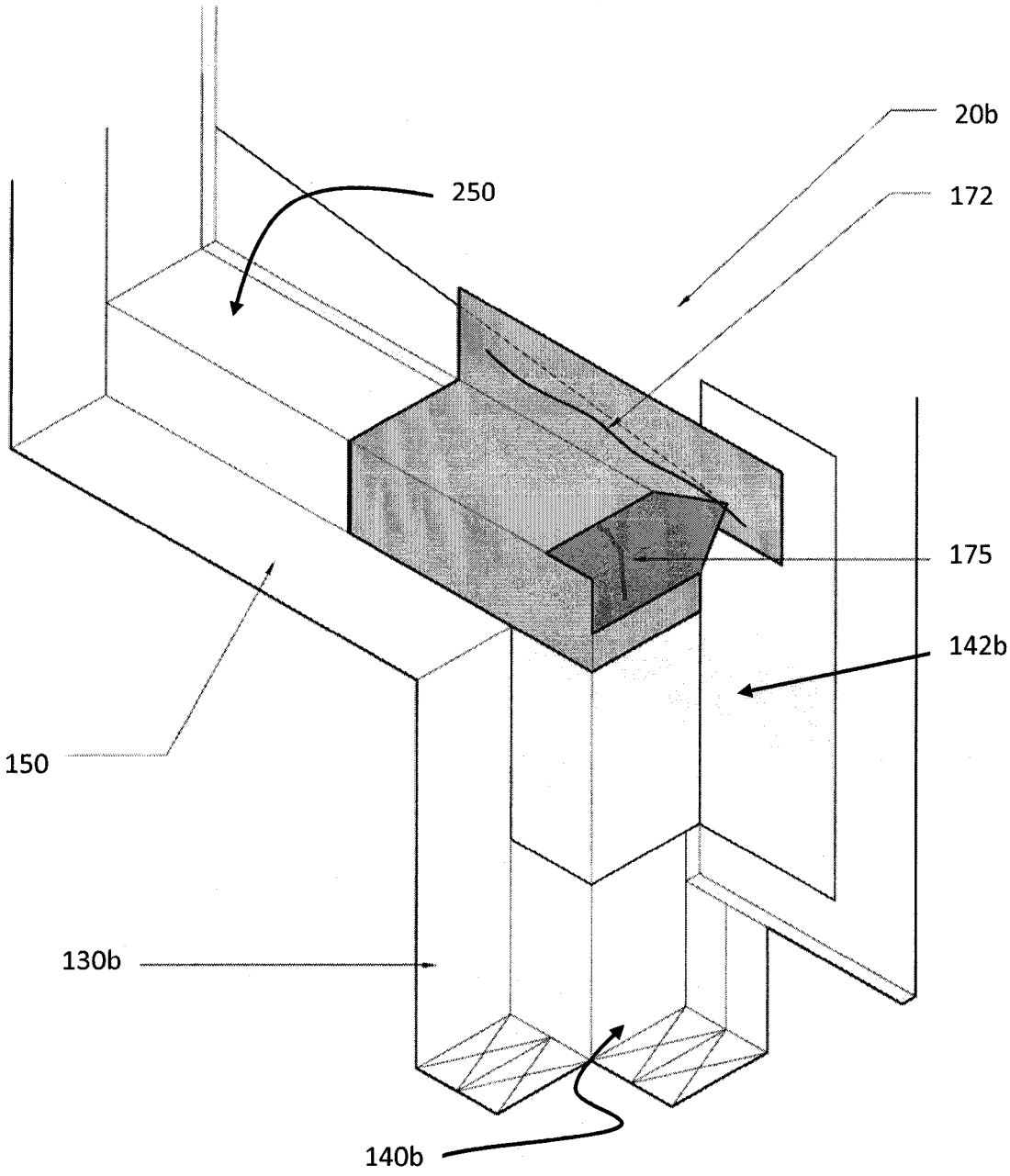
FIG. 11F is a partial perspective view illustrating an additional task of applying an adhesive along the header diverter sheet illustrated in FIGS. 11D and 11E and according to the method for flashing an opening illustrated in FIG. 9.

With reference now to the embodiments illustrated in FIG. 11F (and similarly as shown in FIG. 5B, above), the method for flashing an opening 52 in a wall 20, 40 configured to receive a recessed door or window frame 12, in some embodiments, may include applying an adhesive 170 or 172 along an upper edge of the door or window frame 12 along the header diverter sheet 252. The adhesive, 170 or 172, according to an embodiment, may be a continuous bead of sealant 172. The sealant 172, according to this embodiment, may be the high quality polyurethane caulk configured to adhere to surfaces including wood, vinyl, and metal across a wide range of temperatures experienced in typical window and/or door frames exposed to various weather conditions, for example, the FUTURE FLASH® Sealant, described above. In this embodiment, the sealant 172 may be applied as an approximately ½ inch bead of sealant. In an embodiment, the sealant 172 may be applied along the entire length of the opening 52 at the recessed top header 250 over the header diverter sheet 252 in an upside-down V-shape or pyramid-shape applied starting at a center of the header diverter sheet 252 and running down to each corner at the intersection 151*a* and 151*b* of the recessed top header 250 and each recessed jamb 140*a* and 140*b*. In another embodiment, the sealant 172 may be applied along the entire length of the opening 52 at the recessed top header 250 over the header diverter sheet 252 in an approximately horizontal shape extending to each corner at the intersection 151*a* and 151*b* of the recessed top header 250 and each recessed jamb 140*a* and 140*b*. The adhesive, 170 or 172, according to another embodiment, may be an adhesive strip 170. The adhesive strip 170, according to an embodiment, may be double-sided tape. For example, in an embodiment, the adhesive strip 170 may be double-sided tape having a thickness of ⅜ inch, for example double-sided tape manufactured by TREMCO. In another embodiment, the adhesive strip 170 may be double-sided tape having a thickness of 3⁄16 inch. In an embodiment, the adhesive strip 170 may be applied along the entire length of the opening 52 at the recessed top header 250 over the header diverter sheet 252 in an upside-down V-shape or pyramid-shape applied starting at a center of the header diverter sheet 252 and running down to each corner at the intersection 151*a* and 151*b* of the recessed top header 250 and each recessed jamb 140*a* and 140*b*. In another embodiment, the adhesive strip 170 may be applied along the entire length of the opening 52 at the recessed top header 250 over the header diverter sheet 252 in an approximately horizontal shape extending to each corner at the intersection 151*a* and 151*b* of the recessed top header 250 and each recessed jamb 140*a* and 140*b*.

Figure 11G:
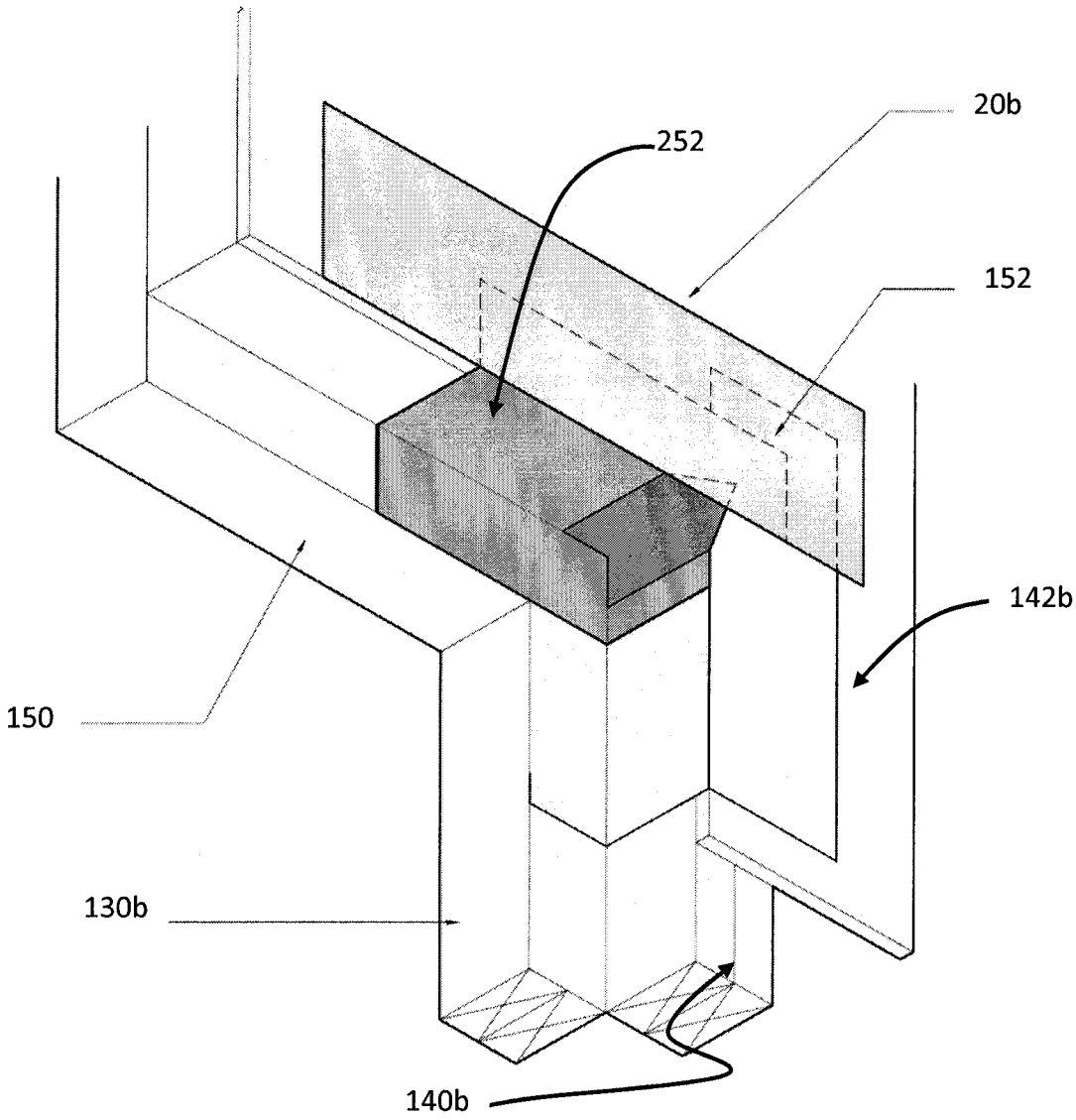
FIG. 11G is a partial perspective view illustrating an additional task of attaching a second header diverter sheet to the opening illustrated in FIG. 9 and according to an embodiment for a method for flashing an opening.

With reference now to the embodiments illustrated in FIG. 11G (and similarly as shown in FIG. 5B, above), the method for flashing an opening 52 in a wall 20, 40 configured to receive a recessed door or window frame 12, in these embodiments, further includes attaching a secondary header diverter sheet 152 to the top surface 20*b* of the wall 20 and over the header diverter sheet 252. The secondary header diverter sheet 152, according to an embodiment, may be a non-adhesive laminate for structural sealing, for example a 9 inch wide flexible sheet of FUTURE FLASH® self-sealing waterproof flashing membrane, as described above, and having a nominal thickness of 25 mils. In other embodiments, the header diverter sheet 152 may have a width less than or greater than 9 inches (for example, 3, 6, 12, 18, or 36 inches), and may have a nominal thickness greater than 25 mils (for example, 35 mils or 40 mils). However, embodiments of the present invention are not limited to these embodiments.

With reference back to the embodiments illustrated in FIGS. 9 and 11C, the method for flashing an opening 52 in a wall 20, 40 configured to receive a recessed door or window frame 12 according to these embodiments further includes placing an adhesive strip 170 along the diverter flap 329, the adhesive strip 170 being configured to attach the diverter flap 329 to a backside of the door or window frame 12. The method may further include attaching a lower edge of the door or window frame 12 to the sill diverter dam 322 with the adhesive strip 170. The adhesive strip 170, according to an embodiment, may be double-sided tape. For example, in an embodiment, the adhesive strip 170 may be double-sided tape having a thickness of ⅜ inch, for example double-sided tape manufactured by TREMCO. In another embodiment, the adhesive strip 170 may be double-sided tape having a thickness of 3/16 inch.

In the embodiments described above with references to FIGS. 9, 10, and 11A-11G, and in conjunction with FIGS. 7A-7D, for example, attaching the sill diverter sheet 123, attaching the lower strip of weep flashing 111, attaching the jamb diverter sheets 143, and attaching the header diverter sheets 152 and 252, can be performed by using sealant, staples, nails, screws, tacks, or any other suitable fasteners or fastening material directly penetrating through the flashing material 123, 111, 143, 152, and/or 252. In embodiments where the flashing material 123, 111, 143, 152, and/or 252 is the flexible sheet of sandwich-type flashing, for example, the FUTURE FLASH® self-sealing waterproof flashing membrane described above, and the inner core of rubberized asphalt may be configured to self-seal any holes created by attaching these flashing materials 123, 111, 143, 152, and/or 252 using conventional fasteners, without the need to apply further sealants.

According to other aspects of the present invention, a kit for flashing an opening 50 in a wall 20, 40 configured to receive a flat door or window frame 10, in an embodiment, includes a sill diverter sheet 113 for forming a sill diverter dam 112 at a bottom sill 110 of the opening 50, one sheet of flexible membrane 175 for each of the intersections 131*a* and 131*b* of the bottom sill 110 and each side jamb 130*a* and 130*b*, a lower strip of weep flashing 111, one jamb diverter sheet 162*a* and 162*b* for each of the side jambs 130*a* and 130*b*, a header diverter sheet 152, adhesive strips 170 for attaching the sill diverter dam 112 to the flat door or window frame 10, and sealant 172.

The sill diverter sheet 113 in the kit, according to the embodiment described above, may be the non-adhesive laminate for structural sealing, for example the 9 inch or 3 inch wide flexible sheet of FUTURE FLASH® self-sealing waterproof flashing membrane, as described above, and having a nominal thickness of 25 mils. In other embodiments of the kit, the sill diverter sheet 113 may have a width less than or greater than 9 or 12 inches (for example, 3, 6, 18, or 36 inches), and may have a nominal thickness greater than 25 mils (for example, 35 mils or 40 mils). The lower strip of weep flashing 111 in the kit, according to the embodiment described above, may be the non-adhesive laminate for structural sealing, for example a 3 inch wide flexible sheet of FUTURE FLASH® self-sealing waterproof flashing membrane, as described above, and having a nominal thickness of 25 mils. In other embodiments of the kit, the lower strip of weep flashing 111 may have a width greater than three inches (for example, 6, 9, 12, 18, or 36 inches), and may have a nominal thickness greater than 25 mils (for example, 35 mils or 40 mils). The jamb diverter sheets 162*a* and 162*b* in the kit, according to the embodiment described above, may be the non-adhesive laminate for structural sealing, for example a 9 inch wide flexible sheet of FUTURE FLASH® self-sealing waterproof flashing membrane, as described above, and having a nominal thickness of 25 mils. In other embodiments of the kit, the jamb diverter sheet 162*a* and 162*b* may have a width less than or greater than nine inches (for example, 3, 6, 12, 18, or 36 inches), and may have a nominal thickness greater than 25 mils (for example, 35 mils or 40 mils). The header diverter sheet 152 in the kit, according to the embodiment described above, may be the non-adhesive laminate for structural sealing, for example a 9 inch wide flexible sheet of FUTURE FLASH® self-sealing waterproof flashing membrane, as described above, and having a nominal thickness of 25 mils. In other embodiments of the kit, the header diverter sheet 152 may have a width less than or greater than nine inches (for example, 3, 6, 12, 18, or 36 inches), and may have a nominal thickness greater than 25 mils (for example, 35 mils or 40 mils).

The sheets of flexible membrane 175 in the kit, according to the embodiment described above, may be the strips of stretchable film or tape, for example, having a hexagonal or pentagonal shape with a quasi-triangular portion configured to be stretched and trimmed flush to a backside of the of the door or window frame 10, for example. In an embodiment, the sheets of flexible membrane 175 may be precut at their corners to streamline installation at the corners or to facilitate bending, stretching, or installation. In an embodiment of the kit, the sheets of flexible membrane 175 may be 4 inch by 6 inch strips of stretchable self-adhering, pliable polymer surface membrane or tape having a hexagonal or pentagonal shape, for example, Butterfly Tape™ manufactured by MFM Building Products Corp., and having a nominal thickness of 35 mils. In another embodiment of the kit, the sheets of flexible membrane 175 may be 6 inch by 6 inch strips of stretchable self-adhering, pliable polymer surface membrane or tape having a hexagonal or pentagonal shape, for example, the Butterfly Tape™ described above. In these embodiments, the sheets of flexible membrane 175 may be precut to lengths corresponding to various opening 50 sizes and sill 110 widths to be cut-to-size in the field. The adhesive strips 170 in the kit, according to the embodiment described above, may be the double-sided tape having a thickness of ⅜ inch, for example double-sided tape manufactured by TREMCO. In another embodiment of the kit, the adhesive strips 170 may be the double-sided tape having a thickness of 3/16 inch. In these embodiments, the adhesive strips 170 may be precut to lengths corresponding to various opening 50 sizes to be cut-to-length in the field. The sealant 172 in the kit, according to an embodiment, may be the high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

According to other aspects of the present invention, a kit for flashing an opening 52 in a wall 20, 40 configured to receive a recessed door or window frame 12 having a production recess, in an embodiment, includes a sill diverter sheet 123 for forming a sill diverter dam 122 at a bottom sill 110 of the opening 52, one sheet of flexible membrane 175 for each of the intersections 141*a* of the recessed sill 120 and each recessed jamb 140*a* and 140*b*, one recessed jamb diverter sheet 143 for each of the recessed jambs 140*a* and 140*b* to form the recessed jamb diverter strips 142*a* and 142*b*, a header diverter sheet 252, one sheet of flexible membrane 175 for each of the intersections 151*a* and 151*b* of the recessed top header 250 and each recessed jamb 140*a* and 140*b*, a secondary header diverter sheet 152, adhesive strips 170, and sealant 172.

The sill diverter sheet 123 in the kit, according to the embodiment described above, may be the non-adhesive laminate for structural sealing, for example a 12 inch wide flexible sheet of FUTURE FLASH® self-sealing waterproof flashing membrane, and having a nominal thickness of 40 mils. In other embodiments of the kit, the sill diverter sheet 123 may have a width less than or greater than 12 inches (for example, 3, 6, 9, 18, or 36 inches), and may have a nominal thickness less than 40 mils (for example, 25 mils or 35 mils). In an embodiment of the kit for a production recess having a depth greater than 4 inches but less than 8 inches, the sill diverter sheet 123 may be an 18 inch wide FUTURE FLASH® self-sealing waterproof flashing membrane having a nominal thickness of 40 mils. In other embodiments of the kit for a production recess having a depth greater than 8 inches, the sill diverter sheet 123 may be a 36 inch wide FUTURE FLASH® self-sealing waterproof flashing membrane having a nominal thickness of 40 mils. The recessed jamb diverter sheet 143 in the kit, according to the embodiment described above, may be the non-adhesive laminate for structural sealing, for example a 12 inch wide flexible sheet of FUTURE FLASH® self-sealing waterproof flashing membrane, and having a nominal thickness of 25 mils. In other embodiments of the kit, the recessed jamb diverter sheet 143 may have a width less than or greater than 12 inches (for example, 3, 6, 9, 18, or 36 inches), and may have a nominal thickness greater than 25 mils (for example, 35 mils or 40 mils). The header diverter sheet 252 in the kit, according to the embodiment described above, may be the non-adhesive laminate for structural sealing, for example a 12 inch wide flexible sheet of FUTURE FLASH® self-sealing waterproof flashing membrane, as described above, and having a nominal thickness of 25 mils. In other embodiments of the kit, the header diverter sheet 252 may have a width less than or greater than 12 inches (for example, 3, 6, 9, 18, or 36 inches), and may have a nominal thickness greater than 25 mils (for example, 35 mils or 40 mils). The secondary header diverter sheet 152 in the kit, according to the embodiment described above, may be the non-adhesive laminate for structural sealing, for example a 9 inch wide flexible sheet of FUTURE FLASH® self-sealing waterproof flashing membrane, as described above, and having a nominal thickness of 25 mils. In other embodiments of the kit, the secondary header diverter sheet 152 may have a width less than or greater than 9 inches (for example, 3, 6, 12, 18, or 36 inches), and may have a nominal thickness greater than 25 mils (for example, 35 mils or 40 mils).

The sheets of flexible membrane 175 in the kit, according to the embodiment described above, may be the strips of stretchable film or tape, for example, having a hexagonal or pentagonal shape with a quasi-triangular portion configured to be stretched and trimmed flush to a backside of the of the door or window frame 12 or flush with the wall 20 or top header 150, for example. In an embodiment, the sheets of flexible membrane 175 may be precut at their corners to streamline installation at the corners or to facilitate bending, stretching, or installation. In an embodiment of the kit, the sheets of flexible membrane 175 may be 4 inch by 6 inch strips of stretchable self-adhering, pliable polymer surface membrane or tape having a hexagonal or pentagonal shape, for example, Butterfly Tape™ manufactured by MFM Building Products Corp., and having a nominal thickness of 35 mils. In another embodiment of the kit, the sheets of flexible membrane 175 may be 6 inch by 6 inch strips of stretchable self-adhering, pliable polymer surface membrane or tape having a hexagonal or pentagonal shape, for example, the Butterfly Tape™ described above. In these embodiments, the sheets of flexible membrane 175 may be precut to lengths corresponding to various opening 52 sizes and sill 110 widths to be cut-to-size in the field. The adhesive strips 170 in the kit, according to the embodiment described above, may be the double-sided tape having a thickness of ⅜ inch, for example double-sided tape manufactured by TREMCO. In another embodiment of the kit, the adhesive strips 170 may be the double-sided tape having a thickness of 3/16 inch. In these embodiments, the adhesive strips 170 may be precut to lengths corresponding to various opening 52 sizes to be cut-to-length in the field. The sealant 172 in the kit, according to an embodiment, may be the high quality polyurethane caulk configured to adhere to surfaces including wood, vinyl, and metal across a wide range of temperatures experienced in typical window and/or door frames exposed to various weather conditions, for example, FUTURE FLASH® Sealant made by TREMCO.

According to another aspect of the present invention, the kit for flashing an opening 52 in a wall 20, 40 configured to receive a recessed door or window frame 12 having a production recess, in an embodiment, may include the sill diverter sheet 123 for forming the sill diverter dam 122 at the bottom sill 110 (as described above), the sheet of flexible membrane 175 for each of the intersections 141*a* of the recessed sill 120 and each recessed jamb 140*a* and 140*b* (as described above), the recessed jamb diverter sheet 143 for each of the recessed jambs 140*a* and 140*b* to form the recessed jamb diverter strips 142*a* and 142*b* (as described above), the header diverter sheet 252 (as described above), the sheet of flexible membrane 175 for each of the intersections 151*a* and 151*b* of the recessed top header 250 and each recessed jamb 140*a* and 140*b* (as described above), the secondary header diverter sheet 152 (as described above), adhesive strips 170 (as described above), sealant 172 (as described above), as well as a sill diverter sheet 323 for forming a bottom sill diverter dam 322 at the bottom sill 10, one sheet of flexible membrane 175 at each intersection 131*a* and 131*b* of the bottom sill 110 and each side jamb 130*a* and 130*b*, and a lower strip of weep flashing 111.

The sill diverter sheet 323 for the bottom sill diverter dam 322 in the kit, according to the embodiment described above, may be the non-adhesive laminate for structural sealing, for example a 6 inch, 9 inch, or 12 inch wide flexible sheet of FUTURE FLASH® self-sealing waterproof flashing membrane, as described above, and having a nominal thickness of 25 mils. In other embodiments of the kit, the sill diverter sheet 323 may have a width less than or greater than 6, 9, or 12 inches (for example, 3, 18, or 36 inches), and may have a nominal thickness greater than 25 mils (for example, 35 mils or 40 mils). In an embodiment of the kit for a production recess having a depth greater than 4 inches but less than 8 inches, the sill diverter sheet 323 may be the 18 inch wide FUTURE FLASH® self-sealing waterproof flashing membrane having a nominal thickness of 40 mils, described above. In other embodiments of the kit for a production recess having a depth greater than 8 inches, the sill diverter sheet the sill diverter sheet 323 may be the 36 inch wide FUTURE FLASH® self-sealing waterproof flashing membrane having a nominal thickness of 40 mils, described above. The lower strip of weep flashing 111 in the kit, according to the embodiment described above, may be the non-adhesive laminate for structural sealing, for example a 3 inch wide flexible sheet of FUTURE FLASH® self-sealing waterproof flashing membrane, as described above, and having a nominal thickness of 25 mils. In other embodiments of the kit, the lower strip of weep flashing 111 may have a width greater than three inches (for example, 6, 9, 12, 18, or 36 inches), and may have a nominal thickness greater than 25 mils (for example, 35 mils or 40 mils).

While various embodiments for a kit for flashing an opening 50, 52 in a wall 20, 40 configured to receive a flat or recessed door or window frame 10 or 12 have been described above, the kit is not limited to the embodiments described. For example, the kit may be provided for small windows, large windows, doors, other types of recessed doors or windows, other types of flat doors or windows, etc. Kits may be adaptable to industry standard sizes or customizable, according to embodiments of the present invention. In some embodiments, the kits may be single-window kits, and in other embodiments, the kits may be for more than one window, as an alternative to purchasing separate components for flashing an opening 50, 52 in a wall 20, 40 configured to receive a flat or recessed door or window frame 10 or 12 according to the methods described above and embodied in the claims.

Moreover, while throughout the description of the various embodiments for a method for flashing a window, door, or other opening 50, 52, and the various embodiments for a kit for flashing an opening 50, 52 in a wall 20, 40 configured to receive a flat or recessed door or window frame 10 or 12, reference has been made to a sealant 172 and an adhesive or adhesive strip 170, it is to be understood that these materials may be used interchangeably in various embodiments throughout this description. Moreover, as understood and appreciated by those skilled in the art, for various embodiments of the present invention, there are circumstances where sealant 172 may be substituted for adhesive or the adhesive strips 170 or adhesive 170 may be substituted for sealant 172, or other equivalent substitutions may be made, without departing from the spirit and scope of the present invention as described.

Still further, while the method for flashing a window, door, or other opening may be described in this specification with particular dimensions that have proven useful for a broad range of applications, it should be apparent to one of ordinary skill in the art that the apparatus employed in these methods may be scaled up or down, made in other geometries, or modified in other obvious and insignificant ways to accommodate different situations, and the invention is not to be limited to the specific embodiments described here.

While this invention has been described in detail with particular references to embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," "parallel," "perpendicular," "first," "second," and similar have been used herein to describe a spatial relationship of one element to another, it is understood that these terms are intended to encompass different orientations of the various elements and component of the invention in addition to the orientation depicted in the figures.

What is claimed is:

1. A method for flashing an opening in a wall configured to receive a recessed door or window frame having a production recess, the opening defined by a bottom sill, a recessed sill stepped externally down and out from the bottom sill, a pair of side jambs at the bottom sill, a pair of recessed jambs at the recessed sill, a top header in line with the bottom sill, and a recessed top header stepped externally up and out from the top header, the method comprising:

forming a recessed sill diverter dam at the recessed sill comprising:

attaching a sill diverter sheet comprising a center strip, an outer edge, and an inner edge along an entire length of the recessed sill with the center strip forming a shelf along the recessed sill with the inner edge extending up a height to the bottom sill, and cutting outermost ends of the outer edge and inner edge to form a wall flap and a jamb flap at each respective recessed jamb where the center strip extends past the recessed sill, and folding the outer edge of the diverter sheet down such that the outer edge and each wall flap are flush against the wall and folding each jamb flap up flush with its respective recessed jamb with the inner edge flush against the step between the recessed sill and the bottom sill;

applying an adhesive at each intersection of the recessed sill and each recessed jamb over the recessed sill diverter dam;

applying a sheet of flexible membrane at each intersection of the recessed sill and each recessed jamb over the recessed sill diverter dam over the adhesive applied at each intersection, and stretching each sheet of flexible membrane over an outside edge of the respective intersection and flush with the wall;

applying an adhesive to a top surface of the wall along an upper edge of the opening along the recessed top header;

forming a recessed jamb diverter strip at each recessed jamb comprising:

attaching a recessed jamb diverter sheet to the wall adjacent the opening at each recessed jamb, the recessed jamb diverter sheet comprising a center strip, an outer edge, and an inner edge along an entire height of each recessed jamb, with the center strip forming a shelf along the height of each recessed jamb and extending up at least to the recessed top header, and cutting outermost ends of the outer edge and inner edge to form a wall flap, a sill flap, a header flap, and a jamb flap at each respective recessed jamb, wherein the center strip extends along the entire height of the respective recessed jamb, folding the outer edge of the recessed jamb diverter sheet including the wall flap around the respective recessed jamb to be flush against the wall adjacent the opening along at least the height of each recessed jamb with the wall flap extending up at least past the recessed top header at the top surface of the wall and down past the recessed sill, folding each jamb flap around the respective recessed jamb to be flush with the respective side jamb at the opening extending along an entire height of the side jamb, folding each sill flap down onto the recessed sill and flush with an inner edge between the recessed sill and the respective recessed jamb, and folding the header flap up onto the recessed top header from each recessed jamb to be flush with an intersection of the recessed top header and each recessed jamb and to be flush with the wall;

applying sealant along an inside flange of the door or window frame;

placing the door or window frame in the opening;

applying sealant along an outside flange of the door or window frame and over an outside edge of the door or window frame to the extend to the wall surrounding the opening;

attaching a header diverter sheet to the top surface of the wall and over the adhesive along the upper edge of the door or window frame, the header diverter sheet comprising a center strip, an outer edge, and an inner edge, the center strip extending along an entire length of the recessed top header and extending down from the recessed top header at least to the top header, and cutting outermost ends of the outer edge and inner edge to form a wall flap and a jamb flap, wherein the center strip extends along the entire length of the recessed top header, the outer edge including the wall flap is folded around the recessed top header flush against the top surface of the wall with the wall flap extending at least past the respective recessed jamb, each jamb flap is folded around the recessed top header extending onto the respective recessed jamb, and the inner edge is folded down from the recessed top header down flush with the top header;

applying an adhesive at each respective intersection of the recessed top header and each recessed jamb; and applying a sheet of flexible membrane at each respective intersection of the recessed top header and each recessed jamb over the adhesive applied at each respective intersection and stretching each sheet of flexible membrane over an outside edge of the intersection and flush with the wall, the top header, and the recessed top header.

2. The method for flashing an opening of claim 1 further comprising applying an adhesive along an upper edge of the door or window frame along the header diverter sheet; and attaching a secondary header diverter sheet to the top surface of the wall and over the header diverter sheet.

3. The method for flashing an opening of claim 2, wherein the adhesive used to attach the header diverter sheet and the secondary header diverter sheet is a sealant applied along the entire length of the opening at the recessed top header and the header diverter sheet, respectively, in an upside-down V-shape applied starting at a center of the opening and running down to each opening corner.

4. The method for flashing an opening of claim 1, wherein the sill diverter sheet, each recessed jamb diverter sheet, and the header diverter sheet each comprises a non-adhesive self-sealing laminate membrane comprising a central core sheet of bituminous rubberized-asphalt with self-sealing properties.

5. The method for flashing an opening of claim 4, wherein attaching the sill diverter sheet, attaching each recessed jamb diverter sheet, and attaching the header diverter sheet each comprises attaching the non-adhesive self-sealing laminate for structural sealing using sealant, nails, screws, tacks, fasteners, or staples.

6. A method for flashing an opening in a wall configured to receive a recessed window or door frame having a production recess, the opening defined by a bottom sill, a recessed sill stepped externally down and out from the bottom sill, a pair of side jambs at the bottom sill, a pair of recessed jambs at the recessed sill, a top header in line with the bottom sill, and a recessed top header stepped externally up and out from the top header, the method comprising:

forming a recessed sill diverter dam at the recessed sill comprising:

attaching a sill diverter sheet comprising a center strip, an outer edge, and an inner edge along an entire length of the recessed sill with the center strip forming a shelf along the recessed sill with the inner edge extending up a height of a step to the bottom sill, and cutting outermost ends of the outer edge and inner edge to form a wall flap and a jamb flap at each respective recessed jamb where the center strip extends past the recessed sill, and folding the outer edge of the sill diverter sheet down such that the outer edge and each wall flap are flush against the wall and folding each jamb flap up flush with its respective recessed jamb with the inner edge flush against the step between the recessed sill and the bottom sill;

applying an adhesive at each intersection of the recessed sill and each recessed jamb over the recessed sill diverter dam;

applying a sheet of flexible membrane at each intersection of the recessed sill and each recessed jamb over the recessed sill diverter dam over the adhesive applied at each intersection, and stretching each sheet of flexible membrane over an outside edge of the respective intersection and flush with the wall;

applying an adhesive to a top surface of the wall along an upper edge of the opening along the recessed top header;

forming a recessed jamb diverter strip at each recessed jamb comprising:

attaching a recessed jamb diverter sheet to the wall adjacent the opening at each recessed jamb, the recessed jamb diverter sheet comprising a center strip, an outer edge, and an inner edge along an entire height of each recessed jamb, with the center strip forming a shelf along the height of each recessed jamb and extending up at least to the recessed top header, cutting outermost ends of the outer edge and inner edge to form a wall flap, a sill flap, a header flap, and a jamb flap at each respective recessed jamb, wherein the center strip extends along the entire height of the respective recessed jamb, folding the outer edge of the recessed jamb diverter sheet including the wall flap around the respective recessed jamb to be flush against the wall adjacent the opening along at least the height of each recessed jamb with the wall flap extending up at least past the recessed top header at the top surface of the wall and down past the recessed sill, folding each jamb flap around the respective recessed jamb to be flush with the respective side jamb at the opening extending along an entire height of the side jamb, folding each sill flap down onto the recessed sill and flush with an inner edge between the recessed sill and the respective recessed jamb, and folding the header flap up onto the recessed top header from each recessed jamb to be flush with an intersection of the recessed top header and each recessed jamb and to be flush with the wall;

forming a bottom sill diverter dam at the bottom sill comprising:

attaching a sill diverter sheet comprising a center strip, an outer edge, and an inner edge along an entire length of the bottom sill with the center strip forming a shelf along the bottom sill and the outside edge extending down over and past an entire height of the bottom sill at the step, cutting outermost ends of the outer edge and inner edge to form a wall flap, a diverter flap, and a jamb flap at each respective side jamb wherein the outer edge extends down from the bottom sill flush down against the step at the recessed sill, the wall flap extends along a thickness of the side jamb to be flush with the recessed jamb, and each jamb flap is folded up flush with its respective side jamb, and folding the inner edge of the sill diverter sheet up along the length of the bottom sill and at the side jamb where each jamb flap is folded up, thereby forming the shelf with the diverter flap extending along the entire length of the bottom sill as well as along a height of each side jamb configured to receive a backside of the door or window frame configured to be installed at the opening;

applying a sheet of flexible membrane at each intersection of the bottom sill and each side jamb over the bottom sill diverter dam, and stretching each sheet of flexible membrane over an outside edge of the respective intersection and flush with the step;

attaching a lower strip of weep flashing to the step between the bottom sill and the recessed sill overlapping the outer edge of the bottom sill diverter dam adjacent the opening at the bottom sill, the lower strip of weep flashing extending along at least an entire length of the recessed sill;

applying sealant along an inside flange of the door or window frame;

placing the door or window frame in the opening;

applying sealant along an outside flange of the door or window frame and over an outside edge of the door or window frame to the extend to the wall surrounding the opening;

attaching a header diverter sheet to the top surface of the wall and over the adhesive along the upper edge of the door or window frame, the header diverter sheet comprising a center strip, an outer edge, and an inner edge, the center strip extending along an entire length of the recessed top header and extending down from the recessed top header at least to the top header, and cutting outermost ends of the outer edge and inner edge to form a wall flap and a jamb flap, wherein the center strip extends along the entire length of the recessed top header, the outer edge including the wall flap is folded around the recessed top header flush against the top surface of the wall with the wall flap extending at least past the respective recessed jamb, each jamb flap is folded around the recessed top header extending onto the respective recessed jamb and the inner edge is folded down from the recessed top header down flush with the top header;

applying an adhesive at each respective intersection of the recessed top header and each recessed jamb;

applying a sheet of flexible membrane at each respective intersection of the recessed top header and each recessed jamb over the adhesive applied at each respective intersection and stretching each sheet of flexible membrane over an outside edge of the intersection and flush with the wall, the top header, and the recessed top header;

placing an adhesive strip along the diverter flap of the sill diverter dam, the adhesive strip configured to attach the diverter flap to the backside of the door or window frame; and attaching a lower edge of the door or window frame to the bottom sill diverter dam with the adhesive strip.

7. The method for flashing an opening of claim 6 further comprising applying an adhesive along an upper edge of the door or window frame along the header diverter sheet; and attaching a secondary header diverter sheet to the top surface of the wall and over the header diverter sheet.

8. The method for flashing an opening of claim 7, wherein applying the sheet of flexible membrane at each intersection of the bottom sill and each side jamb over the bottom sill diverter dam comprises attaching the sheet of flexible membrane using adhesive, sealant, nails, screws, tacks, fasteners, or staples.

9. The method for flashing an opening of claim 7, wherein the adhesive used to attach the header diverter sheet and the secondary header diverter sheet is a sealant applied along the entire length of the opening at the recessed top header and the header diverter sheet, respectively, in an upside-down V-shape applied starting at a center of the opening and running down to each opening corner.

10. The method for flashing an opening of claim 6, wherein the adhesive strip is double-sided tape.

11. The method for flashing an opening of claim 9, wherein each sill diverter sheet, each recessed jamb diverter sheet, the lower strip of weep flashing, and the header diverter sheet each comprises a non-adhesive self-sealing laminate membrane comprising a central core sheet of bituminous rubberized-asphalt with self-sealing properties.

12. The method for flashing an opening of claim 11, wherein attaching each sill diverter sheet, attaching each recessed jamb diverter sheet, attaching the lower strip of weep flashing, and attaching the header diverter sheet each comprises attaching the non-adhesive self-sealing laminate for structural sealing using sealant, nails, screws, tacks, fasteners, or staples.

* * * * *